US006585441B1

(12) United States Patent
Shamitoff

(10) Patent No.: US 6,585,441 B1
(45) Date of Patent: Jul. 1, 2003

(54) STYLIZED WRITING INSTRUMENT

(76) Inventor: Joel B. Shamitoff, 141 Redhawk Ct., Brisbane, CA (US) 94005

( * ) Notice: Subject to any disclaimer, the term of this patent is extended or adjusted under 35 U.S.C. 154(b) by 0 days.

(21) Appl. No.: 09/569,217

(22) Filed: May 11, 2000

Related U.S. Application Data

(63) Continuation-in-part of application No. 09/480,009, filed on Jan. 10, 2000, which is a continuation of application No. 09/434,828, filed on Nov. 5, 1999, now Pat. No. 6,428,231.

(51) Int. Cl.[7] ..... B43K 5/16
(52) U.S. Cl. ..... 401/115; 401/110; 401/111
(58) Field of Search ..... 401/48, 99, 109, 401/112, 195, 52, 115, 110, 111, 117; D19/46

(56) References Cited

U.S. PATENT DOCUMENTS

| | | | | | |
|---|---|---|---|---|---|
| 2,500,979 | A | * | 3/1950 | Coler-Dark | 401/117 |
| 3,912,401 | A | | 10/1975 | Zepell | |
| 4,035,865 | A | | 7/1977 | McRae et al. | |
| 4,162,754 | A | | 7/1979 | Fleming | |
| 4,377,349 | A | * | 3/1983 | Kunii | 401/115 |
| D292,297 | S | * | 10/1987 | Bingham | D19/42 |
| 4,728,212 | A | | 3/1988 | Spector | |
| 4,986,685 | A | | 1/1991 | Kiyokane | |
| D344,977 | S | * | 3/1994 | Monzyk | D19/42 |
| D345,176 | S | * | 3/1994 | Monzyk | D19/42 |
| D345,375 | S | * | 3/1994 | Monzyk | D19/42 |
| D372,047 | S | * | 7/1996 | Adatte et al. | D19/42 |
| 5,564,849 | A | | 10/1996 | Greer, Jr. | |
| 5,688,062 | A | | 11/1997 | Shih | |
| 5,826,997 | A | | 10/1998 | Coleman et al. | |

FOREIGN PATENT DOCUMENTS

| | | | | |
|---|---|---|---|---|
| CA | 663362 | * | 5/1963 | 401/115 |
| DE | 3908960 | | 9/1990 | B43K/7/00 |
| DE | 3909133 | | 9/1990 | B43K/29/00 |
| FR | 2718081 | | 10/1995 | B43K/25/02 |

* cited by examiner

*Primary Examiner*—David J. Walczak
(74) *Attorney, Agent, or Firm*—Fliesler Dubb Meyer & Lovejoy LLP

(57) ABSTRACT

A stylized writing instrument shaped like a proprietary or familiar object. Embodiments of the invention include a housing shaped like the proprietary or familiar object, a writing implement, and internal mechanisms provided within the housing for extending the writing implement from, and retracting the writing implement into, the housing. The internal mechanisms may comprise a wide variety of actuation systems for extending and retracting the writing implement, including a cam actuation assembly, an edge slide actuation assembly, a gravity actuation assembly, a pressure actuation assembly and a push button actuation assembly.

35 Claims, 62 Drawing Sheets

SECTION A-A

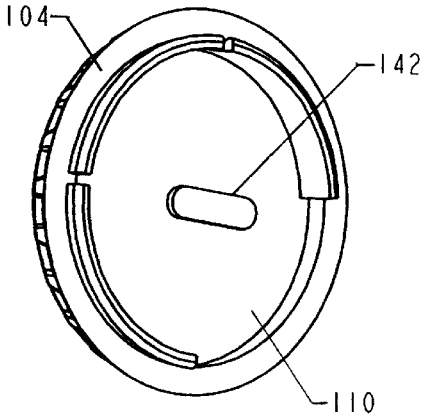
FIG. 14
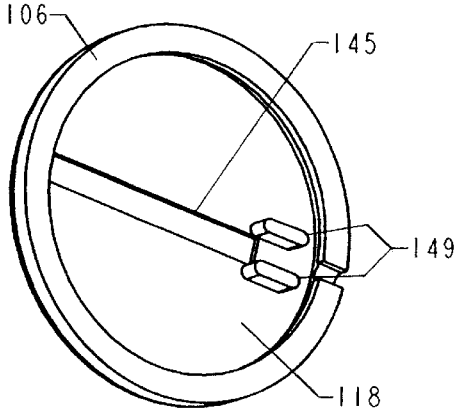
FIG. 15
FIG. 17
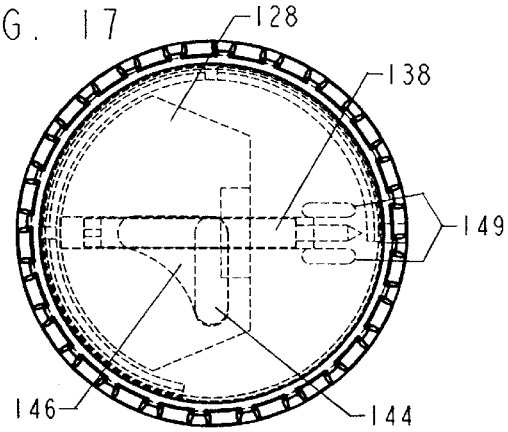
FIG. 16
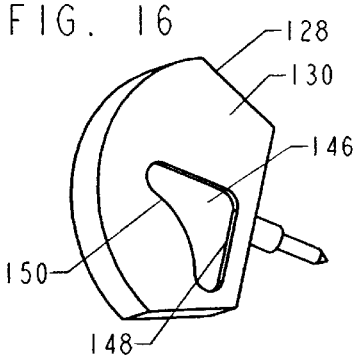
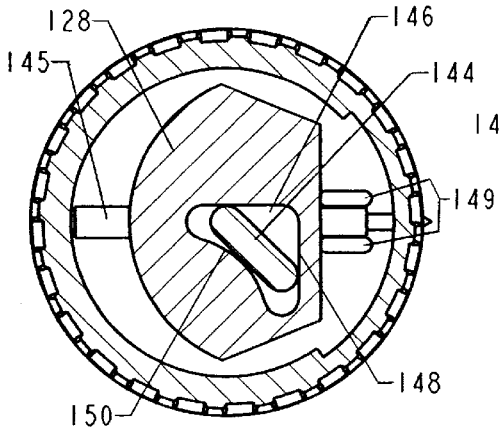
FIG. 18
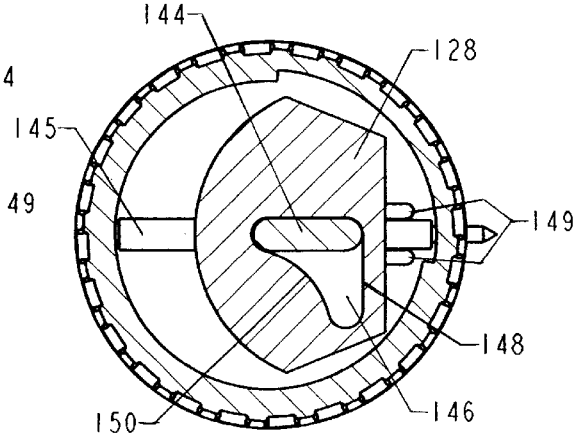
FIG. 19

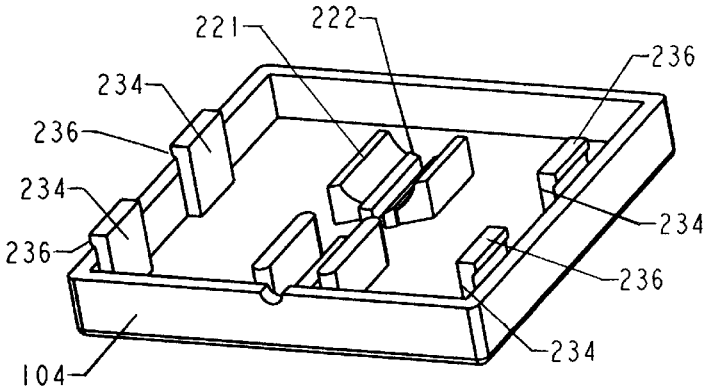
FIG. 35
FIG. 36
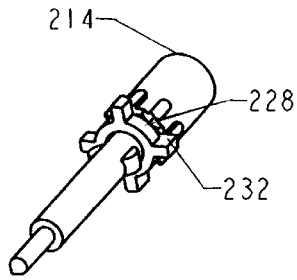
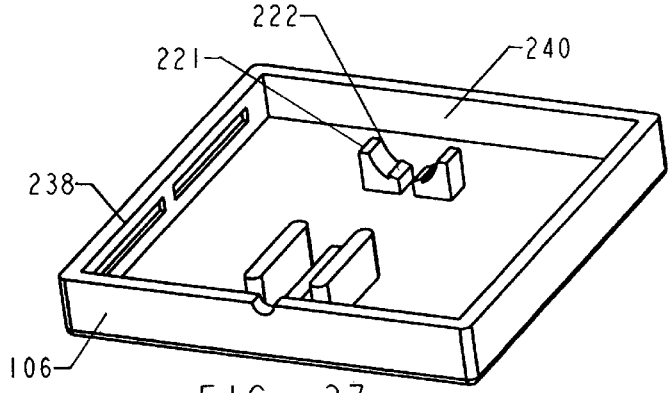
FIG. 37
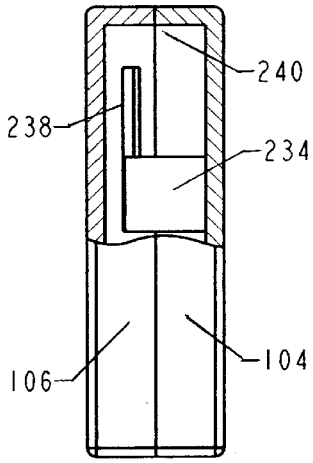
FIG. 38
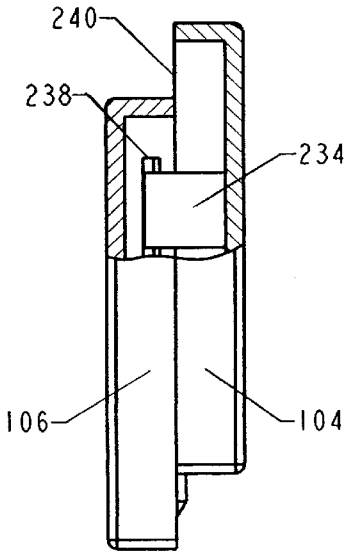
FIG. 39
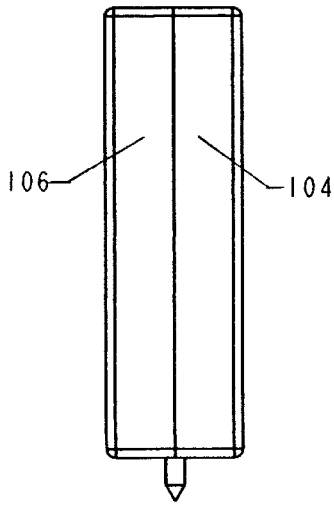
FIG. 40

FIG. 61
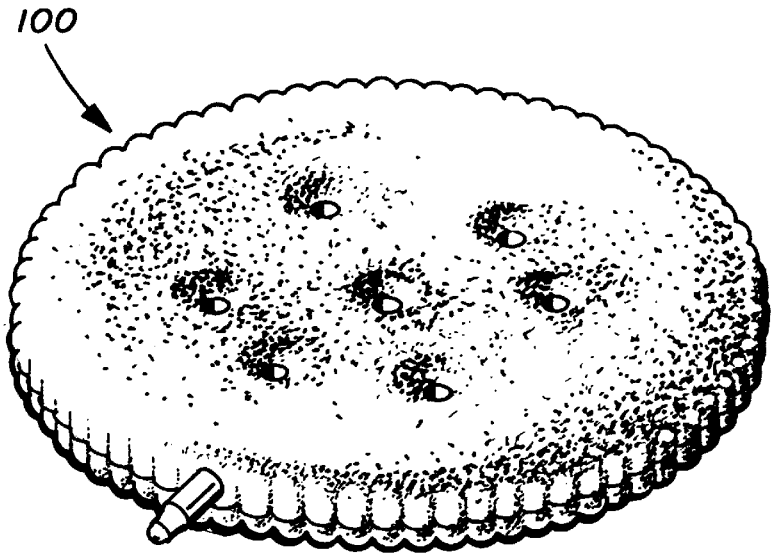
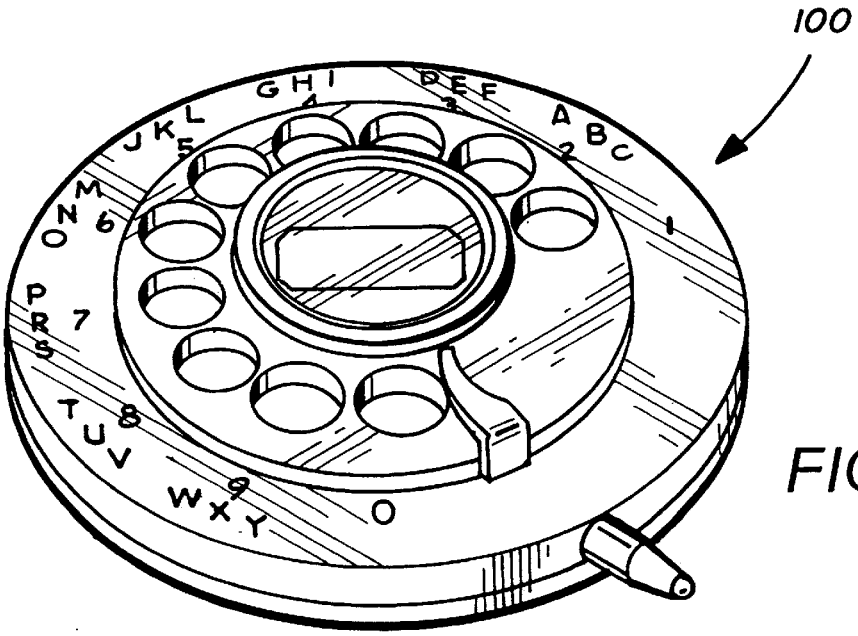
FIG. 62

FIG. 69
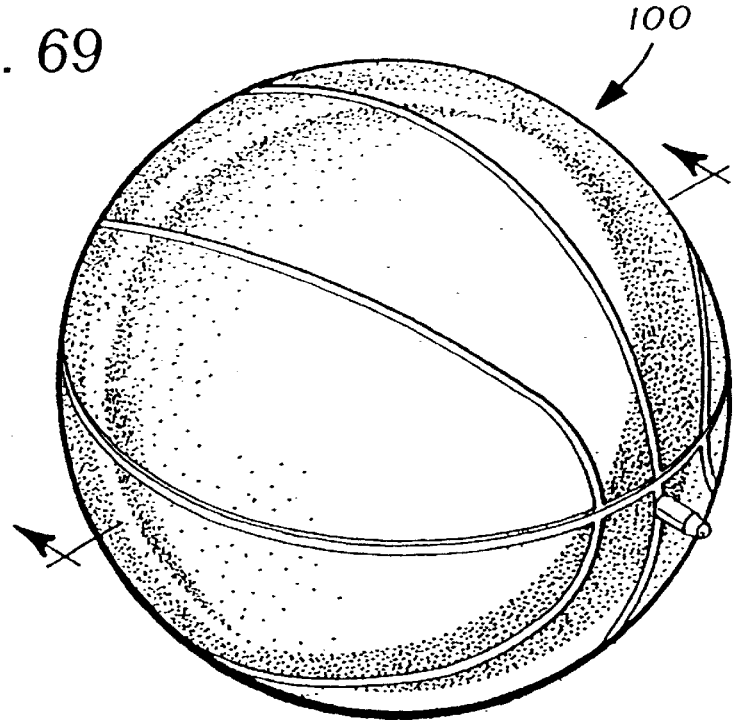
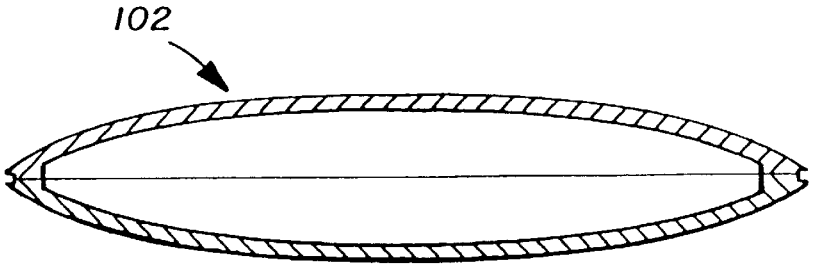
FIG. 69B
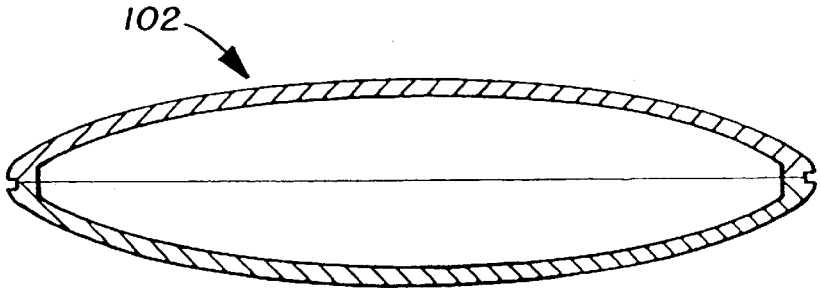
FIG. 69A

FIG. 70
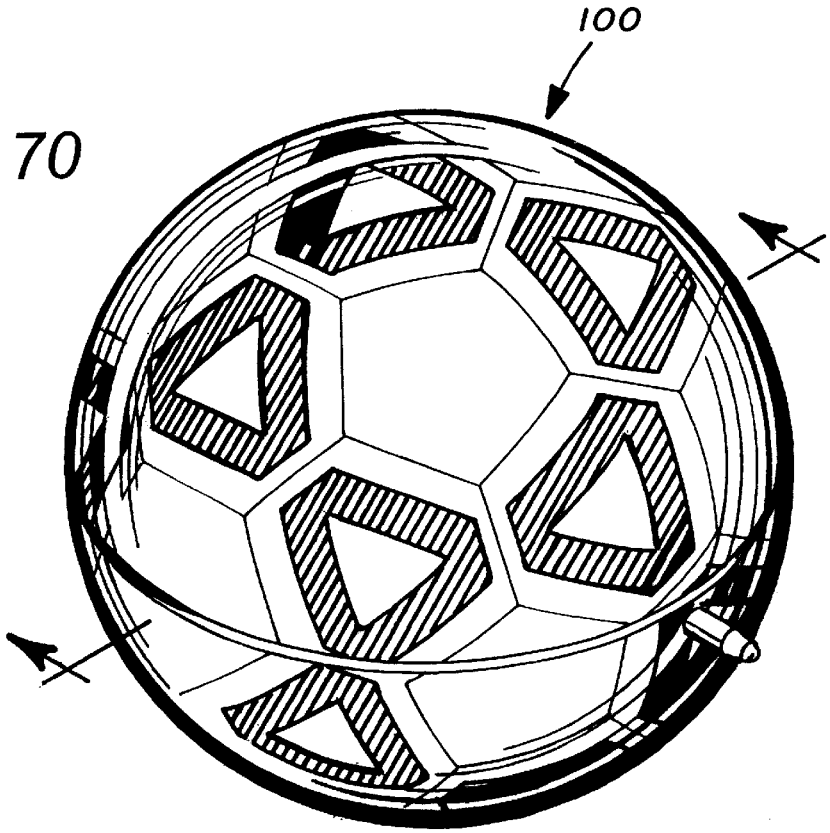
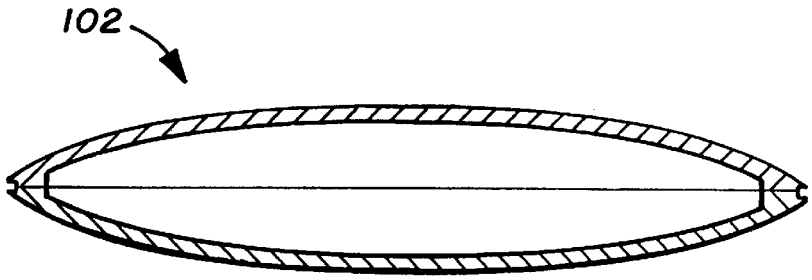
FIG. 70 B
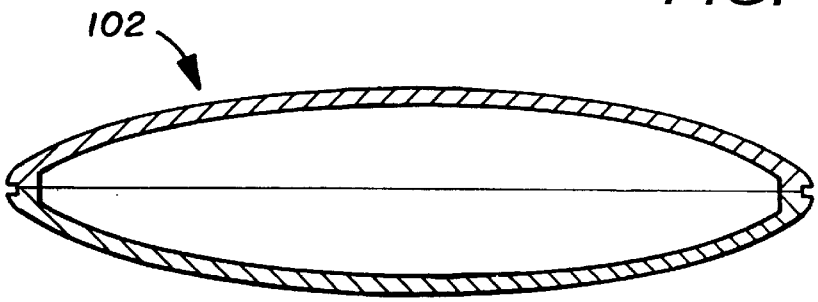
FIG. 70 A

FIG. 71
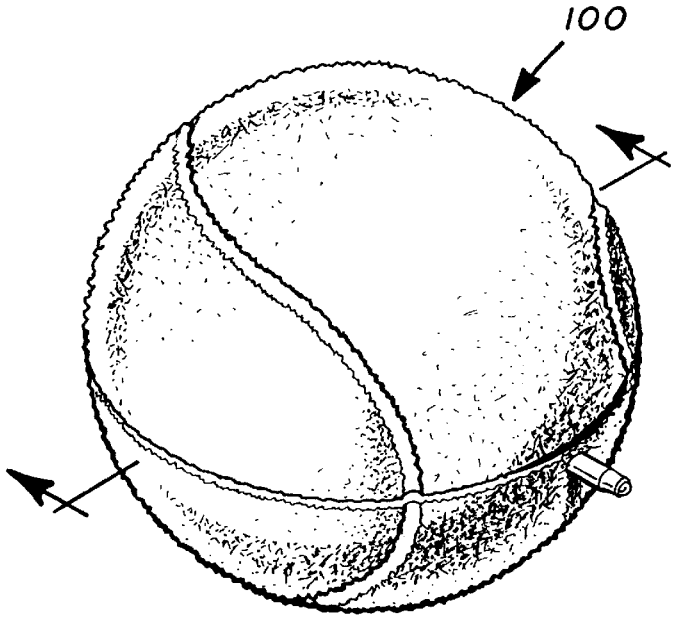
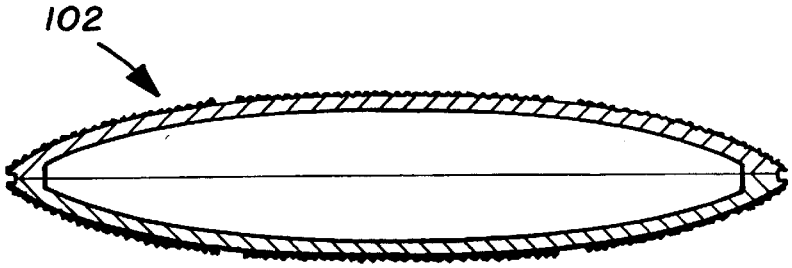
FIG. 71B
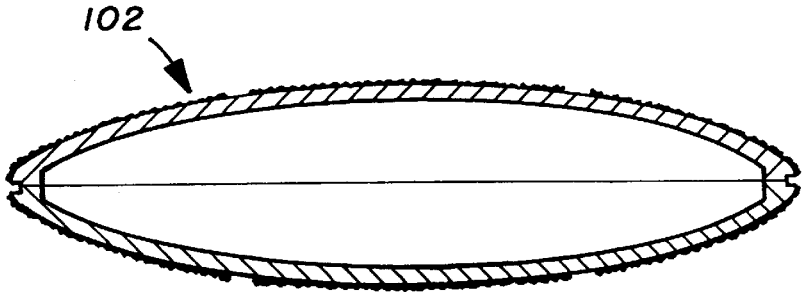
FIG. 71A

FIG. 74
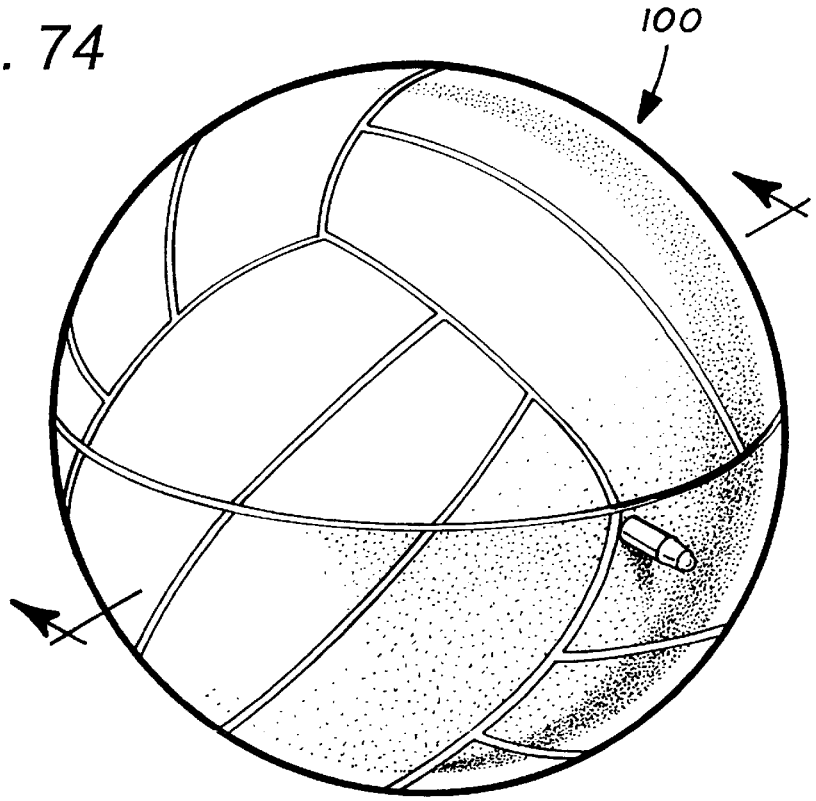
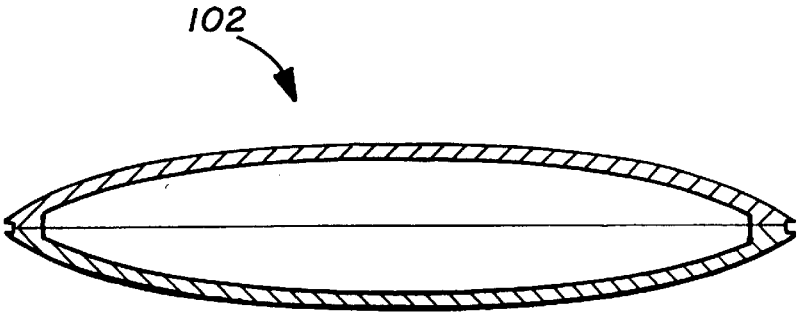
FIG. 74 B
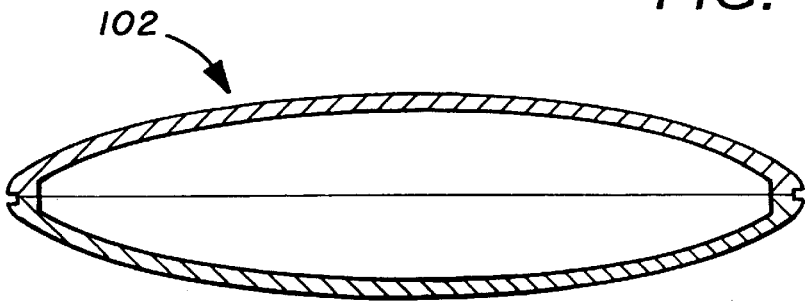
FIG. 74 A

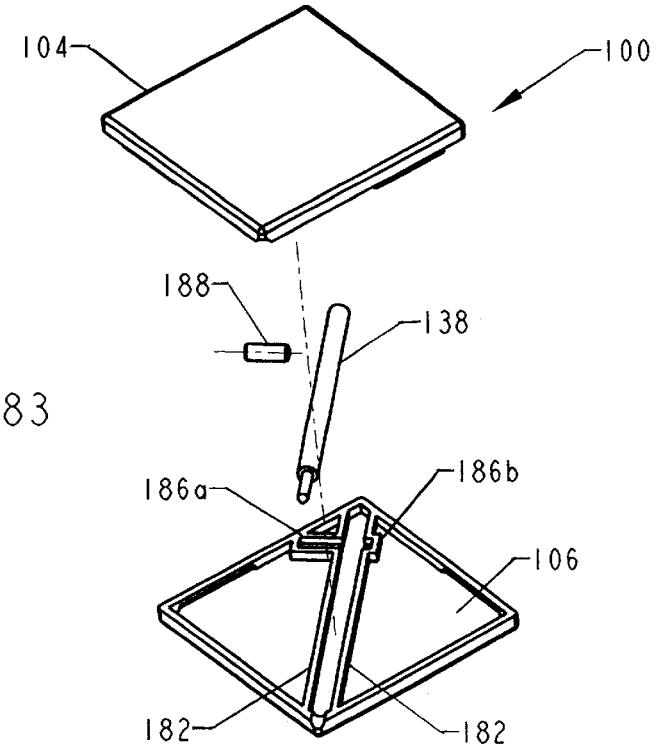
FIG. 83
FIG. 84
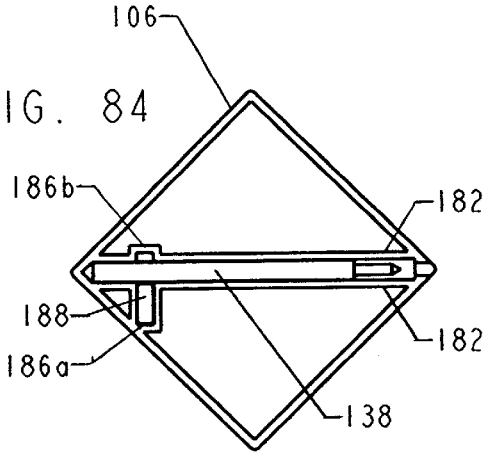
FIG. 85
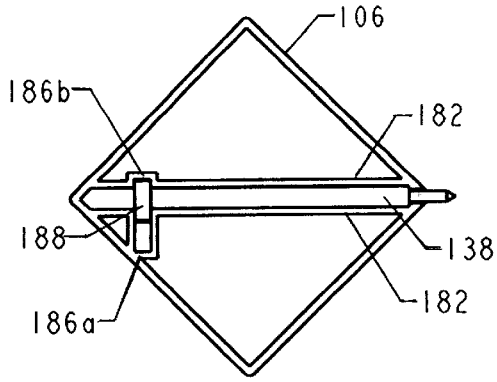

STYLIZED WRITING INSTRUMENT

CROSS REFERENCE TO RELATED APPLICATION

The present application is a continuation-in-part of currently pending U.S. patent application Ser. No. 09/480,009 filed Jan. 10, 2000; which application is a continuation of currently U.S. patent application Ser. No. 09/434,828 filed Nov. 5, 1999 U.S. Pat. No. 6,428,231.

BACKGROUND OF THE INVENTION

1. Field of the Invention

The present invention relates to a writing instrument and in particular to a writing instrument shaped like a familiar and/or proprietary object.

2. Description of the Related Art

Business entities and organizations have long used pens and other writing instruments to promote their name, products and services. By mass distribution of pens having a name, slogan, symbol or other indicia of ownership printed on the pen casing, the entity or organization is able to keep their corporate image in the minds of consumers as the pens pass through commerce.

However, there is nothing distinct about the shape of the pen itself which would serve to engender a particular corporate image, and unless the promotional information printed on a pen is read or studied, the information is useless as a promotional tool. Moreover, even when closely examined, words and images printed on pens are less effective at promoting a product or business than the actual products and symbols of that particular business.

SUMMARY OF THE INVENTION

It is therefore an advantage of the present invention to provide a writing instrument having greater promotional and advertising value than a conventional writing instrument.

It is a further advantage of the present invention to provide a writing instrument shaped like a proprietary object which conjures a corporate image without having to read or study information printed on a side of the instrument.

It is another advantage of the present invention to provide a novelty writing instrument shaped like a familiar, easily recognizable object.

It is another advantage of the present invention that it remains in the shape of a proprietary and/or familiar object at all times, even during use.

It is another advantage of the present invention to provide a writing instrument in the shape of a proprietary and/or familiar object in which a pen tip may be easily extended and retracted.

These and other advantages are provided by the present invention which in general relates to a stylized writing instrument shaped like a proprietary and/or familiar object. In general, embodiments of the invention include a housing shaped like the proprietary and/or familiar object, a writing implement, and internal mechanisms provided within the housing for moving the writing implement between its extended and retracted positions. The internal mechanisms may comprise a wide variety of actuation systems for extending and retracting the writing implement, including, for example a cam actuation assembly, an edge slide actuation assembly, a gravity actuation assembly, a pressure actuation assembly and a push button actuation assembly.

In embodiments of the present invention including the cam actuation assembly, the outer housing may include first and second covers rotatably affixed to each other. The covers define an interior space in which a pen guide having a pen cartridge attached thereto is seated. One of the covers includes a cam on an inner surface, which mates with a cam follower on a juxtaposed surface of the pen guide. Upon rotation of the covers with respect to each other, the cam on the cover and cam follower on the pen guide cause the pen cartridge to move between its extended and retracted positions.

In embodiments of the present invention including the edge slide assembly, the outer housing is formed by a pair of fixedly attached covers which enclose a pen cartridge and an edge slide having a finger-actuated portion extending out beyond the housing. The edge slide includes a sloped surface capable of acting on the pen cartridge so that, by sliding the edge slide between a first and second position, the cartridge maybe moved between its extended and retracted positions.

In embodiments of the present invention including a gravity activation assembly, the outer housing is again formed by a pair of fixedly attached covers which enclose a pen cartridge seated within a channel. The channel further includes a detent along its length, and a locking ball seated atop the pen cartridge. When the writing instrument is tilted downward, gravity causes the pen cartridge to extend from the housing, at which point the locking ball seats partially within the detent, thereby locking the pen in the extended position. In order to retract the pen cartridge, the instrument is tilted upward, so that the ball falls out of the detent and gravity retracts the cartridge. This embodiment may include a cover along an edge of the writing instrument to prevent the pen tip from extending when the instrument is not in use.

In embodiments of the present invention including a pressure activation assembly, the outer housing is formed by a pair of covers having a degree of flexibility and elasticity. The covers enclose a cartridge extension mechanism capable of extending the pen cartridge from the housing upon application of a pressure to the respective covers, and retracting the pen cartridge into the housing upon removal of the pressure from the covers. It is also contemplated in this embodiment that the pen cartridge may be extended as a result of a pressure applied to the edges of the housing.

In embodiments of the present invention including a push button activation assembly, the housing is formed by a pair of fixedly attached covers which enclose a pen cartridge. The pen cartridge may be moved between its extended and retracted positions by a conventional push button assembly which is well known in the pen industry for extending and retracting a pen out of an elongated pen casing.

A writing instrument including any of the above actuation systems may be formed with the shape, appearance, texture and/or color of a wide variety of familiar and/or proprietary objects.

BRIEF DESCRIPTION OF THE DRAWINGS

The present invention will now be described with reference to the drawings in which:

FIG. 14 is a perspective view of the inner surface of the first cover according to an alternative embodiment;

FIG. 15 is a perspective view of the inner surface of the second cover according to an alternative embodiment;

FIG. 16 is a perspective view of a pen guide and pen cartridge according to the embodiments of FIGS. 14 and 15;

FIG. 17 is a top view according to alternative embodiments shown in FIGS. 14–16 with the various internal components shown in phantom;

FIG. 18 is a cross-sectional view of the embodiment shown in FIG. 17 with the pen cartridge partially extended;

FIG. 19 is a cross-sectional view of the embodiment shown in FIG. 17 with the pen cartridge fully extended;

FIG. 35 is a perspective view showing the inner surface of the first cover according to a further alternative embodiment including sliding covers;

FIG. 36 is a perspective view showing the pen cartridge according to the alternative embodiment including sliding covers;

FIG. 37 is a perspective view showing the inner surface of the second cover according to the alternative embodiment including sliding covers;

FIG. 38 is a side view according to the alternative embodiment including sliding covers showing the pen tip in a retracted position;

FIG. 39 is a side view according to the alternative embodiment including sliding covers showing the covers sliding with respect to each other to extend the pen tip;

FIG. 40 is a side view according to the alternative embodiment including sliding covers showing the pen tip extended;

FIG. 61 is a perspective view of the present invention shaped like a Ritz® cracker;

FIG. 62 is a perspective view of the present invention shaped like a rotary phone dial;

FIG. 69 is a perspective view of the present invention shaped like a basketball;

FIGS. 69A and 69B are cross-sectional views of an alternative embodiment to that shown in FIG. 69;

FIG. 70 is a perspective view of the present invention shaped like a soccer ball;

FIGS. 70A and 70B are cross-sectional views of an alternative embodiment to that shown in FIG. 70;

FIG. 71 is a perspective view of the present invention shaped like a tennis ball;

FIGS. 71A and 71B are cross-sectional views of an alternative embodiment to that shown in FIG. 71;

FIG. 74 is a perspective view of the present invention shaped like a volleyball;

FIGS. 74A and 74B are cross-sectional views of an alternative embodiment to that shown in FIG. 74;

FIGS. 83–85 illustrate an exploded perspective and top views of the gravity activated embodiment of the present invention;

DETAILED DESCRIPTION

Figure 1:
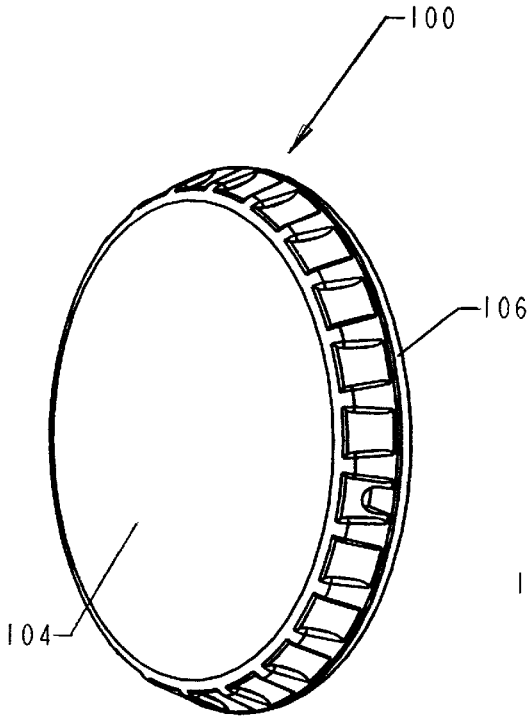
FIG. 1 is a perspective view of the writing instrument.
Figure 2:
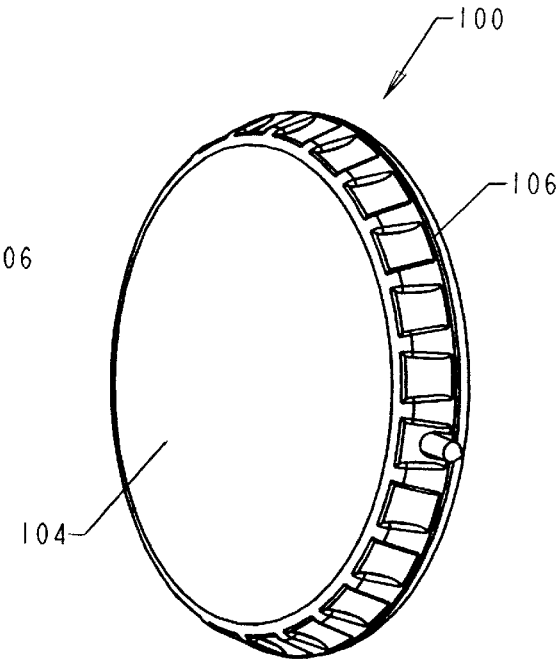
FIG. 2 is a perspective view of the writing instrument with the pen cartridge in an extended position.
Figure 3:
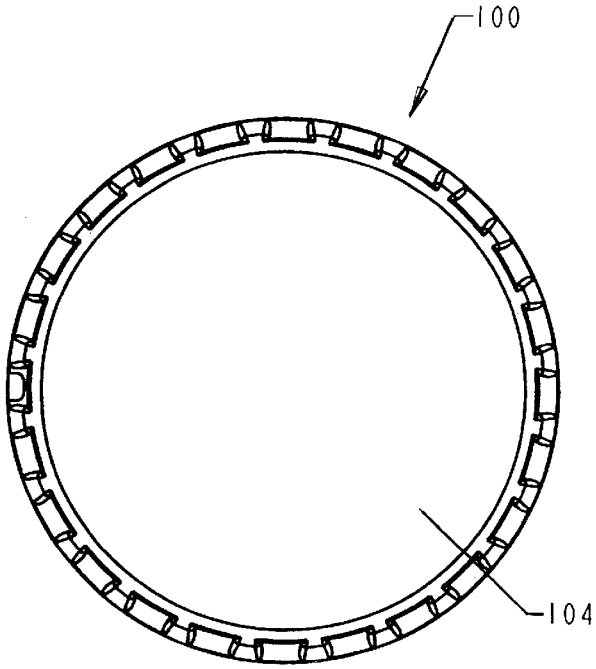
FIG. 3 is a top view of the writing instrument.

The present invention will now be described with reference to FIGS. 1–108, which in general relate to a writing instrument which may be shaped as a familiar and/or proprietary object. While the writing instrument according to preferred embodiments is a pen, it is understood that the writing instrument may alternatively be a marker, pencil, chalk, crayon or any of various other known writing instruments. Moreover, as set forth in greater detail below, the instrument according to the present invention may alternatively contain a tool such as a screwdriver, cutting blade or light source.

Writing Instrument Including Cam Assembly

A first embodiment of the present invention will now be described with reference to FIGS. 1–24. As shown therein, a writing instrument 100 includes a housing 102 formed of a first circular cover 104 and a second circular cover 106. As depicted in FIGS. 1–9, the writing instrument 100 is formed to look like a bottle cap which may have a proprietary logo thereon (not shown in FIGS. 1–9) such as that of Coke® or Pepsi®. However, the outward appearance of the writing instrument 100 shown in FIGS. 1–9 is but one of a wide variety of shapes and appearances of the instrument, and is provided by way of example only. As set forth in greater detail below, the outward size, appearance and texture of the writing instrument may be that of various other proprietary objects or symbols, such as for example an auto manufacturer's emblem, including that of Cadillac, Lincoln or Mercedes. The outward size, appearance and texture of the writing instrument may alternatively be that of a familiar object, such as a coin or a food item, for example a cracker. Furthermore, the outward size, appearance and texture of the writing instrument may be formed to have an artistic design or picture. As described in greater detail below, various other outward sizes, appearances and textures for writing instrument 100 are contemplated.

Referring now to FIGS. 1–5, the first cover 104 includes an outer surface 108 formed in the general size, appearance and/or texture of a familiar and/or proprietary object. The cover 104 further includes an inner, generally planar surface 110 including a generally circular shaped outer wall 112 extending away from the inner surface, at an outer circumference of the cover 104. The outer wall 112 extends around substantially the entire circumference of cover 104, but has a hole 114 defining an opening through which a pen cartridge tip can extend and retract as explained hereinafter. The second cover 106 similarly includes an outer surface 116 formed in the size, appearance and/or texture of a familiar and/or proprietary object. Inner surface 118 includes a generally circular shaped wall 120 extending away from the inner surface, near an outer circumference of the cover 106. The inner wall 120 extends around a substantial portion of the cover 106, but has a break which defines a gap 122.

The first and second covers may fit concentrically over each other so that the wall 112 lies circumjacent around the inner wall 120, and in close engagement thereto, with an inner surface of the wall 112 lying in contact with an outer surface of the wall 120. As is known in the art, a small lip may be formed around a top portion of wall 112, which mates within a small annular detent at the base of wall 120. The mating of the lip within the detent holds the first and second covers together when assembled while allowing relative rotation of the covers. As would be understood by those of skill in the art, the first and second covers may be rotationally affixed to each other by other fastening schemes.

The walls 112 and 120 also serve to space the first and second covers from each other when attached so as to define an internal space within the housing 102 for the internal components of the writing instrument which are discussed hereinafter. The outer surface of wall 112 which is visible on the outside of the writing instrument 100 is also formed to look and/or feel like corresponding portions of the object emulated by the writing instrument.

The size of the writing instrument may vary to generally match that of the object being emulated. The covers 104 and 106 are preferably formed of a rigid and durable polymer having smooth inner surfaces, such as any of various plastics, and may be formed by injection molding. It is understood however that the covers 104 and 106 may be formed of various other materials and by various other processes in alternative embodiments. For example, the covers may alternatively be formed of various metals, such as gold, silver and aluminum, various magnetic materials such as for example cobalt or nickel, various woods, such as pine and oak, or various combinations of the above. Moreover, the covers may alternatively be formed by processes such as stamping or machining. The covers 104 and 106 may also be painted, coated and/or textured to take on the appearance and/or feel of the desired object.

Referring now to FIGS. 4–9, in a preferred embodiment, the inner surface 118 of second cover 106 includes walls which define an arcuate track 124. The inner surface 110 of the first cover 104 includes a pair of spaced apart walls which form a pair of linear guides 126. The track 124 may alternatively be located in the inner surface of cover 104, and the linear guides 126 may alternatively be located in the inner surface of cover 106 in different embodiments.

The writing instrument 100 according to the present embodiment further includes a pen guide 128 seated within the housing 102 in the space between the respective covers 104 and 106 in their assembled position. The pen guide 128 has a first surface 130 including a protruding, circular track following section 132, and a second surface 134 opposite the first including a spaced apart pair of indented guide following sections 136. The pen guide further includes a writing implement, such as a pen cartridge 138 with a writing tip, pressed into a hole formed in a circumferential edge of the pen guide 128. It is understood that the writing tip may include a relatively blunt tip to minimize the risk of injury if the pen tip impacts against the skin or eyes of a user of the pen. As previously indicated, writing implements other than pen cartridges may be used. The cartridge 138 stores and supplies ink to the tip of the pen. In alternative embodiments, an interior portion of the pen guide may be hollow to define an additional ink reservoir for storing and supplying ink to the tip of the pen.

The pen guide 128 preferably includes smooth, low friction surfaces, and may be formed of a rigid and durable polymer, such as any of various plastics, by injection molding. It is understood however that the pen guide 128 may be formed of various other materials and by various other processes in alternative embodiments. The footprint shape of the pen guide 128 may vary in alternative embodiments with the provision that the pen guide not be inhibited from pivoting within the housing 102 as explained below. The pen guide may also include an air channel 139 communicated through to the hole in which the pen cartridge is seated. The air channel allows equalization of the pressure within the pen cartridge to that of the surrounding atmosphere.

Figure 4:
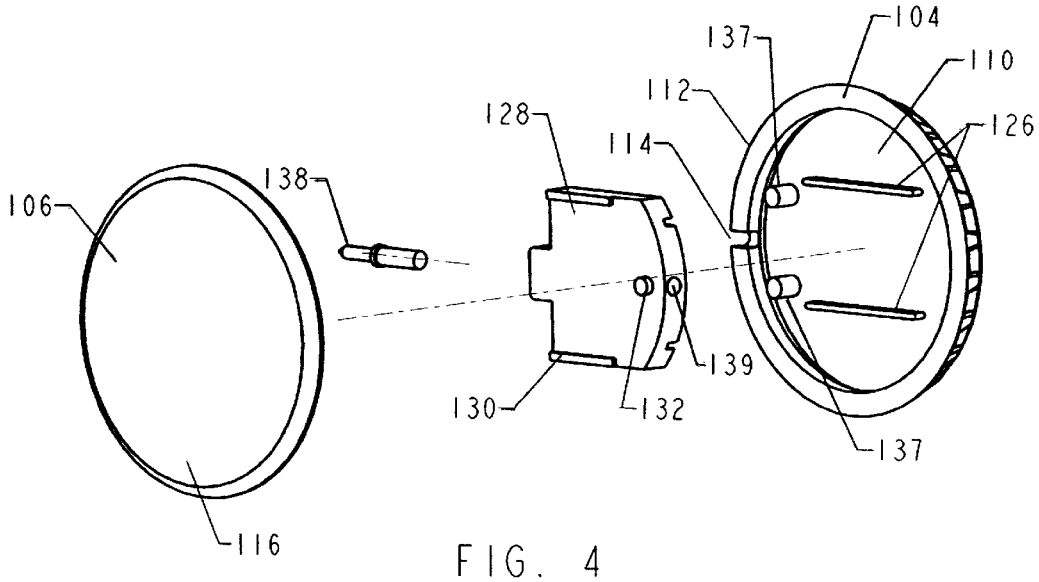
FIG. 4 is an exploded bottom perspective view including a perspective view of the inner surface of the first cover, a perspective view of the bottom of the pen guide, and a perspective view of the outer surface of the second cover.
Figure 5:
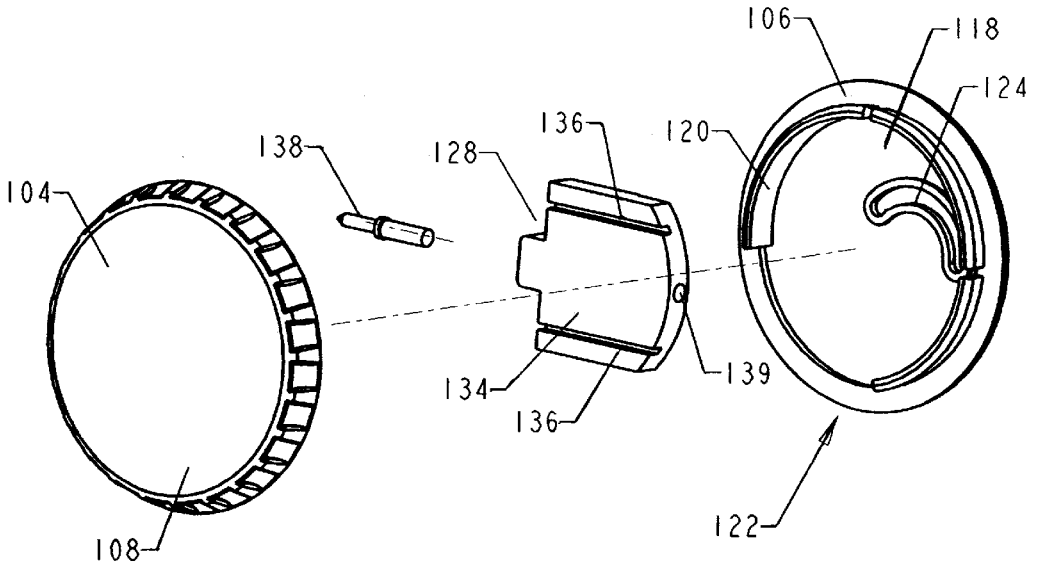
FIG. 5 is an exploded top perspective view including a perspective view of the outer surface of the first cover, a perspective view of the top of the pen guide, and a perspective view of the inner surface of the second cover.

The operation of the writing instrument 100 shown in FIGS. 4 and 5 to extend and retract the pen cartridge upon rotation of the covers 104 and 106 will now be explained with reference to FIGS. 4–9. When the writing instrument 100 is assembled, the pen guide 128 lies between the respective covers 104 and 106 with the track following section 132 of the pen guide lying within the track 124 on the inner surface 118 of the second cover 106. The guide following sections 136 on the opposite side of the pen guide from the track following section ride over the respective linear guides 126 on the inner surface 110 of the first cover 104. (FIG. 6 illustrates the components within the respective covers in phantom lines, and FIGS. 8 and 9 show the pen in cross section, for clarity.)

Figure 6:
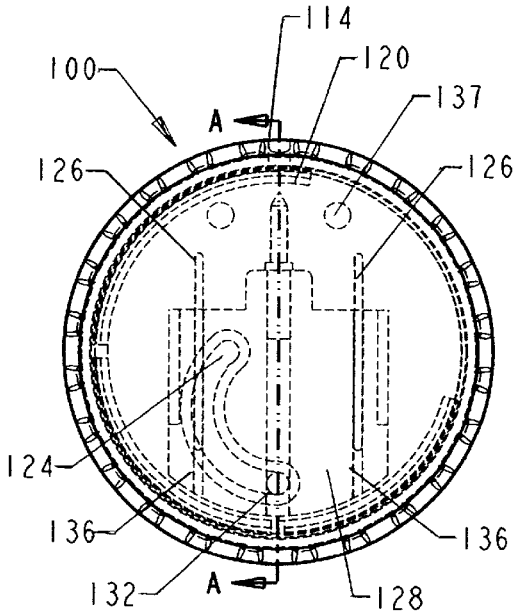
FIG. 6 is a top view of the pen in a retracted position with hidden members shown in phantom.
Figure 7:
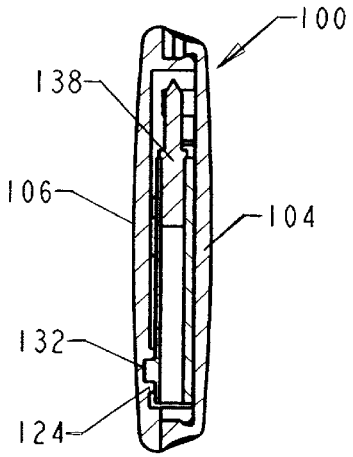
FIG. 7 is a cross-sectional side view through line A—A in FIG. 6.
Figure 8:
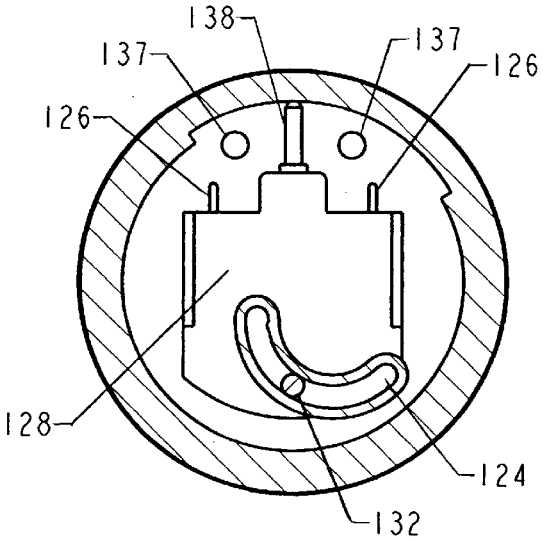
FIG. 8 is a cross-sectional top view showing the pen cartridge partially extended.
Figure 9:
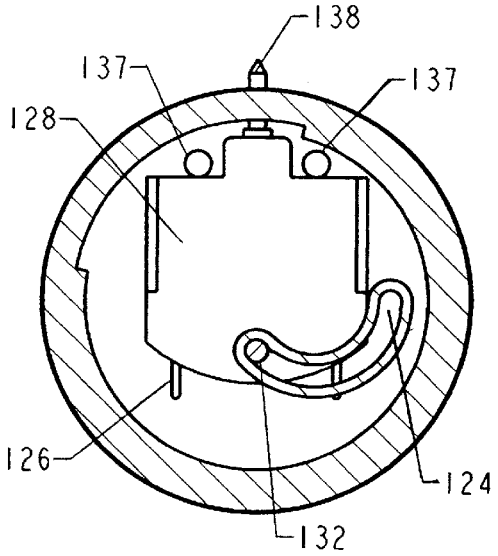
FIG. 9 is a cross-sectional top view showing the pen cartridge fully extended.
Figure 10:
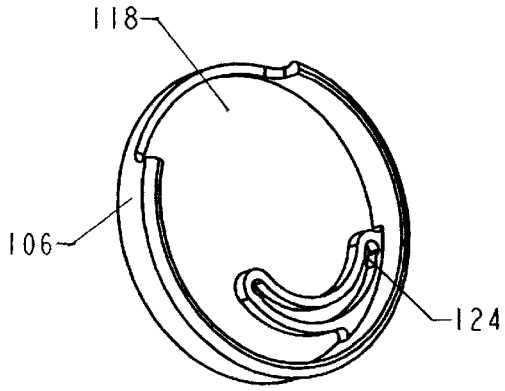
FIG. 10 is a perspective view of the inner surface of the first cover according to an alternative embodiment.
Figure 11:
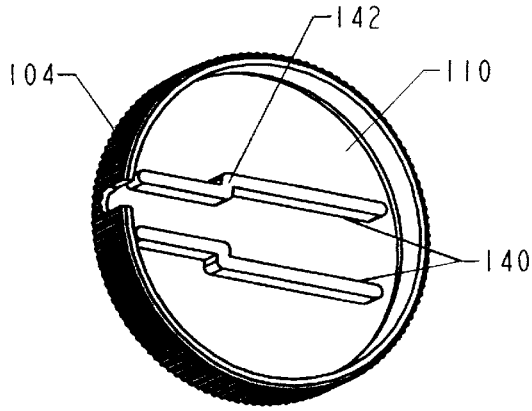
FIG. 11 is a perspective view of the inner surface of the second cover according to an alternative embodiment.

Rotation of the second cover clockwise from the view of FIGS. 6, 8 and 9 with respect to the first cover causes rotation of the track 124 as shown. Rotation of the track 124 in turn causes translation of the track following section 132, which is constrained to translate vertically from the views of FIGS. 6, 8 and 9 as a result of the guide following sections 136 riding along the linear guides 126. Thus, rotation of the second cover from the position shown in FIG. 6, through the position shown in FIG. 8, to the position shown in FIG. 9 results in the writing end of the cartridge 138 moving from its retracted position to its extended position. In a preferred embodiment, cover 104 preferably further includes a pair of stops 137 extending up from the inner surface 110. As seen in FIG. 9, when in the fully extended position, the pen guide 128 abuts up against the stops 137 to prevent further respective rotation of the covers 104 and 106 and to define a maximum extension of the pen tip from the housing.

In a preferred embodiment, as shown in FIG. 6, when in the retracted position, the wall 120 covers the hole 114 through which the pen tip extends. However, upon rotation of the cover 106, the gap 122 in the wall 120 aligns with the hole 114 to allow the pen tip to extend through the hole 114 and out of the housing. It is understood that in alternative embodiments, the wall 120 need not extend as far around the periphery of the cover 106 as shown, so that the wall does not cover the hole 114 when the pen tip is in the retracted position.

In order to retract the pen cartridge 138 from its extended position, the first and/or second covers are rotated in the opposite direction than to extend the pen cartridge. This rotation results in the pen guide 128 and the pen cartridge 138 moving from the position shown in FIG. 9 to the position shown in FIG. 6. The arcuate track 124 is configured so that a 90° rotation of the covers with respect to each other results in an approximate ¼ inch translation of the pen cartridge, which is sufficient to move the pen cartridge between its extended and retracted positions. The configuration of the track 124 may be varied so that various other angles of rotation of the covers result in the same translation of the pen cartridge in alternative embodiments. Such various other angles may range between 30° and 180° in one alternative embodiment. It is further contemplated that the relative positions of the track 124 in cover 106 and the track following section 132 in pen guide 128 may be reversed in alternative embodiments. It is similarly contemplated that the positions of the linear guides in cover 104 and the guide following sections 136 in the pen guide 128 may be reversed in alternative embodiments.

Figure 12:
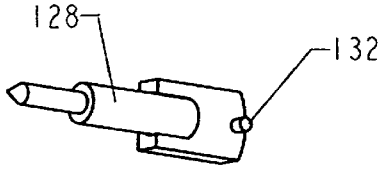
FIG. 12 is a perspective view of a pen guide and pen cartridge according to the embodiments of FIGS. 10 and 11.
Figure 13:
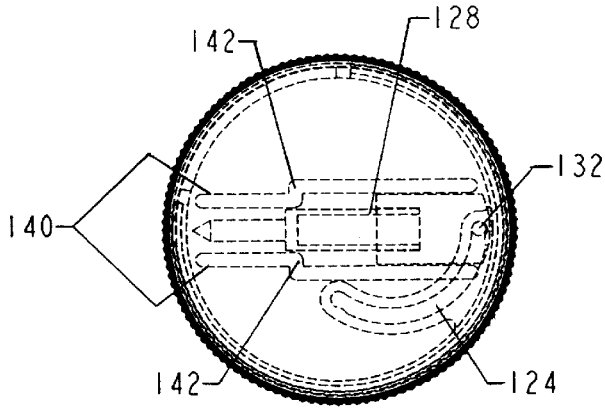
FIG. 13 is a top view according to alternative embodiments shown in FIGS. 10–12 with the various internal components shown in phantom.

It is understood that other cam assemblies and configurations may be utilized according to the first embodiment of the present invention to extend and retract the pen cartridge upon rotation of the covers 104 and 106. One such alternative embodiment is shown in FIGS. 10–13. As shown, the cover 106 may include an arcuate track 124 substantially as described above. The cover 104 may similarly include guides 140 between which the pen guide 128 translates. In the current embodiment, the pen guide 128 is slightly modified in shape as shown in FIG. 12 relative to that described above so as to fit between the guides 140. However, as described above, the pen guide 128 still includes the track following section 132 which fits within the track 124 when the respective covers 104, 106 are assembled as shown in FIG. 13. (FIG. 13 illustrates the components within the respective covers in phantom lines for clarity.) As described above, rotation of the first cover with respect to the second cover causes rotation of the track 124, which in turn causes translation of the track following section 132. The track following section 132 is constrained to translate left and right from the view of FIG. 13 as a result of the guides 140. The guides 140 may each include a shoulder 142 which define stops against which portions of the pen guide 128 abut when the pen is in the fully extended position.

A further alternative embodiment employing a cam arrangement is shown in FIGS. 14–19. According to this embodiment, the inner surface 110 of first cover 104 includes a raised section defining an oblong-shaped cam 144 having one end at the center of the cover 104 and having a second end extending radially outward therefrom toward the outer circumference of the cover. The inner surface 118 of the second cover 106 includes a depression defining a track 145 extending diagonally across the inner surface 118, through the center of the cover 106. The cam 144 may alternatively be located in the inner surface of cover 106, and the track 145 may alternatively be located in the inner surface of cover 104 in different embodiments.

The writing instrument 100 according to the embodiment of FIGS. 14–19 further includes a pen guide 128 seated within the housing 102 in the space between the respective covers 104 and 106 in their assembled position. The pen guide 128 according to this embodiment has a first surface 130 including an indented cam following section 146. The second surface 134 of the pen guide includes a track following section (not shown) which rides within track 145.

When the writing instrument 100 is assembled, the pen guide 128 lies between the respective covers 104 and 106 with the cam following section 146 of the pen guide residing over the cam 144 on the inner surface 110 of the first cover 104. (FIG. 17 illustrates the components within the respective covers in phantom lines, and FIGS. 18 and 19 show the pen in cross section, for clarity.) Rotation of the first cover with respect to the second cover causes the cam 144 to engage against and ride along a first portion 148 of the cam following section 146. This engagement causes translation of the pen guide and pen cartridge from their retracted position shown in FIG. 17, through their position shown in FIG. 18, to their extended position shown in FIG. 19. This embodiment may optionally further include a pair of guideposts 149 for further guiding the pen cartridge as it translates between its extended and retracted positions. Although not shown, the track 145 in the second cover 106 rides within the track following section on the pen guide 128 to ensure pure translation of the pen guide and pen cartridge.

In order to retract the pen cartridge 138 from its extended position, the first and second covers are rotated in the opposite direction than to extend the pen cartridge. Such rotation causes the cam 144 to engage against and ride along a second portion 150 of the cam following section 146. This engagement results in the pen guide 128 and the pen cartridge 138 moving from the position shown in FIG. 9 to the position shown in FIG. 6. The cam and cam following sections are configured so that a 90° rotation of the covers with respect to each other results in an approximate ¼ inch translation of the pen cartridge, which is sufficient to move the pen cartridge between its extended and retracted positions. The configuration of the cam and cam following section may be varied so that various other angles of rotation of the covers result in the same translation of the pen cartridge in alternative embodiments. Such various other angles may range between 30° and 180° in one alternative embodiment. It is further contemplated that the positions of the cam in cover 104 and the cam following member in pen guide 128 may be reversed in alternative embodiments. It is similarly contemplated that the positions of the track in cover 106 and the track following section in the pen guide 128 may be reversed in alternative embodiments.

Figure 20:
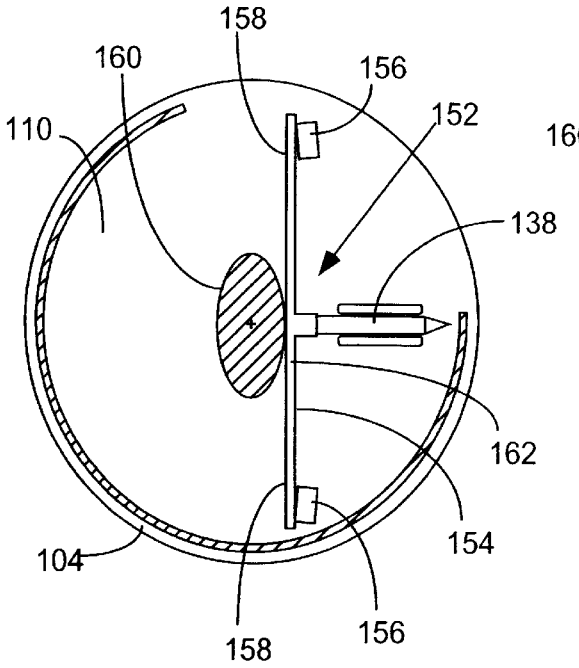
FIG. 20 is a top view with the cover removed according to an alternative embodiment of the present invention with the pen cartridge in a retracted position.
Figure 21:
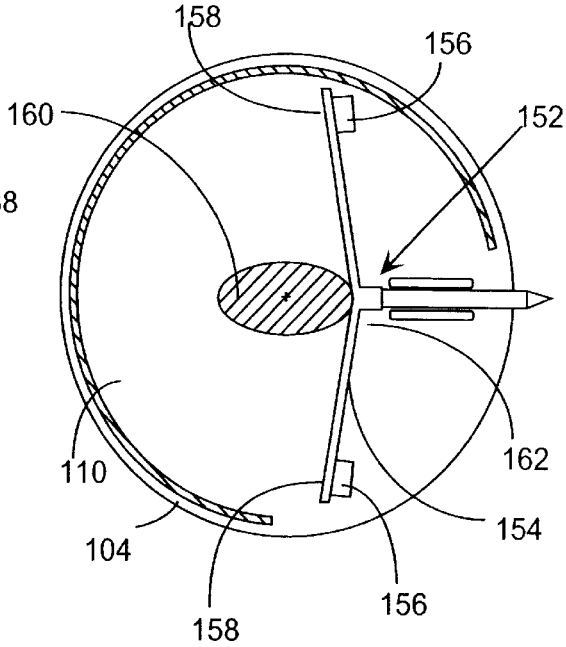
FIG. 21 is a top view with the cover removed according to the alternative embodiment shown in FIG. 20 with the pen cartridge in an extended position.

A further alternative cam embodiment is shown in FIGS. 20 and 21. In this embodiment, a pen guide 152 comprises a span 154, preferably formed of a durable, elastic polymer such as any of various plastics, and having a modulus of elasticity allowing the span to repeatably flex between the positions shown in FIGS. 20 and 21. The first cover 104 according to this embodiment preferably includes a pair of braces 156 mounted to the inner cover 110 for supporting the ends 158 of the pen guide 152. The second cover 106 according to this embodiment preferably includes an oval-shaped cam 160 mounted to inner surface 118 (not shown in FIGS. 20 and 21). It is understood that the positions of the braces 156 and cam 160 on the respective covers may be switched in alternative embodiments.

When the second cover 106 is rotated with respect to the first cover 104, the cam 160 rotates from the position shown in FIG. 20 to the position shown in FIG. 21. During such movement, the cam 160 bears against a central portion 162 of the pen guide 152 to force the pen guide downward and to extend the pen cartridge from the housing 102. The elasticity of the pen guide according to this embodiment biases the pen guide to its unflexed position shown in FIG. 20, so that upon rotation of the second cover from the position shown in FIG. 21 to the position shown in FIG. 20, the pen cartridge retracts back into the housing.

Figure 22:
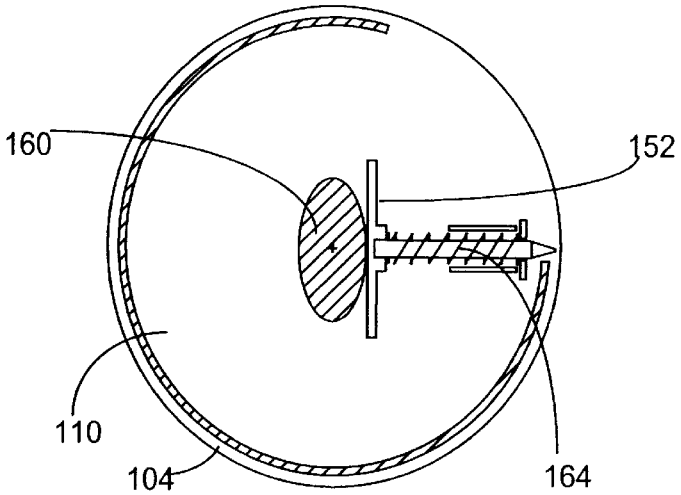
FIG. 22 is a top view with the cover removed according to a further alternative embodiment of the present invention with the pen cartridge in a retracted position.

As shown in FIG. 22, those of skill in the art would appreciate that the ends of pen guide 152 used to bias the pen cartridge back to its retracted position may be omitted, and replaced by some other biasing force such as a spring 164. Other cam assemblies and configurations are also contemplated.

Figure 23:
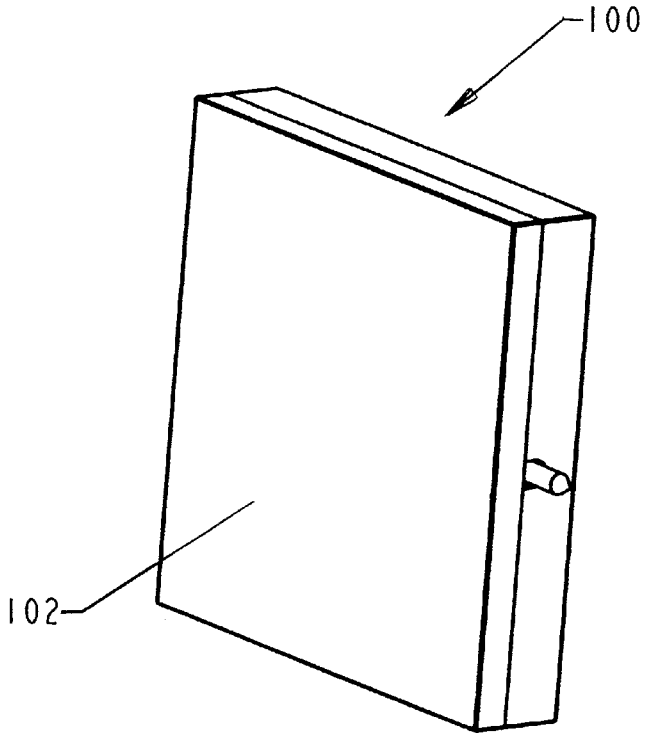
FIG. 23 is the square-shaped pen embodiment.
Figure 24:
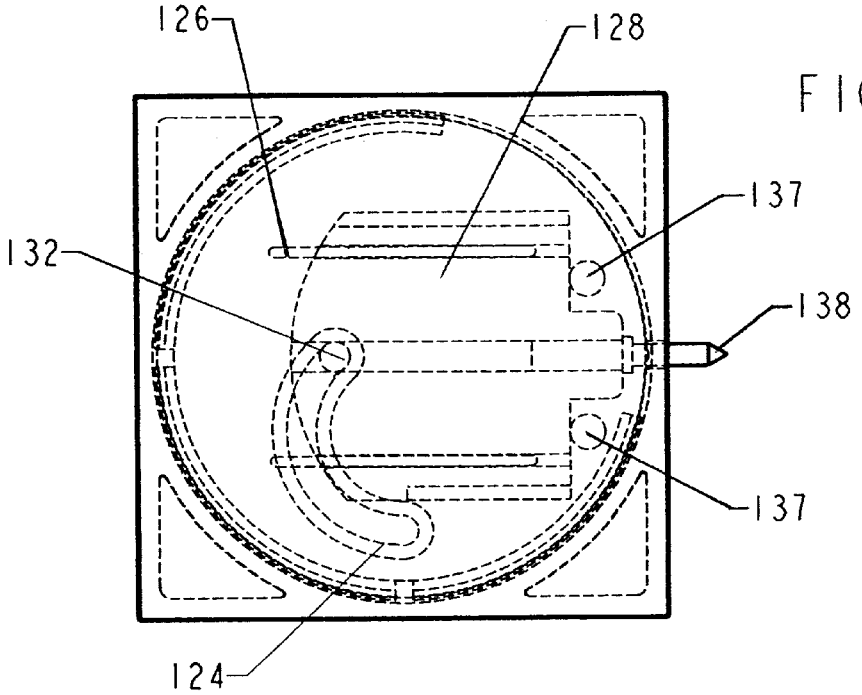
FIG. 24 is a top view of a square-shaped pen embodiment of FIG. 23 with the internal components shown in phantom.

Up to this point, the covers 104 and 106 have been described as being circular. It is understood that the covers may have different shapes in alternative embodiments. For example, as shown in FIGS. 23 and 24, the housing 102 may be square. As shown in FIG. 24, the pen cartridge 138 may be moved between its extended and retracted positions with internal components such as those described above with respect to FIGS. 4–9. It is understood that the internal components according to other embodiments may be used with the square covers as well. It is further contemplated that one of the covers be square, and that the other cover be circular and rotationally mounted within the square cover. One of skill in the art would appreciate for example how to modify cover 106 as described above with respect to FIGS. 1–9 to have a square footprint. Furthermore, in all embodiments including a square housing, it is understood that the pen tip may protrude from the housing 102 along one of the four straight sides of the housing or at a corner where two sides of the housing come together.

The covers 104 and 106 may alternatively be other shapes, such as pentagonal, hexagonal, heptagonal, octagonal, oval, oblong and irregular. Regardless of the shape, it is preferable that the angle through which the covers rotate to extend and retract the pen cartridge tip is provided so that the edges of the two covers align when the pen cartridge is both in the fully extended and retracted positions. It is however contemplated that the edges of the respective covers 104 and 106 not align with each other when the pen cartridge is in its fully extended and/or retracted positions in alternative embodiments.

The internal mechanisms according to the above-described cam embodiments allow the respective covers to be easily rotated with a single hand to move the pen cartridge between its extended and retracted positions. Moreover, the present embodiment does not have any elements protruding from the housing (beside the pen cartridge tip itself). As many of the familiar and/or proprietary objects to which the pen is shaped do not have protruding elements, the present embodiment allows an accurate replication of these objects.

Writing Instrument Including Edge Slide Assembly

A further embodiment of the present invention will now be described with respect to FIGS. 25–26A. The embodiments of FIGS. 25–26A include covers 104 and 106 having outer surfaces and outer edge surfaces substantially as described above. In this embodiment, the covers are fixedly attached to each other with a conventional adhesive or fastener so as not to rotate with respect to each other. It is understood that the housing may alternatively be formed by attaching component parts other than covers 104 and 106. For example, two semicircular halves may be attached together to form housing 102. Regardless of how the covers are affixed to each other, the covers define an interior space in which the internal components of the pen are mounted.

In particular, an edge slide 166 is mounted within the interior space defined by the covers, which slide 166 is capable of arcuate translation around a portion of the interior space. The edge slide 166 includes an arcuate, wedge-shaped section 168 having a relatively wide rear section 170 which narrows to substantially a point at a front section 172. The edge slide 166 further includes an arcuate extension 174 extending from rear section 170. The edge slide 166 additionally has a finger grip 176 attached at the rear section 170 and extending outside of the footprint of the covers 104 and 106. A portion of the outer circumferential walls formed in covers 104 and 106 may be omitted to allow translation of the edge slide 166 outside of the housing as described below. A pair of guides 171 are additionally mounted to the surface of either cover 104 or 106 between which the pen cartridge 138 is seated.

Figure 25:
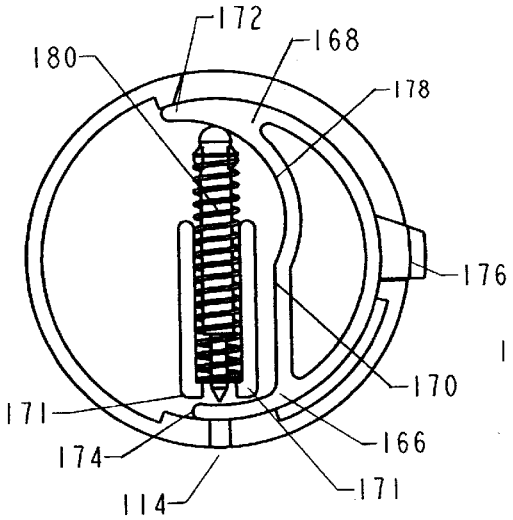
FIG. 25 is a top view with the cover removed showing the edge slide embodiment with the pen in the retracted position.
Figure 25A:
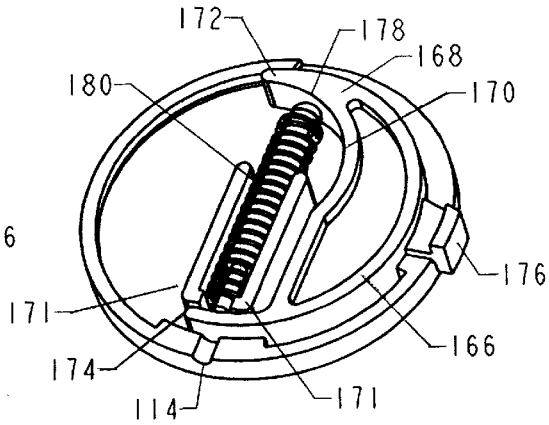
FIG. 25A is a perspective view of the pen shown in FIG. 25.

In its retracted position shown in FIGS. 25 and 25A, the rear of pen cartridge 138 (i.e., the top as shown in FIG. 25) lies engaged with the front section 172 of edge slide 166. It is also contemplated that the rear pen cartridge 138 not contact any portion of the edge slide 166 when the cartridge is in its retracted position. To extend the pen cartridge to the position shown in FIGS. 26 and 26A, the finger grip 176 is manually actuated in the counterclockwise direction from the perspective of FIGS. 25 and 26. Upon such actuation, a ramp surface 178 of the wedge-shaped section 168 forces the pen cartridge downward with respect to FIG. 25, thus moving the pen cartridge to its extended position shown in FIGS. 26 and 26A. The arcuate extension 174 serves both to facilitate smooth arcuate translation of the edge slide 166, and also to cover the hole 114 in the housing when the edge slide 166 is in the position shown in FIGS. 25 and 25A.

Figure 26:
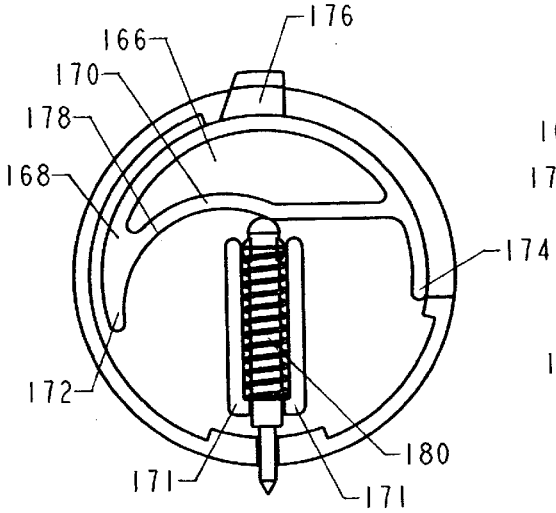
FIG. 26 is a top view with the cover removed showing the edge slide embodiment with the pen in the extended position.
Figure 26A:
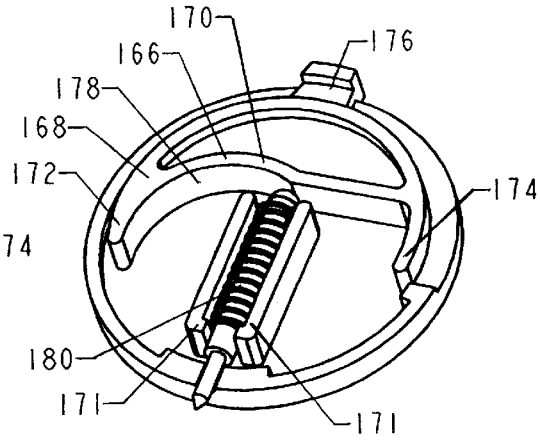
FIG. 26A is a perspective view of the pen shown in FIG. 26.

In a preferred embodiment, a spring 180 may be provided around cartridge 138, which spring biases the cartridge upward from the perspective of FIGS. 25 and 26 to its retracted position. Thus, when the edge slide is moved clockwise, spring 180 biases the pen cartridge 138 back into its retracted position as ramp 178 recedes. It is understood that biasing mechanisms other than springs may be used to bias the pen cartridge back to its retracted position.

The edge slide is configured so that a 45° arcuate translation of the edge slide will result in an approximate ¼ inch translation of the pen cartridge which is sufficient to move the pen cartridge between its extended and retracted positions. The configuration of edge slide 166, and in particular the slope of ramp surface 178, may be varied in alternative embodiments to vary the translation of pen cartridge 138 for a given arcuate translation of edge slide 166. In one alternative embodiment, the edge slide may translate over an arc ranging between 30° and 180°.

As will be appreciated from this embodiment, the finger grip 176 may be easily manipulated by one hand to move the tip of the writing cartridge between its extended and retracted positions.

Writing Instrument Including Gravity-Activated Assembly

A further embodiment of the present invention will now be described with reference to FIGS. 27–30C and 83–92. The embodiments of FIGS. 27–30C and 83–92 include covers 104 and 106 having outer surfaces and outer edge surfaces substantially as described above. In this embodiment, the covers 104 and 106 are fixedly attached to each other with a conventional adhesive or fastener so as not to rotate with respect to each other. A pair of guides 182 are formed on the inner surface 110 of cover 104, or alternatively on the inner surface 118 of cover 106, between which guides the pen cartridge 138 is seated. One or more detents 186 are formed in the guides 182. The detents are provided at a position along the length of the guides 182 for receiving a locking member such as locking ball 188 to maintain the pen in its extended position.

Figure 27:
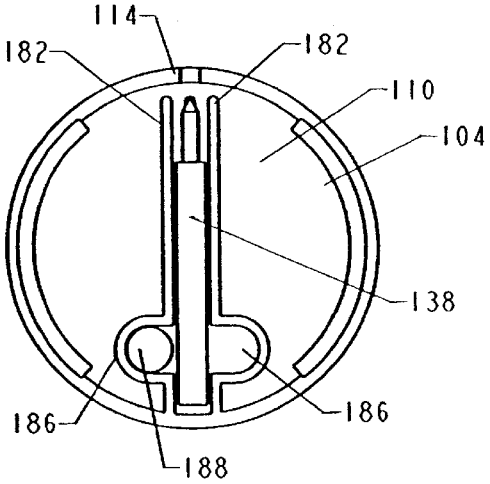
FIG. 27 is a top view with the cover removed of the gravity actuated embodiment showing the pen in a retracted position and the locking ball seated within a detent.
Figure 28:
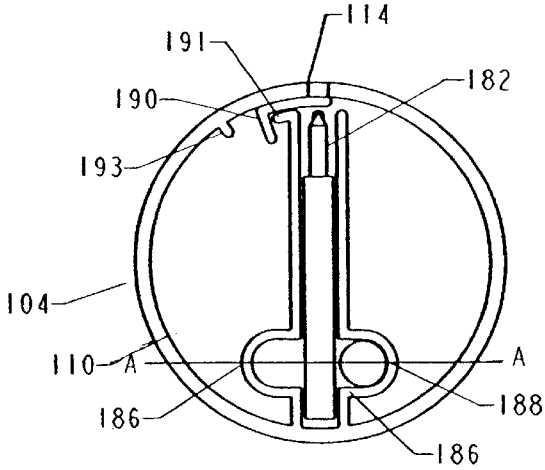
FIG. 28 is a top view with the cover removed as in FIG. 27 but further including a cover for covering a hole through which the pen tip extends on the edge of the pen.

In particular, in its retracted position shown in FIGS. 27 and 28, the locking ball 188 is seated within a detent 186. The cartridge 138 remains in its retracted position as shown in FIG. 27 due to the forces of gravity. Alternatively, as shown in FIG. 28, a gravity-actuated slide cover 190 may seal the hole 114 to maintain the pen cartridge in its retracted position when not in use. In the embodiment of FIG. 28, before the pen cartridge may be extended, the pen must be tilted on its side so that gravity moves the cover 190 away from the hole 114. One of the guides 182 may include a foot portion 191 which, together with the wall of the cover, restricts the movement of the cover to slide between a first position where the hole 114 is covered and a second position where the hole 114 is uncovered. A stop 193 may further be provided to limit the motion of the cover when in the second position. After the pen has been tilted to move the cover 190 to the second position, the pen may be pointed downward so that gravity moves the pen cartridge to the extended position shown in FIG. 28A. The tilting of the pen to move the cover away from the hole 114 and pointing of the pen downward to extend the pen cartridge may be accomplished in a single hand motion.

Figure 28A:
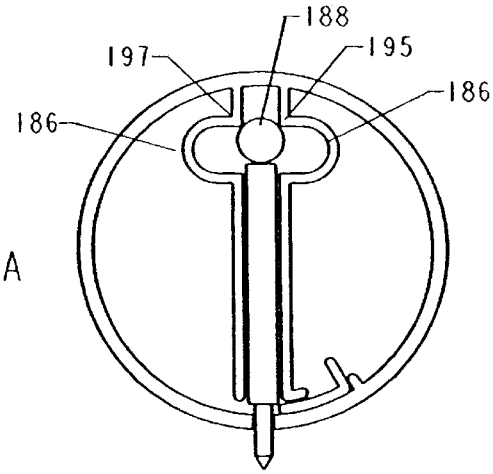
FIG. 28A is a top view with the cover removed of the gravity fed embodiment of FIG. 28 showing the pen cartridge locked in the extended position.

As shown in FIG. 28A, when the cartridge 138 moves to its extended position, the locking ball 188 moves out of the detent and seats on top of the back end of the pen cartridge. The position of the detents 186 are determined by the length of pen cartridge 138 so that locking ball 188 is able to move out of the detent 186 when the tip of the pen cartridge is fully extended. The spacing between the guides 182 is smaller than the diameter of the locking ball so that, seated on top of the pen cartridge, the locking ball wedges against corners 195 and 197 of the guides so to lock the pen cartridge in its extended position. As long as the locking ball 188 remains in position on the back end of the pen cartridge, the pen cartridge will remain in its extended position. In order to retract the pen, the pen is lifted off of the writing surface and tilted, at which point the locking ball 188 falls back into a detent 186. Thereafter, tilting the pen upward retracts the pen cartridge rearward into the housing 102.

Figure 29:
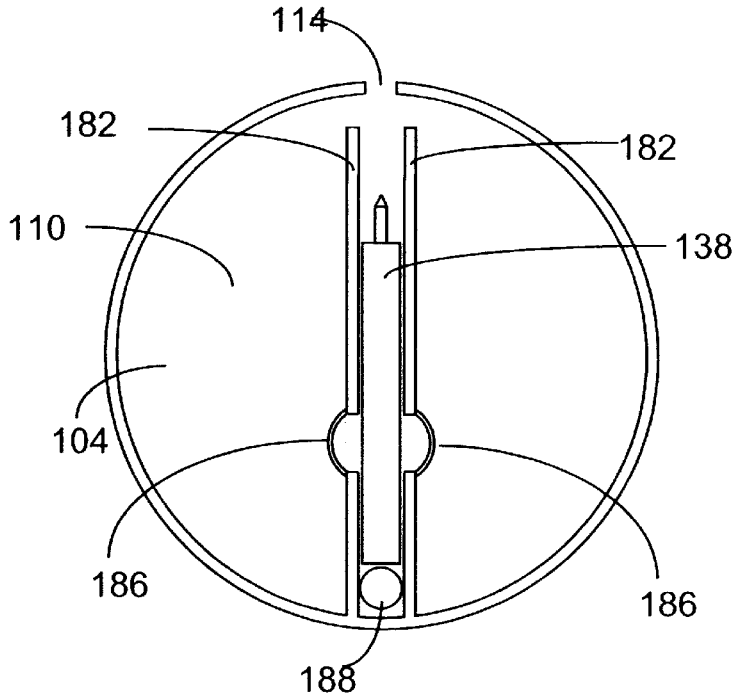
FIG. 29 is a top view with the cover removed of an alternative gravity actuated embodiment showing the pen in a retracted position and the locking ball seated atop a back end of the pen cartridge.
Figure 29A:
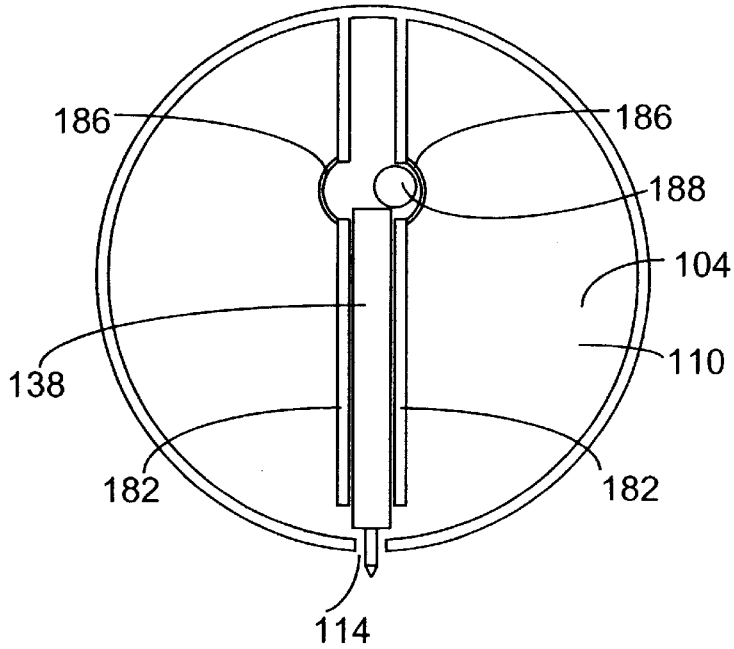
FIG. 29A is a top view with the cover removed of the gravity fed embodiment of FIG. 29 showing the pen cartridge locked in the extended position.
Figure 31:
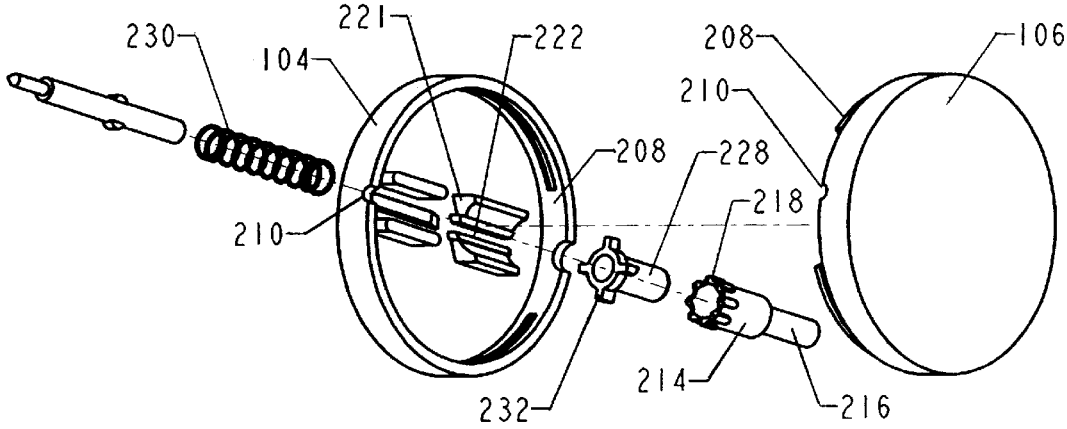
FIG. 31 is an exploded perspective view of the writing instrument including the ratchet-type push button activation protruding from a side of the pen opposite where the pen tip protrudes.

In an alternative embodiment shown in FIGS. 29 and 29A, when the pen is in the retracted position, the locking ball 188 maybe seated between the guides 182 at the back end of the pen cartridge 138. The cartridge 138 may remain in its retracted position due to the forces of gravity as shown in FIG. 29. When the writing instrument 100 is oriented so that the tip of the pen cartridge faces generally downward as shown in FIG. 29A, the forces of gravity will bias the pen cartridge to its extended position (in embodiments including a slide cover 190, the slide cover must first be opened for the pen cartridge to move to its extended position). As shown in FIG. 29A, when the cartridge 138 moves to its extended position, the locking ball 188 will seat partially within detent 186. Seated partially within the detent, the locking ball locks the pen cartridge in its extended position by preventing the cartridge 138 from retracting. As long as the instrument remains tilted in the writing position, locking ball 188 will remain in detent 186, and the pen cartridge will remain in its extended position. In order to retract the pen, the pen is tilted upward, at which point the locking ball 188 falls out of detent 186 and the forces of gravity retract the pen cartridge rearward into the space between guides 182.

Figure 30B:
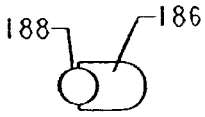
FIG. 30B is a cross-sectional top view showing a single detent.
Figure 30C:
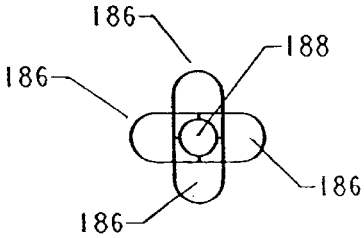
FIG. 30C is a cross-sectional top view showing greater than two detents.
Figure 30A:
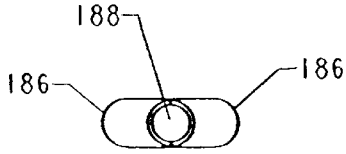
FIG. 30A is a cross-sectional top view through section line A—A of FIG. 28 showing the detents into which the locking ball locks.

FIG. 30A shows a cross-section of the detents 186 shown in FIG. 29A. Instead of having two detents 186, the guides 182 may be formed with a single discrete detent 186 as shown in FIG. 30B, or more than two discrete detents 186 as shown in FIG. 30C for receiving locking ball 188.

The gravity activated embodiment of the present invention is further shown in FIGS. 83–85. The writing instrument 100 shown therein operates in the same manner as the writing instrument 100 shown in FIGS. 27–28A. It includes a locking member comprising a locking pin 188, and first and second detents 186*a* and 186*b*. When the writing instrument is tilted upwards, the locking pin 188 resides in first detent 186*a* as shown in FIG. 84. In this position, the pen cartridge 138 is free to retract due to the forces of gravity. When the writing instrument is tilted downwards, the locking pin 188 slides partially out of detent 186*a*, across the channel defined by guides 182, and seats partially within detent 186*b* as shown in FIG. 85. In this position, the pen is prevented from retracting and is held in a position for writing. (While the writing instrument shown in FIGS. 83–85 has a square shape, it is understood that the writing instrument shown in FIGS. 27–29A and 83–85 may be circular, square or other shapes as described above.)

Figure 86:
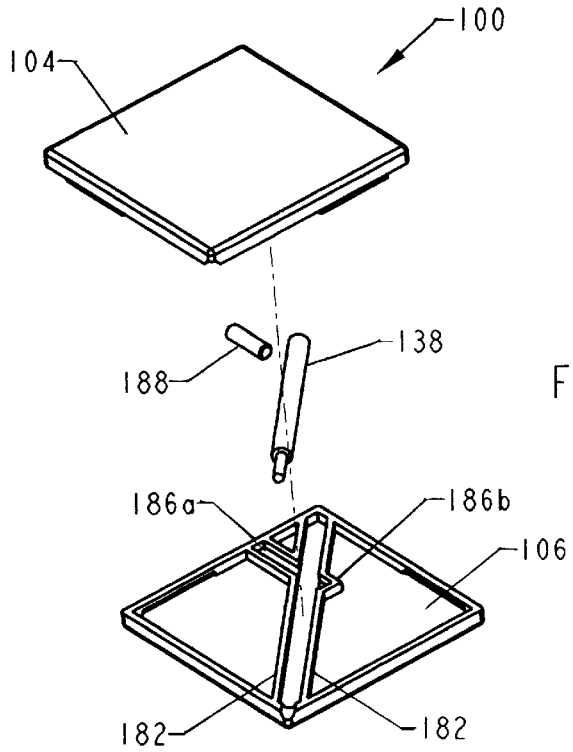
FIGS. 86–88 illustrate an exploded perspective and top views of an alternative embodiment of the gravity activated embodiment of the present invention.
Figure 87:
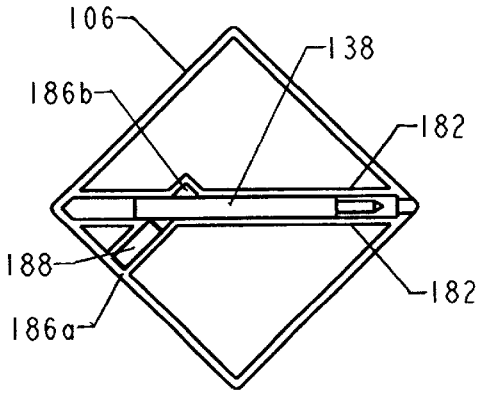
Figure 88:
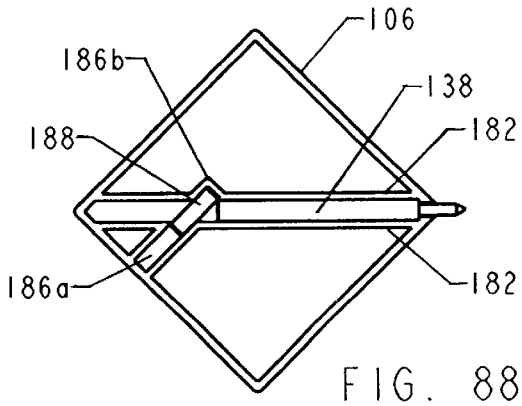
Figure 89:
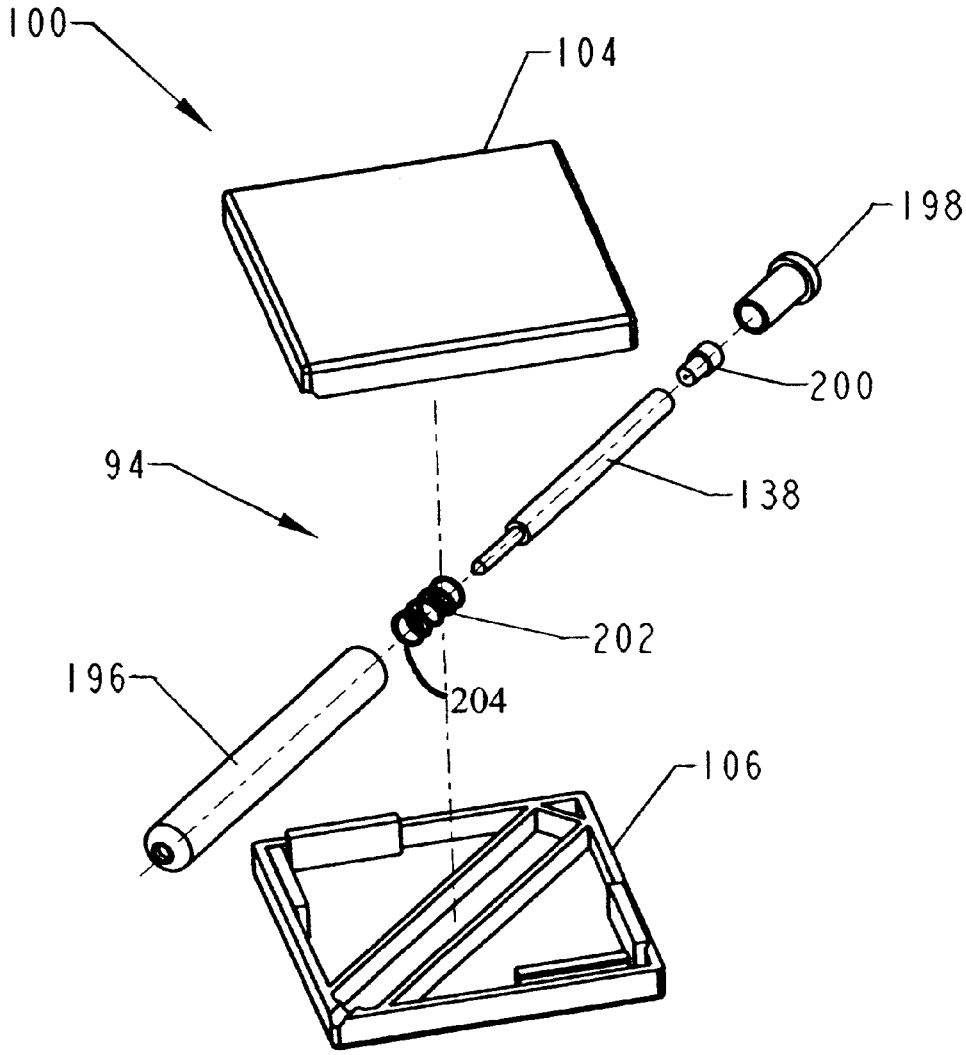
FIG. 89 is an exploded perspective view of an alternative embodiment of the gravity actuated writing instrument.

It is understood that the detents 186*a* and 186*b* may be perpendicularly oriented with respect to the channel defined by guides 182 as shown in FIGS. 83–85. Alternatively, the detents 186*a* and 186*b* may be angled with respect to the channel defined by guides 182 as shown in FIGS. 86–88. The embodiment of the writing instrument 100 shown in FIGS. 86–88 operates similarly to the embodiment shown in FIGS. 83–85 and components which are common to both embodiments have been assigned like reference numerals. However, the embodiment of FIGS. 86–88 makes use of the fact that the pen is generally tilted when in the writing position so that the detents 186*a* and 186*b* shown in FIGS. 86–88 will be oriented straight up and down when the instrument 100 is tilted in the writing position to ensure that the locking pin 188 is ensured of sliding to the locking position shown in FIG. 88.

A further alternative embodiment of the gravity activated writing instrument according to the present invention is shown in FIGS. 89–92. This embodiment includes covers 104 and 106 as previously described, and a gravity cartridge assembly 194. Cartridge assembly 194 includes a cartridge housing 196 fixedly mounted to either cover 104 or 106 and sealed at its back end with a cartridge assembly cap 198. Cap 198 is preferably cylindrically shaped with a central opening 199 facing the interior of the housing 196 when the cap 198 is inserted into the back end of housing 196. A pen cartridge 138 as described above is located within the cartridge housing 196, which pen cartridge 138 includes a cap 200. A gravity tube 202 is also provided within the cartridge housing 196, which tube 202 has an outer diameter slightly smaller than an inner diameter of cartridge housing 196 so that tube 202 is free to translate between a front end and back end of the housing 196. The position of the tube 202 is determined by gravity so that when the front end of the cartridge housing faces downward the tube 202 resides in the front end of the housing and when the back end of the cartridge housing faces downward the tube 202 resides in the back end of the housing. Tube 202 includes a central aperture 204 through which the pen cartridge 138 fits.

Figure 90:
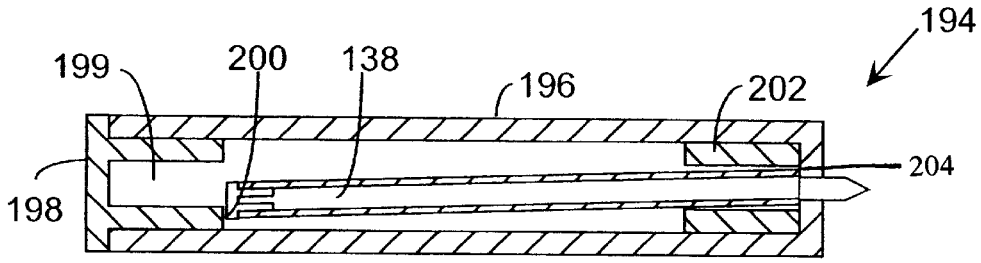
FIGS. 90–92 are cross-sectional views of the embodiment of the writing instrument shown in FIG. 89.

When the writing instrument 100 according to this embodiment is tilted downward as represented in FIG. 90, gravity moves tube 202 to the front of the cartridge housing, and moves the pen cartridge to the extended position where the pen tip protrudes out of the housing 102. When the pen tip is pressed down on a writing surface, the pen tip and pen cartridge will be biased rearward relative to the cartridge housing 196. As the pen is tilted when writing, a force will also be exerted on the pen cartridge biasing the back end of the pen cartridge into contact with a portion of the cylindrical side walls of the housing 196. Therefore, upon application of the writing force, the back end of the pen cartridge will move rearward and wedge against a front portion of cartridge assembly cap 198 as shown in FIG. 90 to maintain the pen in the extended writing position.

Figure 91:
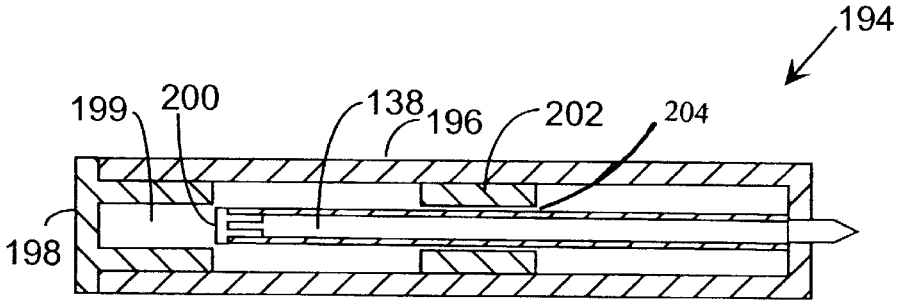
Figure 92:
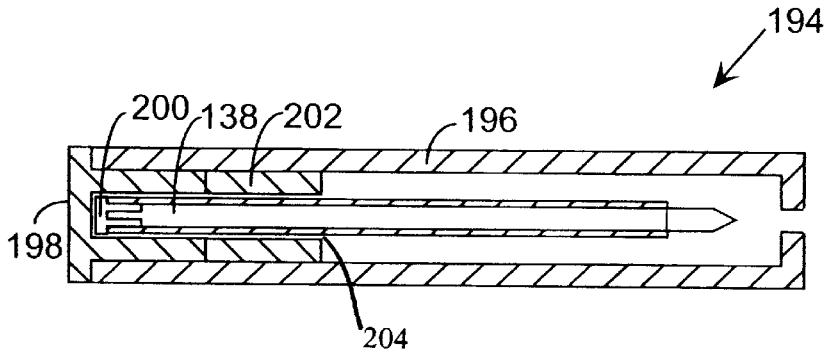

When the writing instrument 100 according to this embodiment is tilted upward, the tube 202 moves toward the back end of the cartridge housing 196 as shown in FIG. 91, and seats atop the cartridge assembly cap 198 as shown in FIG. 92. The inner diameter of the tube 202, at least at its back end, is equal to or slightly smaller than the inner diameter of the cylindrical cartridge assembly cap 198. Thus, when seated atop the cap 198, the tube 202 prevents the back end of the pen cartridge from wedging against the cap 198, and when tilted upwards away from the writing surface as represented in FIG. 92, the back end of the pen cartridge funnels into the central opening 199 under the force of gravity to retract the pen tip into the housing 102.

While the cartridge housing 196, the cap 198 and the tube 202 are preferably cylindrical, it is understood that these components may have other shapes in cross section in alternative embodiments, such as for example rectangular. Moreover, while the pen tip is shown as retracted into the cartridge housing 196 in FIG. 92, it is understood that the pen tip need only retract into the housing 102 of the writing instrument, in which housing 102 the cartridge housing 196 is fixedly mounted. In such an embodiment, the pen tip may be in a retracted position within housing 102 and still protrude from cartridge housing 196.

According to the embodiments of FIGS. 27–30C, 83–89 and 93–95, the pen cartridge may be easily moved between its extended and retracted positions by a simple flick of the wrist or tilting of the writing instrument 100. In embodiments including a hand-actuated slide cover, the pen may be maintained in its retracted position when not in use, and easily moved to its extended position with a single hand by sliding the slide cover to an open position and then tilting the pen as described above.

Writing Instrument With Push Button-Activation Assembly

A further embodiment of the present invention will now be described with reference to FIGS. 31–34. The embodiments of FIGS. 31–34 include covers 104 and 106 having outer surfaces substantially as described above. Each cover according to this embodiment preferably further includes a wall 208 extending around the outer circumference of each cover. The walls 208 of the respective covers are preferably of the same diameter and are fixedly attached to each other at their upper edges as by an adhesive or fastener. The walls 208 preferably include aligned openings 210 through which the pen cartridge 138 may extend and retract.

According to this embodiment, the pen cartridge 138 may be moved between its extended and retracted positions by a conventional push button assembly 212 which is well known in the pen industry for extending and retracting a pen out of an elongated pen casing. In general, push button assembly 212 includes a plunger 214 having a push button 216 at its top end extending out of the housing 102, and a plurality of track followers 218 at its bottom end. Push button assembly 212 further includes formations 221 on the inner surfaces 110 and 118 of the covers 104 and 106 (only the formation 221 on the cover 104 is shown). When the covers are assembled together, the formations 221 together define an enclosure having a plurality of tracks 222 in which track followers 218 move up and down upon hand activation of the push button 216 of plunger 214. The assembly 212 further includes an actuator 228 fitting substantially within the plunger and against which the pen cartridge 138 abuts. A spring 230 is provided around a lower portion of the pen cartridge to bias the pen cartridge upward against the actuator 228. The actuator includes a number of teeth 232, which reside in alternating tracks 222 (e.g., there may be four teeth 232 on the actuator 228 and eight tracks 222 defined by the formations 221).

Figure 32:
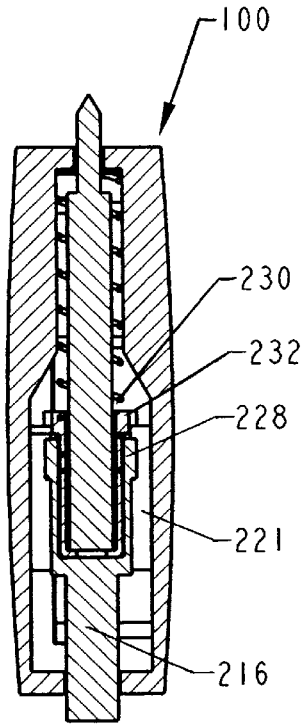
FIG. 32 is a cross-sectional side view of the embodiment of FIG. 31 with the pen in an extended position.
Figure 33:
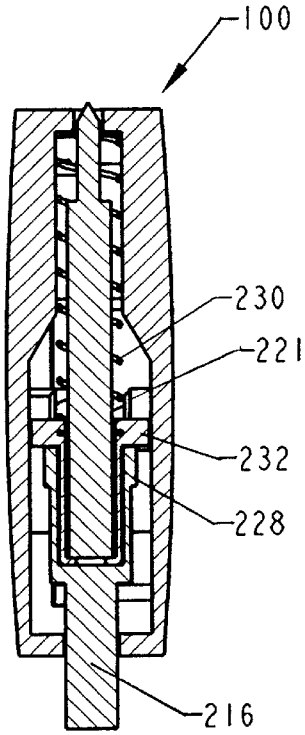
FIG. 33 is a cross-sectional side view of the embodiment of FIG. 31 with the pen in a partially extended position.
Figure 34:
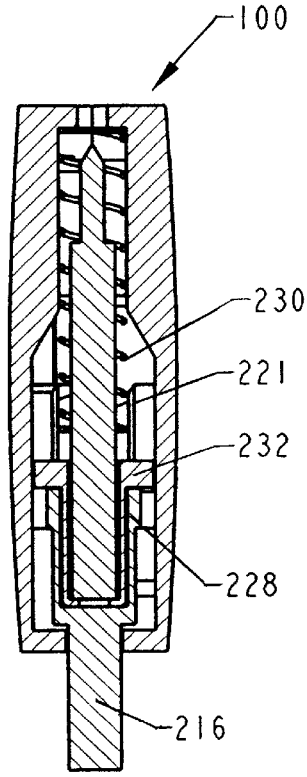
FIG. 34 is a cross-sectional side view of the embodiment of FIG. 31 with the pen in a retracted position.

As shown in FIGS. 32–34, and as is known in the art, upon each manual actuation of the plunger 214, the actuator will rotate the pitch of one track 222 as a result of teeth 232 within the tracks having slanted edges (not shown). When the teeth of the actuator reside in one set of alternating tracks, the teeth catch on stops (not shown) in the tracks so that the actuator is prevented from fully retracting. In this instance, the pen cartridge abutting against the actuator is held in the extended position as shown in FIG. 32. Upon the next depression of plunger 214, the teeth move to the next adjacent set of tracks, where they do not catch (FIG. 33) so that the spring 230 biases the pen cartridge, actuator and plunger downward (FIG. 34) to a retracted position.

As would be appreciated by those of skill in the art, other known push button assemblies may be employed wherein the tip of the pen cartridge 138 is alternately extended and retracted upon finger activation of a mechanism extending from the housing 102.

An alternative embodiment of the present invention is shown in FIGS. 35–40. This embodiment includes an assembly which operates similarly to the pushbutton assembly 212 disclosed above with respect to FIGS. 31–34, except that the push button 216 is omitted. According to this embodiment, the two covers 104, 106 are slidably mounted to each other to provide a so-called "slide by" actuation to move the pen cartridge between its extended and retracted positions. One of the covers, for example cover 104, includes posts 234, each of which includes a lip 236. The other of the covers, for example cover 106, includes a corresponding number of slots 238 formed partially through the wall on the interior of the cover. The lip 236 of each post 234 mates within a slot 238. As the slots are wider than the posts and lips, the lip is capable of sliding in the slot to allow the respective covers to slide back and forth with respect to each other.

In accordance with this embodiment, the plunger 214 (without the push button 216) abuts against an interior wall 240 of either cover 104 or 106. In an embodiment where the plunger 214 abuts against wall 240 on cover 106, when it is desired to move the pen cartridge between its extended and retracted positions, the cover 106 is advanced (downward as shown in FIG. 39) relative to cover 104. This movement in turn moves the plunger downward and the actuator 228 will rotate between alternating ratchet positions as described above. In a first rachet position (shown in FIG.38), the teeth 232 of the actuator do not catch on the tracks 222, and the pen remains in the retracted position. In a second rachet position (shown in FIG. 40), the teeth 232 of the actuator do catch on the tracks 222, and the pen is held in an extended position. A spring 230 as described above biases the pen into a retracted position and also biases the covers into a coextensive position.

Figure 93:
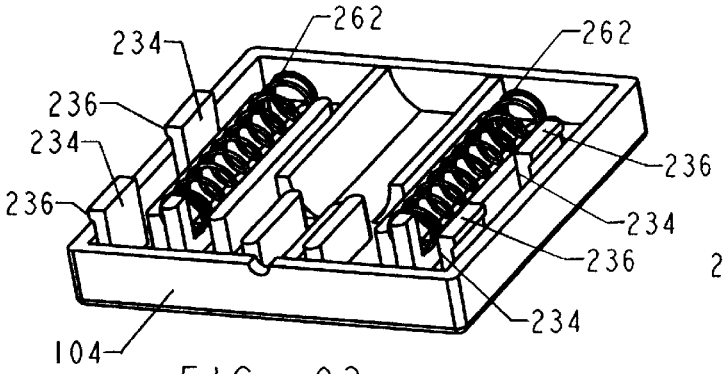
FIGS. 93–95 are perspective views of an alternative embodiment of the ratchet assembly writing instrument shown in FIGS. 35–40.
Figure 94:
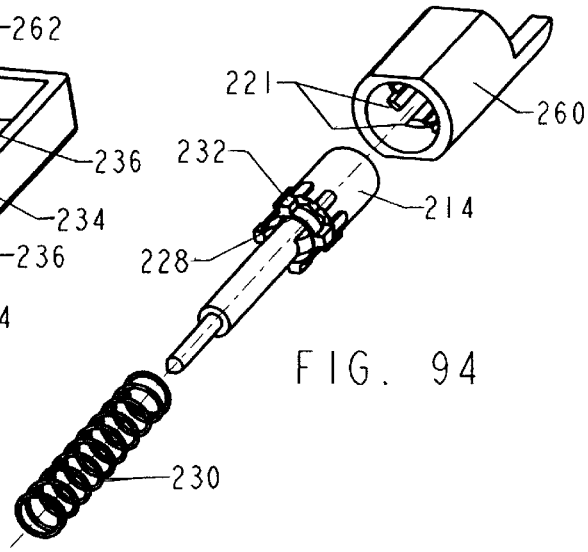
Figure 95:
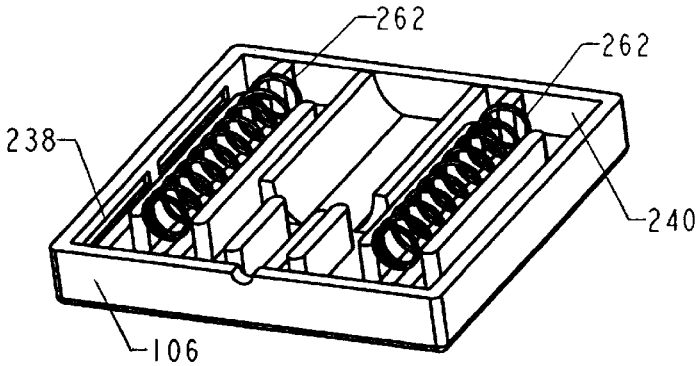

A further alternative embodiment of the slide by actuation mechanism of FIGS. 35–40 is shown in FIGS. 93–98. Components which are common to both embodiments have been assigned like reference numerals. In this embodiment, instead of formations 221 being formed on the inner surfaces 110 and 118 of the covers 104 and 106 as described above, the formations 221 are formed around an inner diameter of a cylindrical ratchet housing 260 (FIG. 94) so that the formations form a plurality of tracks 222 as described above within ratchet housing 260. Ratchet housing 260 is in turn fixedly mounted to either cover 104 or 106. Additionally, a pair of springs 262 are further provided, which springs compress when the covers are moved with respect to each other as shown in FIG. 39. The springs 262, which are preferably provided in cover 104 as shown in FIG. 93 or in cover 106 as shown in FIG. 95, bias the covers in a "home" position with respect to each other, i.e. to a position where the covers are coextensive with each other.

Figure 97:
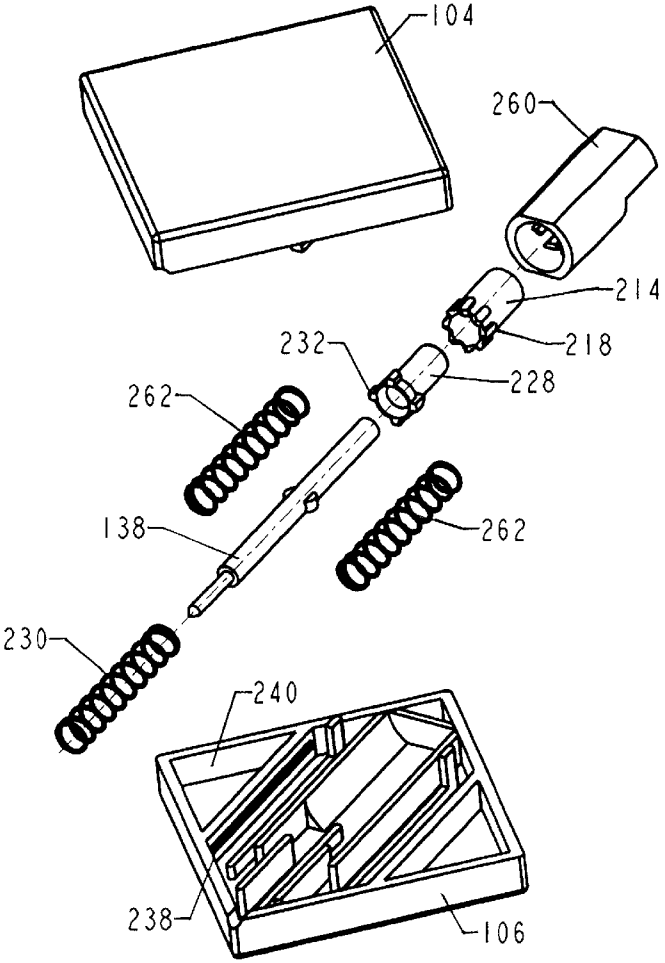
FIGS. 96–98 are exploded perspective and cross-sectional views of an alternative embodiment of the ratchet assembly writing instrument shown in FIGS. 93–95.
Figure 96:
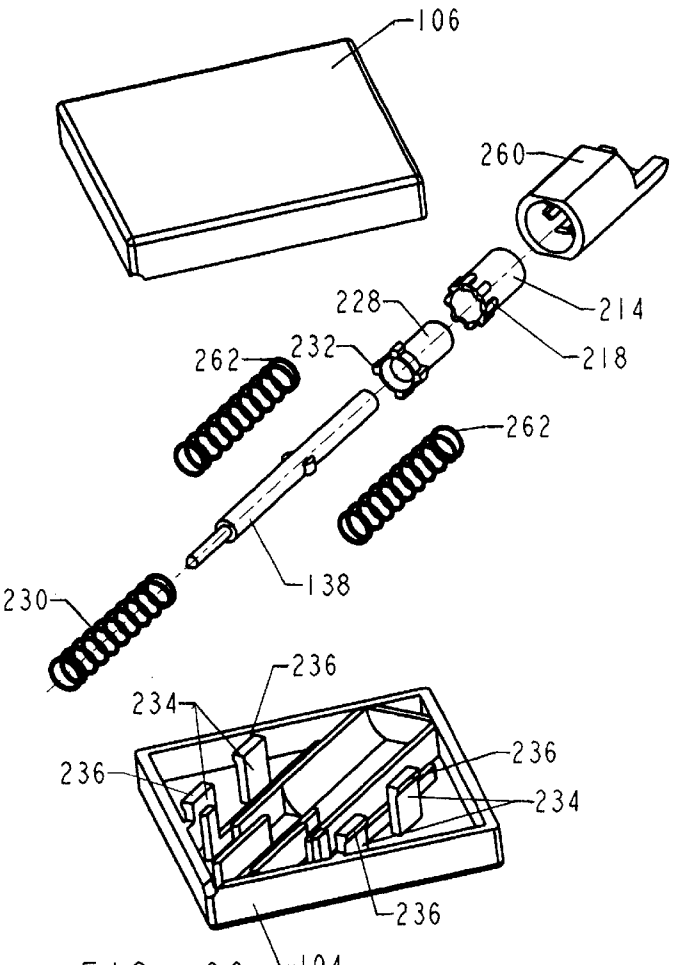
Figure 98:
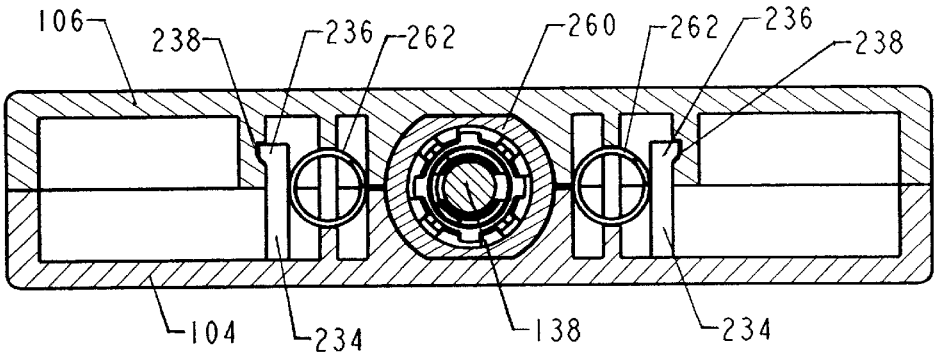

The pen tip may protrude from a side between two corners in the slide by ratchet pen assembly as shown in FIGS. 35–40 and 93–95. Alternatively, as shown in FIGS. 96–98, the covers 104 and 106 may be square, but the pen tip may protrude from a corner where two sides come together. Thus, the covers move with respect to each other along a line between a pair of diametrically opposed corners to extend and retract the pen tip by the ratcheting assembly as described above.

Writing Instrument Including Pressure-Activated Assembly

Although not shown in the drawings, a further embodiment of the present invention may comprise a writing instrument where the pen cartridge is actuated between its extended and retracted positions as a result of applying inwardly directed pressure on the outer surfaces of covers 104 and 106. According to this embodiment, covers 104 and 106 are preferably formed of an elastic polymer such as any of various plastics, and having a modulus of elasticity that allow the covers to elastically deform upon a pressure applied to the outer surface of the covers.

As would be appreciated by those of skill in the art, various mechanisms may be employed in accordance with this embodiment to extend and retract the pen cartridge. For example, the mechanism could be made up of a series of tiny, interconnected four-bar linkages so that a pressure exerted on the mechanism in one direction (i.e., along the upper and lower edge of the mechanism) results in a change in the length of the mechanism. The mechanism would be located within the housing 102 in a plane perpendicular to the inner surfaces of covers 104 and 106, and colinear with pen cartridge 138. Each joint in the mechanism could be affixed together by a small pin holding the respective members together while allowing rotation of the joined members with respect to each other. The back end of the pen cartridge would be affixed to or abutting against the end of the mechanism, so that upon extension of the mechanism as a result of pressure on the covers, the mechanism and the cartridge would extend. A rachet and spring assembly as described above could be used to hold the pen extended upon a first application of pressure to the covers, and to allow the pen to retract upon a second application of pressure.

As an alternative to covers formed of a polymer, the covers may be formed of a thin gauge metal with an inherent bias into a position where the covers bow slightly outward. In this embodiment, upon application of a threshold pressure to the respective covers, the covers may invert so that the covers bow inward to actuate the cartridge extension mechanism as described above. Due to the inherent bias of the covers to remain in their natural position, the covers will snap quickly inward upon application of the threshold pressure, and will snap quickly back to their natural position upon removal of the pressure. The covers may also be made to make an audible snapping noise when moving between their natural and inwardly bowed positions.

Each component used in making the writing instrument 100 according to the various above-described embodiments can be manufactured and assembled at a low cost, thus allowing the finished writing instrument to be economically manufactured. However, it is further understood that high-end writing instruments according to the above-described embodiments may also be provided. In such writing instruments, the focus is not in providing an economical finished product, but in providing a precision, durable and/or elegant finished product. As will be appreciated by those of skill in the art, other components may be substituted for those described above for providing such a high-end writing instrument.

Figure 41:
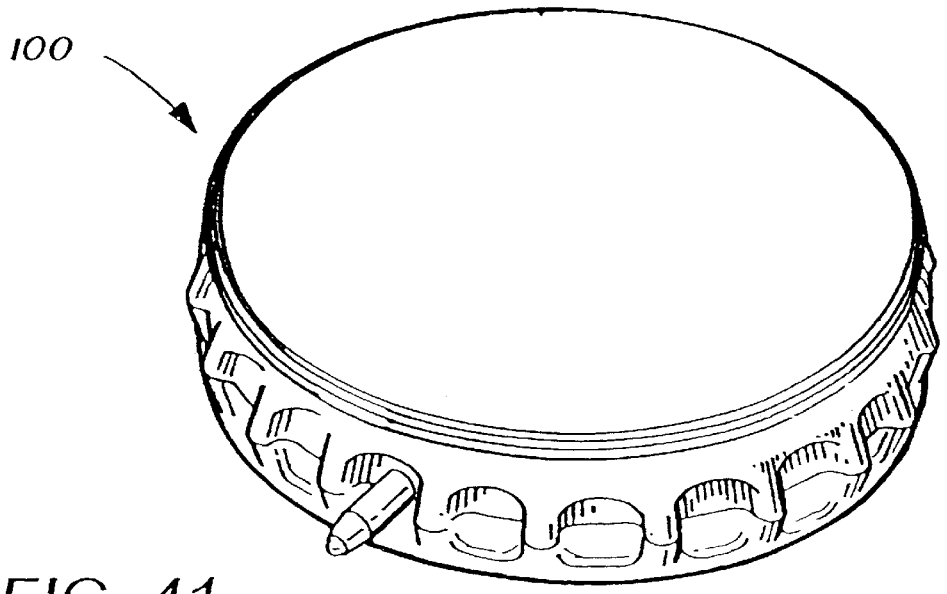
FIG. 41 is a perspective view showing the housing shaped like two bottlecaps joined together.
Figure 42:
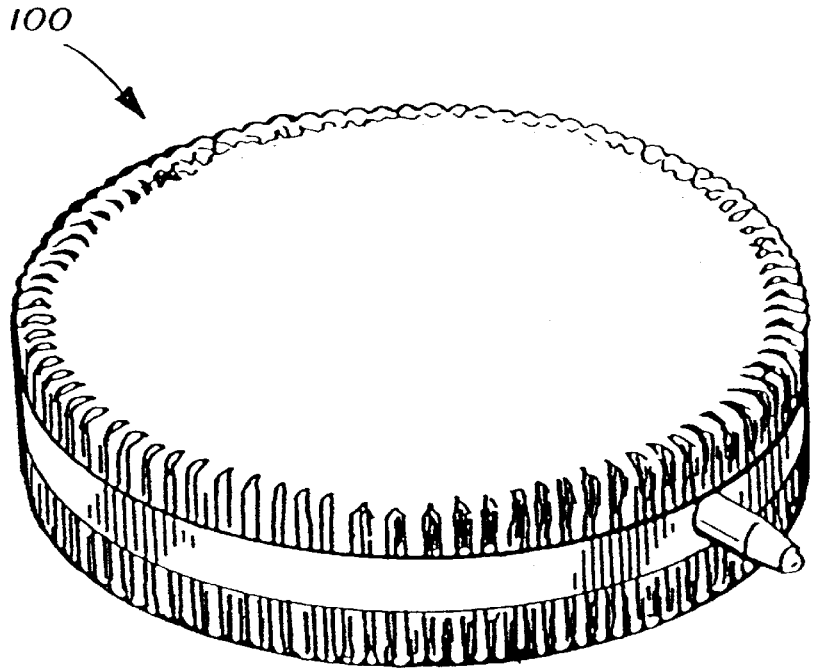
FIG. 42 is a perspective view of the present invention shaped like an Oreo® cookie.
Figure 41A:
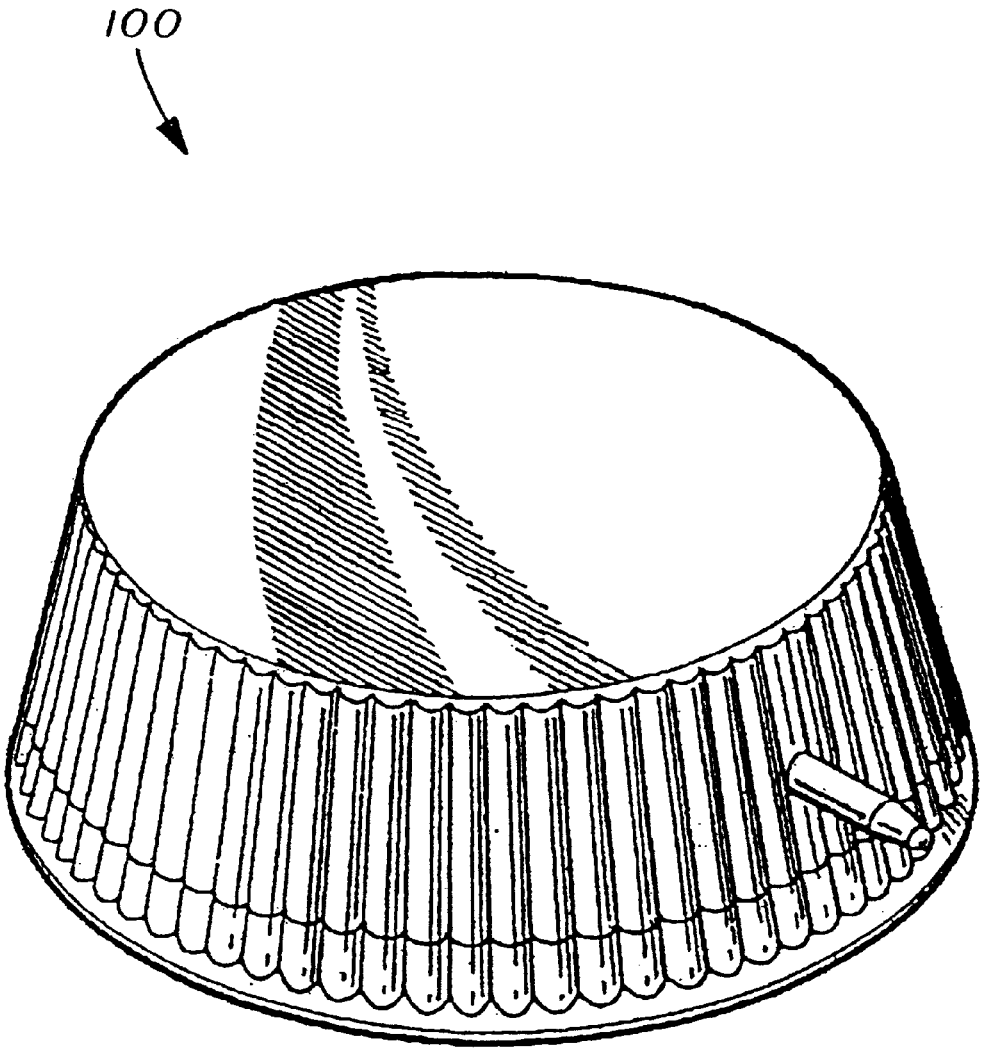
FIG. 41A is a perspective view of bottle cap.
Figure 43:
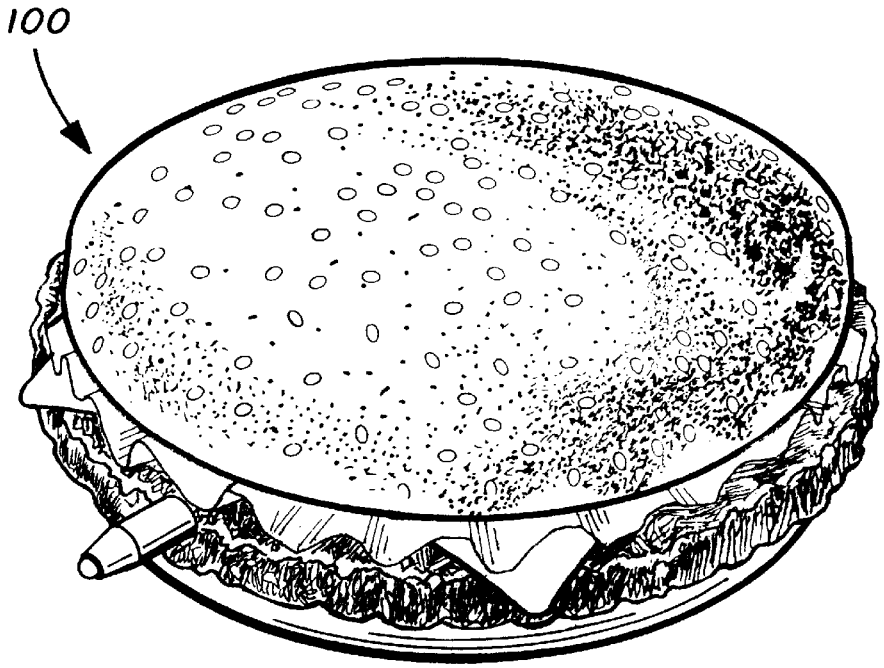
FIG. 43 is a perspective view of the present invention shaped like a hamburger.
Figure 44:
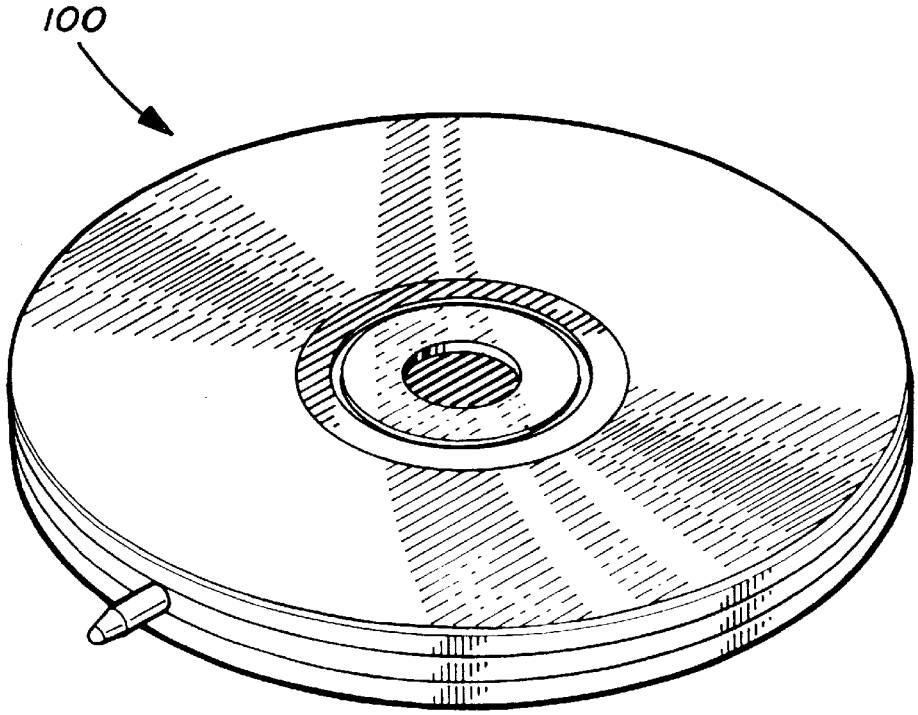
FIG. 44 is a perspective view of the present invention shaped like a compact disc.
Figure 45:
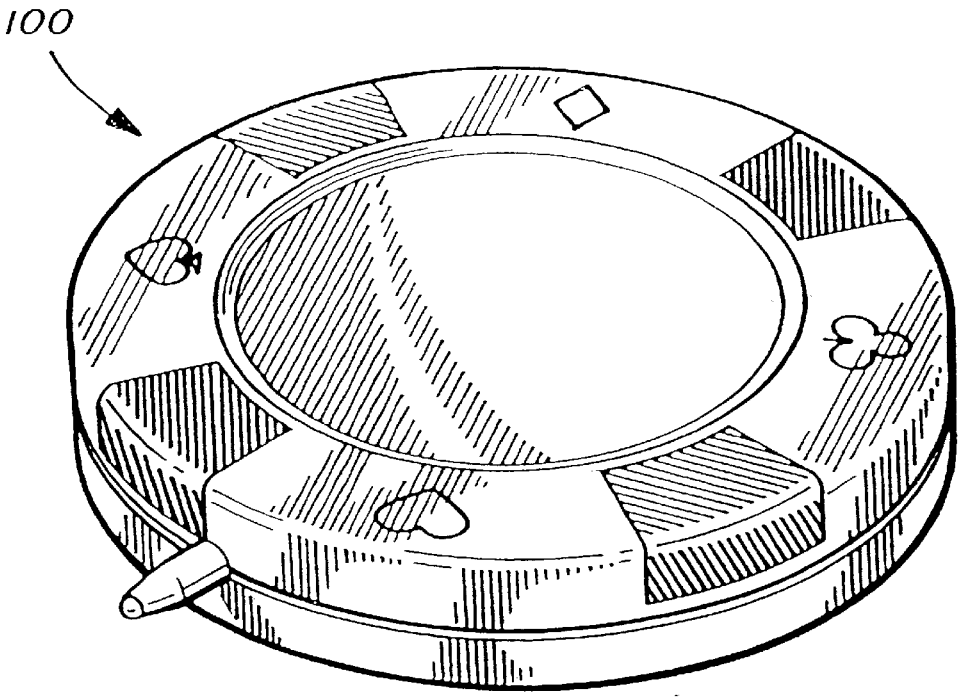
FIG. 45 is a perspective view of the present invention shaped like a gambling chip.
Figure 46:
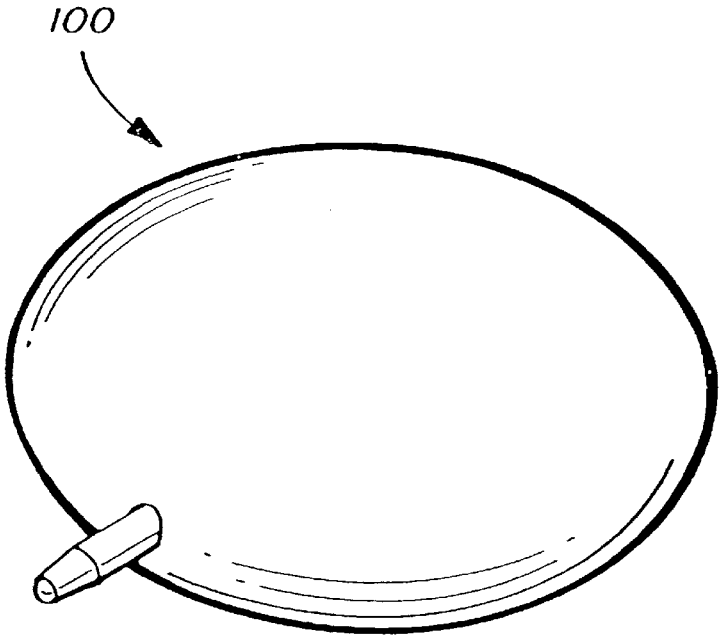
FIG. 46 is a perspective view of the present invention shaped like an M&M® chocolate candy piece.
Figure 47:
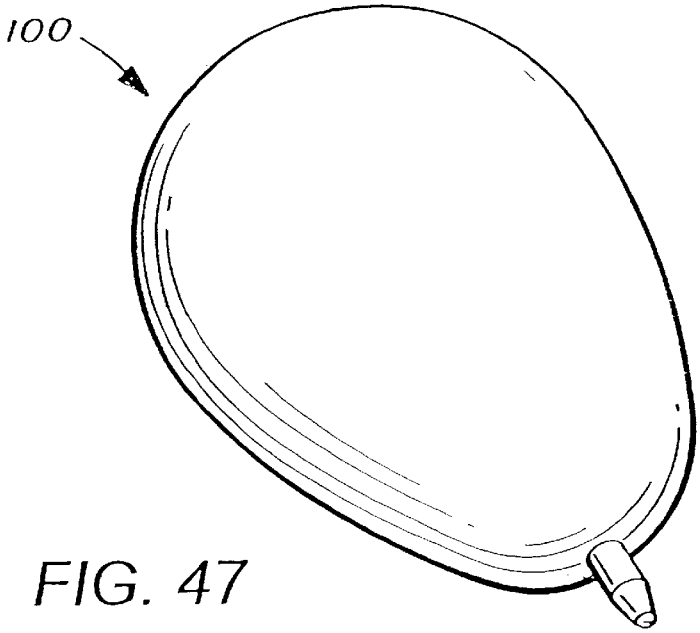
FIGS. 47 and 47 A are perspective views of the present invention shaped like a M&M® chocolate covered peanut candy piece.
Figure 48:
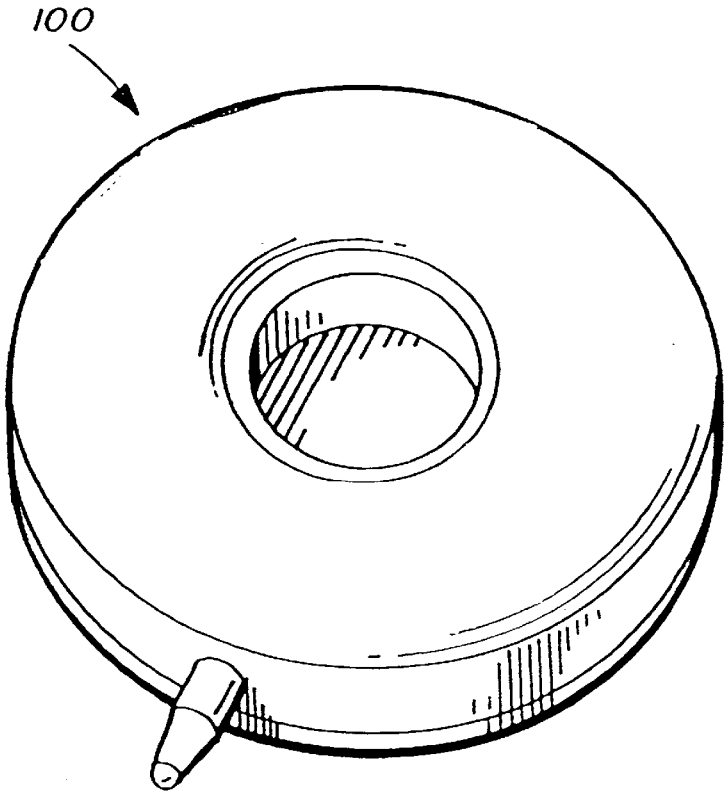
FIG. 48 is a perspective view of the present invention shaped like a LifeSavers® candy piece.
Figure 47A:
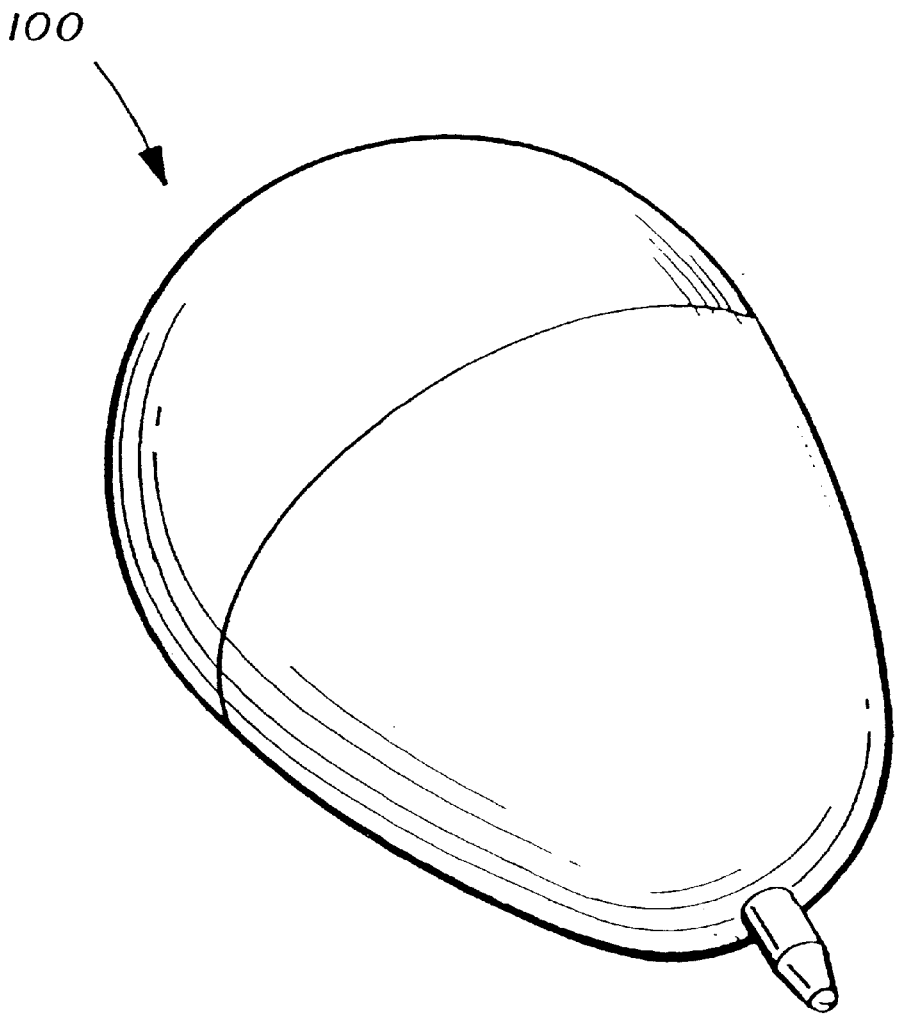
Figure 49:
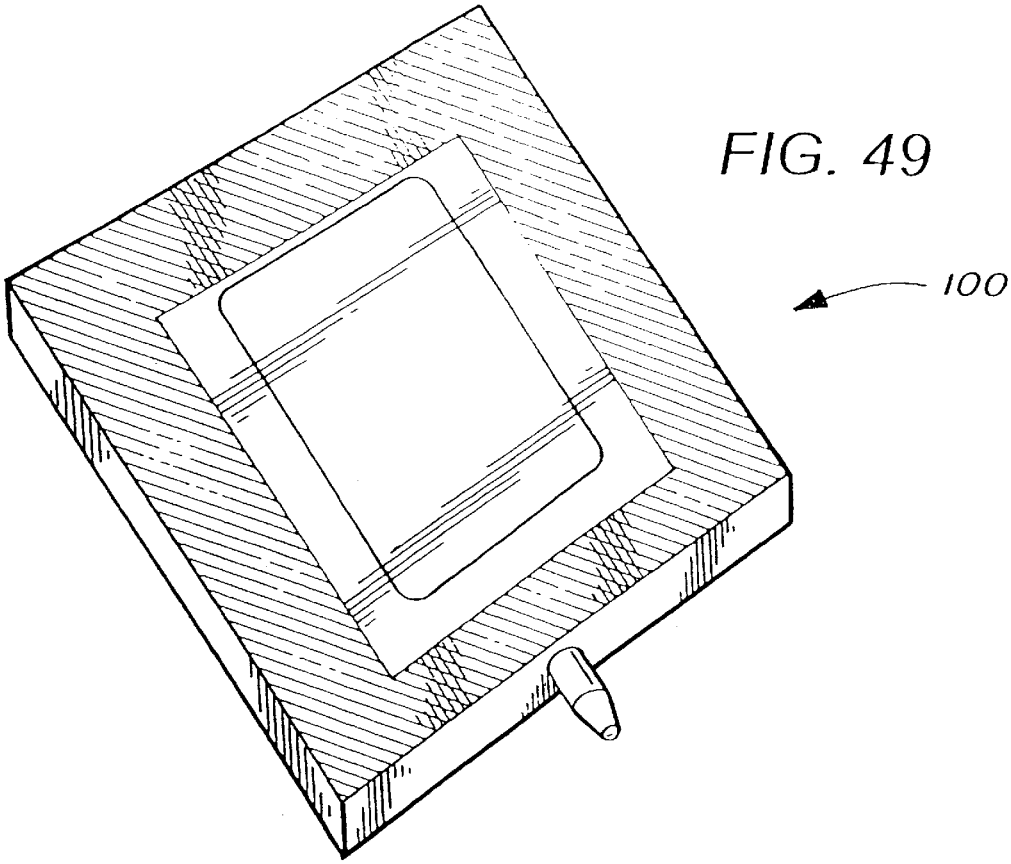
FIGS. 49 and 49A are perspective views of the present invention shaped like a computer chip.
Figure 50:
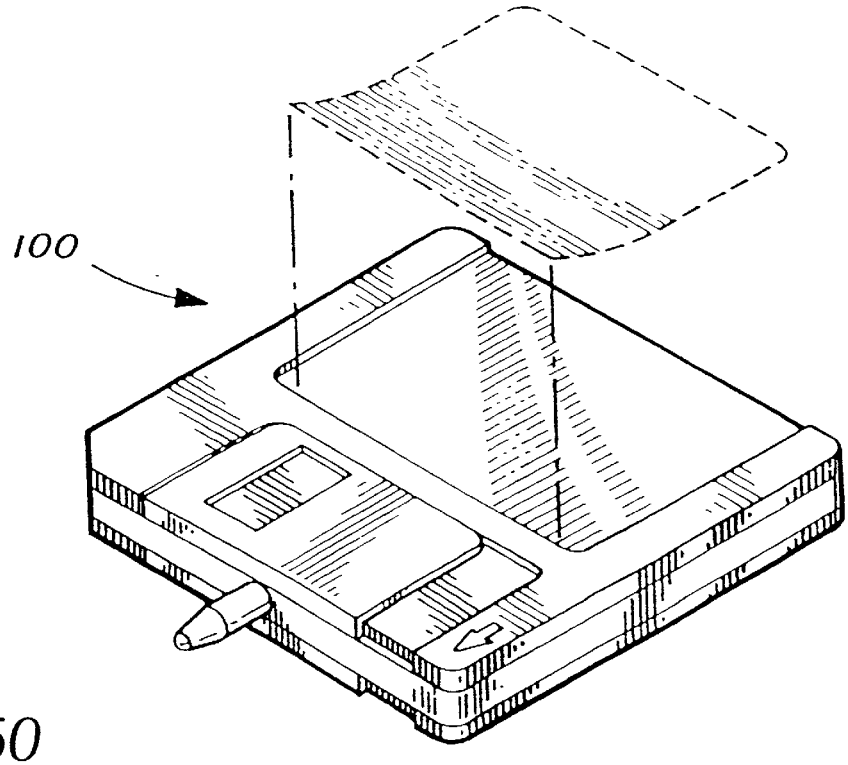
FIG. 50 is a perspective view of the present invention shaped like a floppy disk.
Figure 49A:
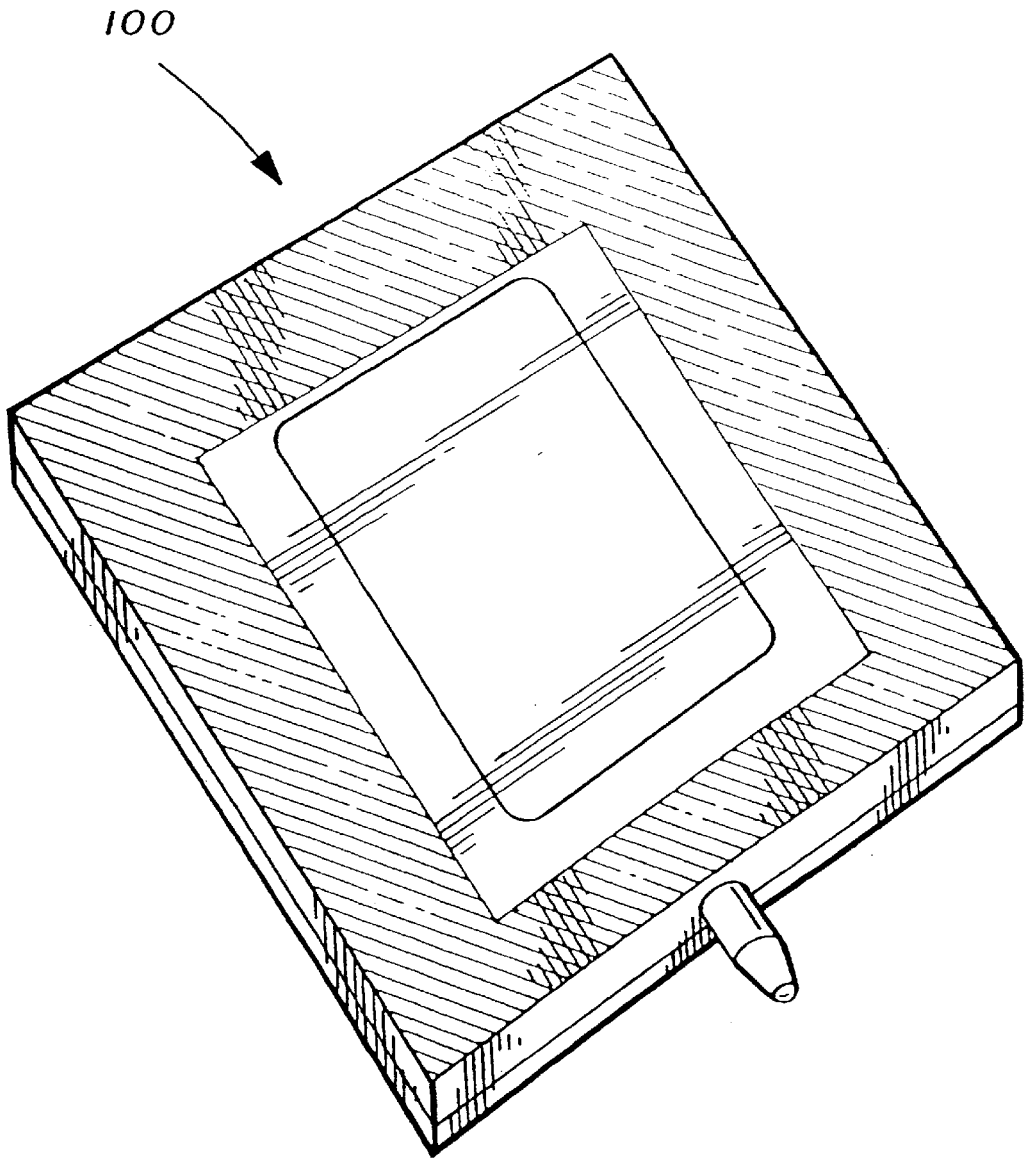
Figure 51:
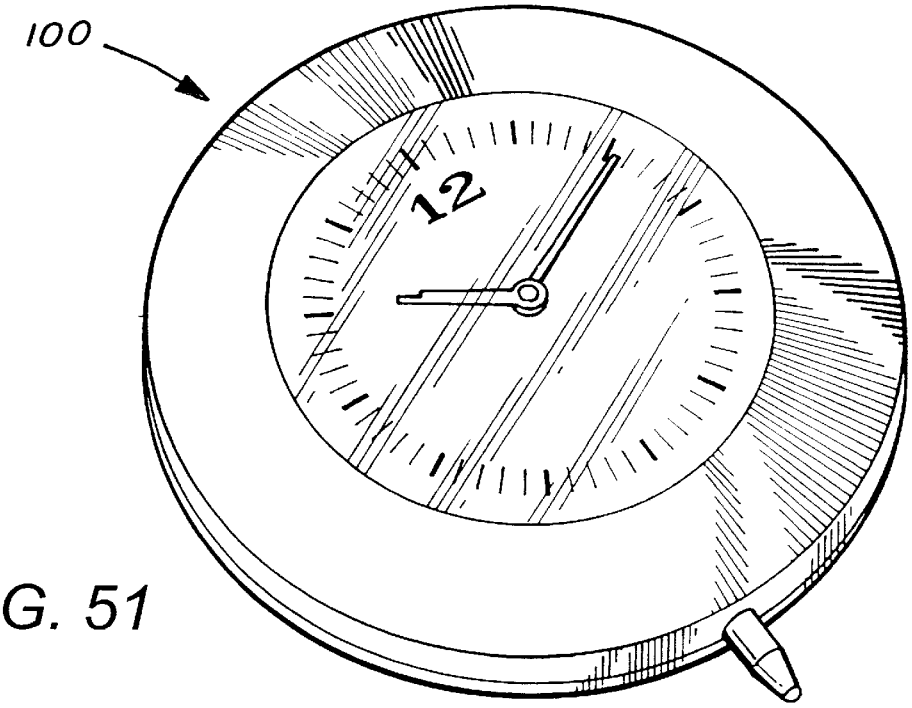
FIG. 51 is a perspective view of the present invention shaped like a watch including minute and second hands.
Figure 52:
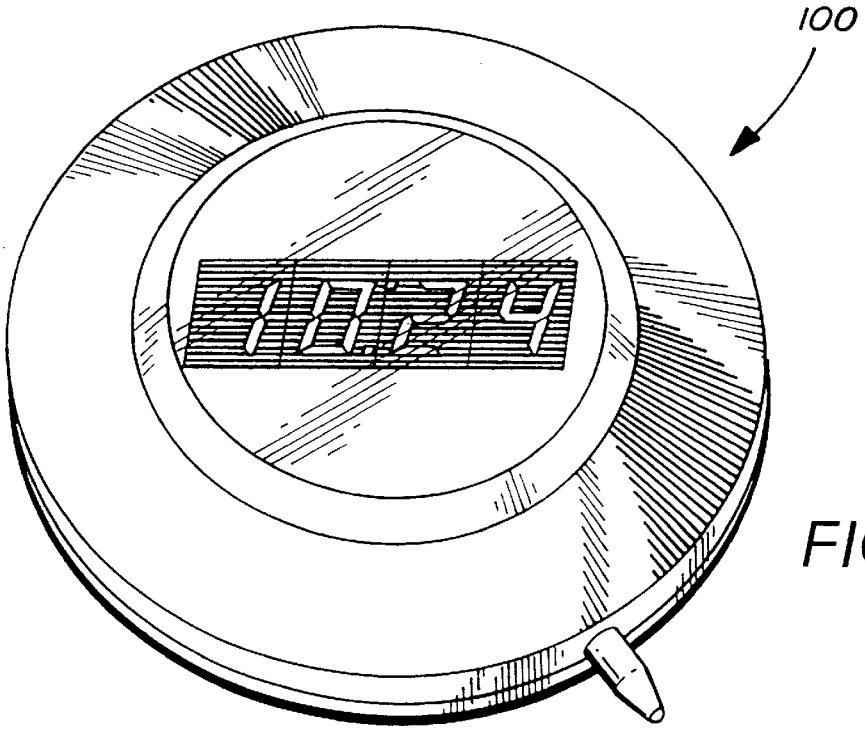
FIG. 52 is a perspective view of the present invention shaped like a watch including a digital readout.
Figure 53:
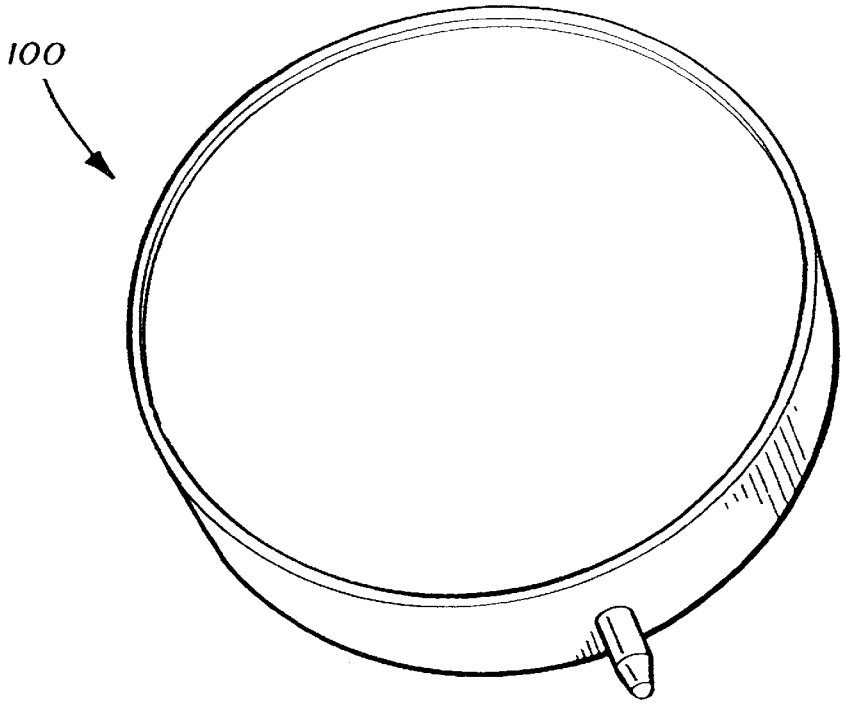
FIGS. 53 and 53A are perspective views of the present invention shaped like an ice cream container cover.
Figure 54:
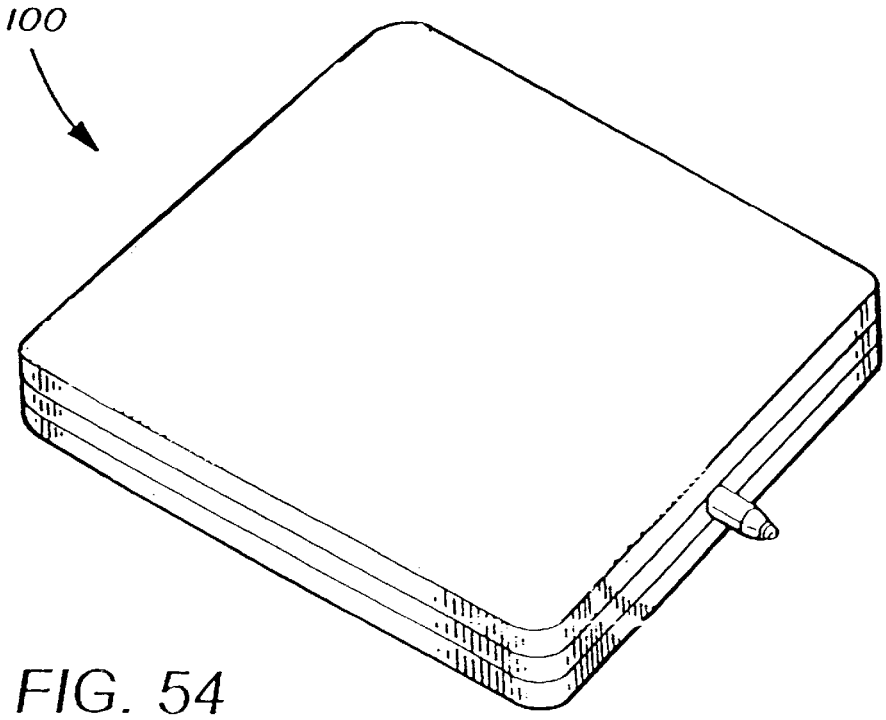
FIG. 54 is a perspective view of the present invention shaped like a coaster.
Figure 53A:
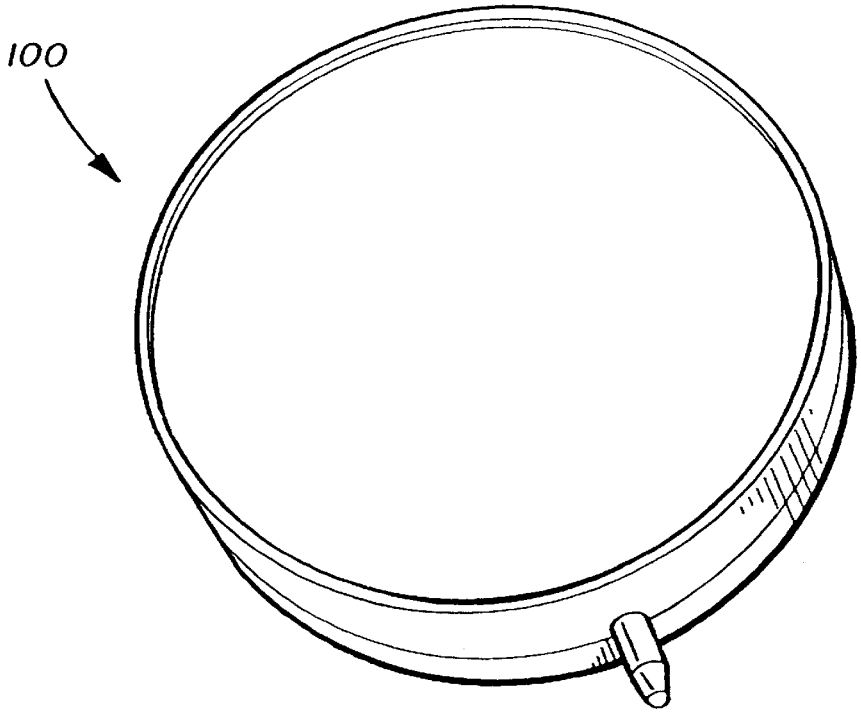
Figure 55:
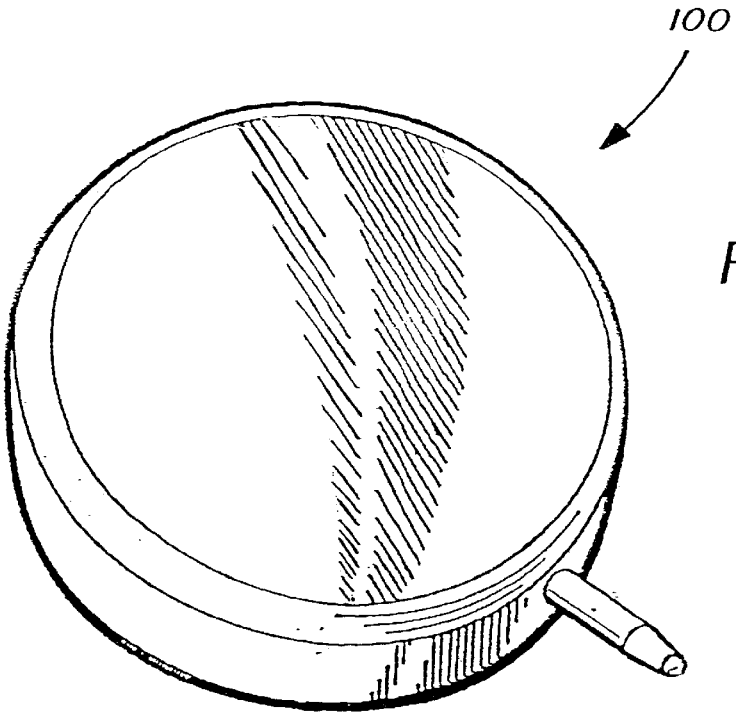
FIG. 55 is a perspective view of the present invention shaped like a pill.
Figure 56:
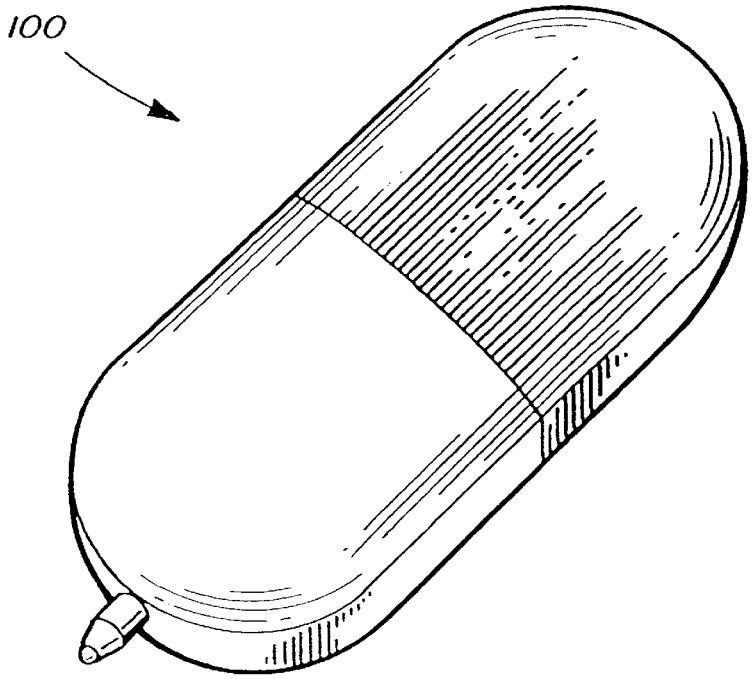
FIGS. 56 and 56A are perspective views of the present invention shaped like a capsule.
Figure 56A:
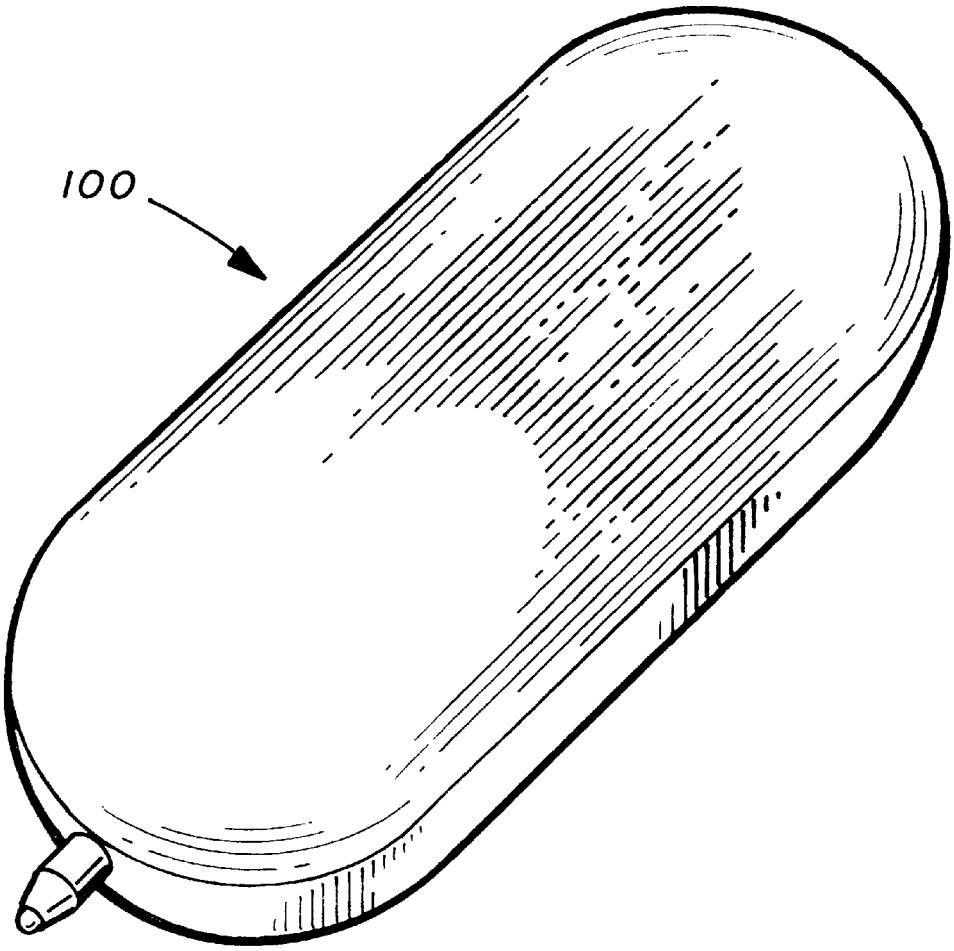
Figure 57:
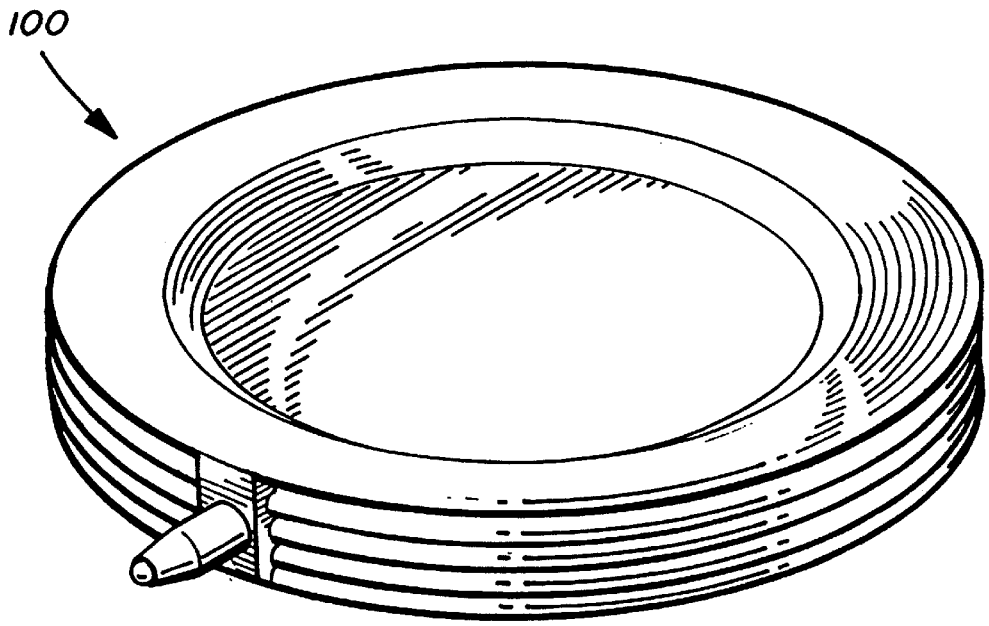
FIG. 57 is a perspective view of the present invention shaped like a plate.
Figure 58:
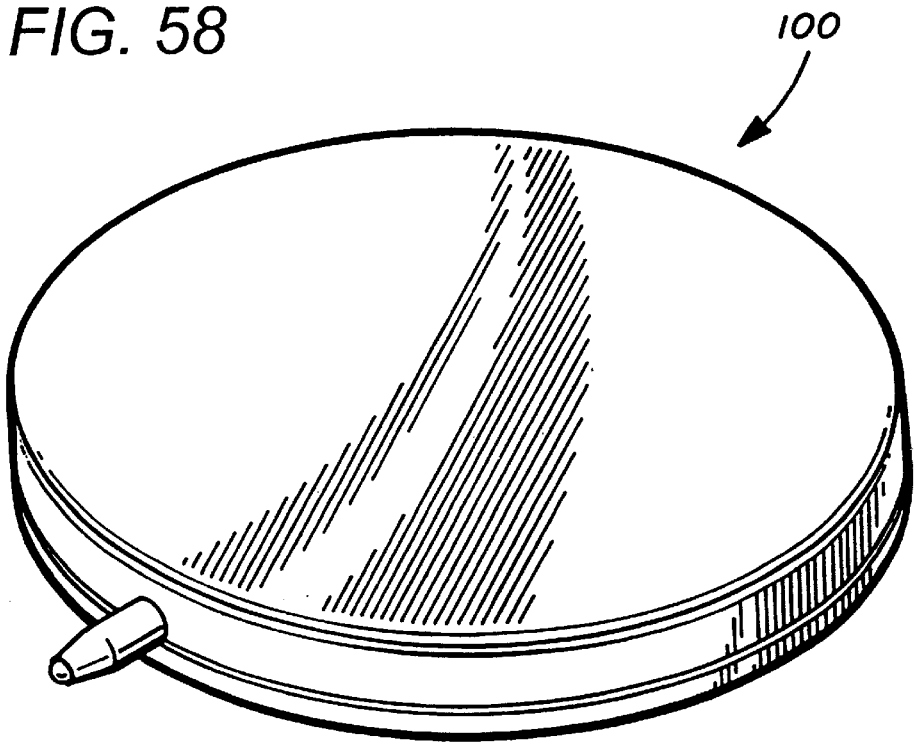
FIG. 58 is a perspective view of the present invention shaped like a make-up compact.
Figure 59:
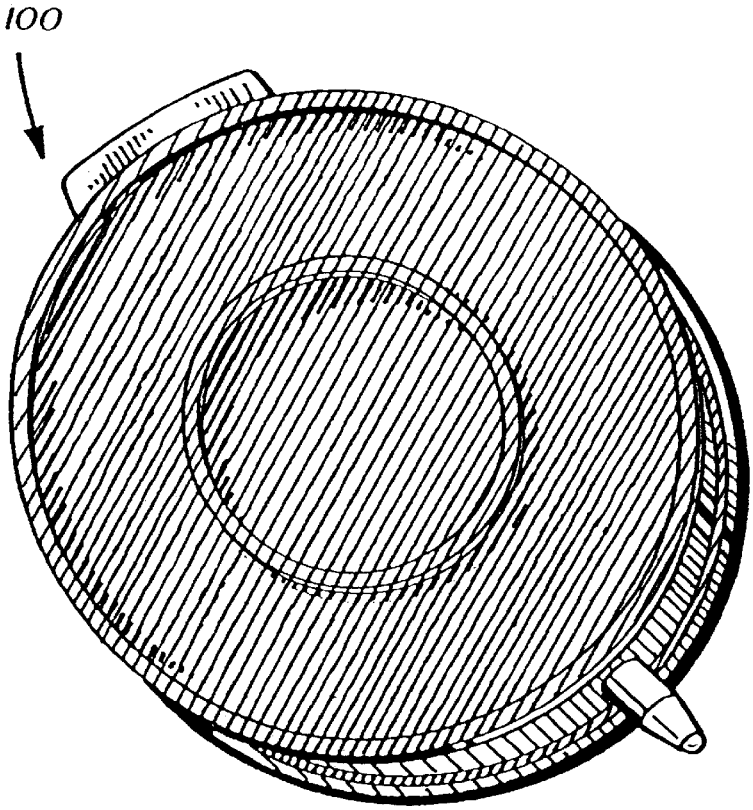
FIG. 59 is a perspective view of the present invention shaped like a rivet.
Figure 60:
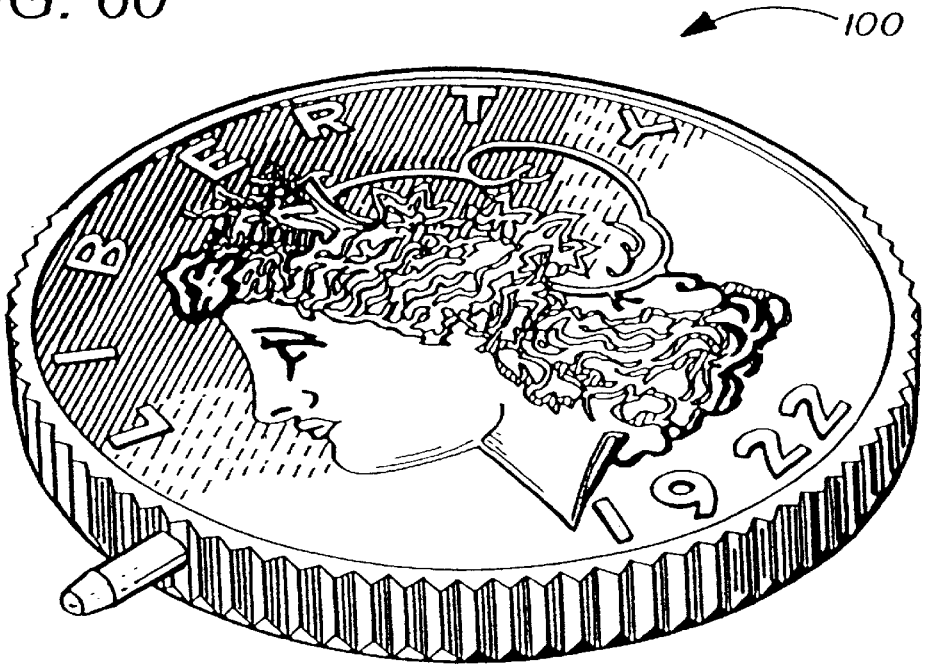
FIGS. 60 and 60A are perspective views of the present invention shaped like a coin.
Figure 60A:
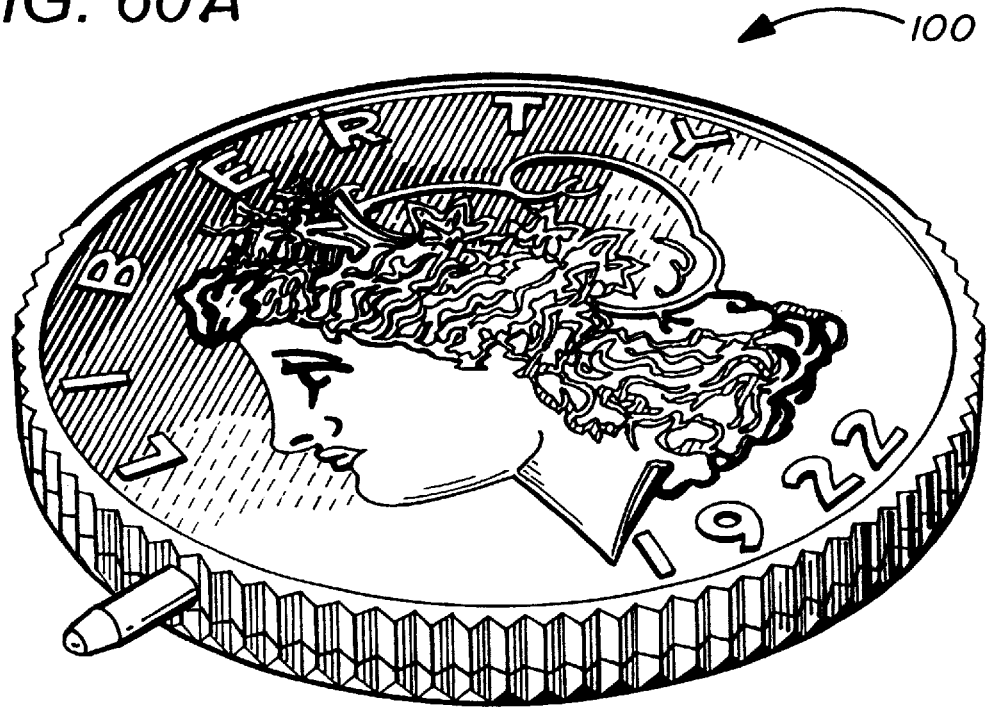
Figure 63:
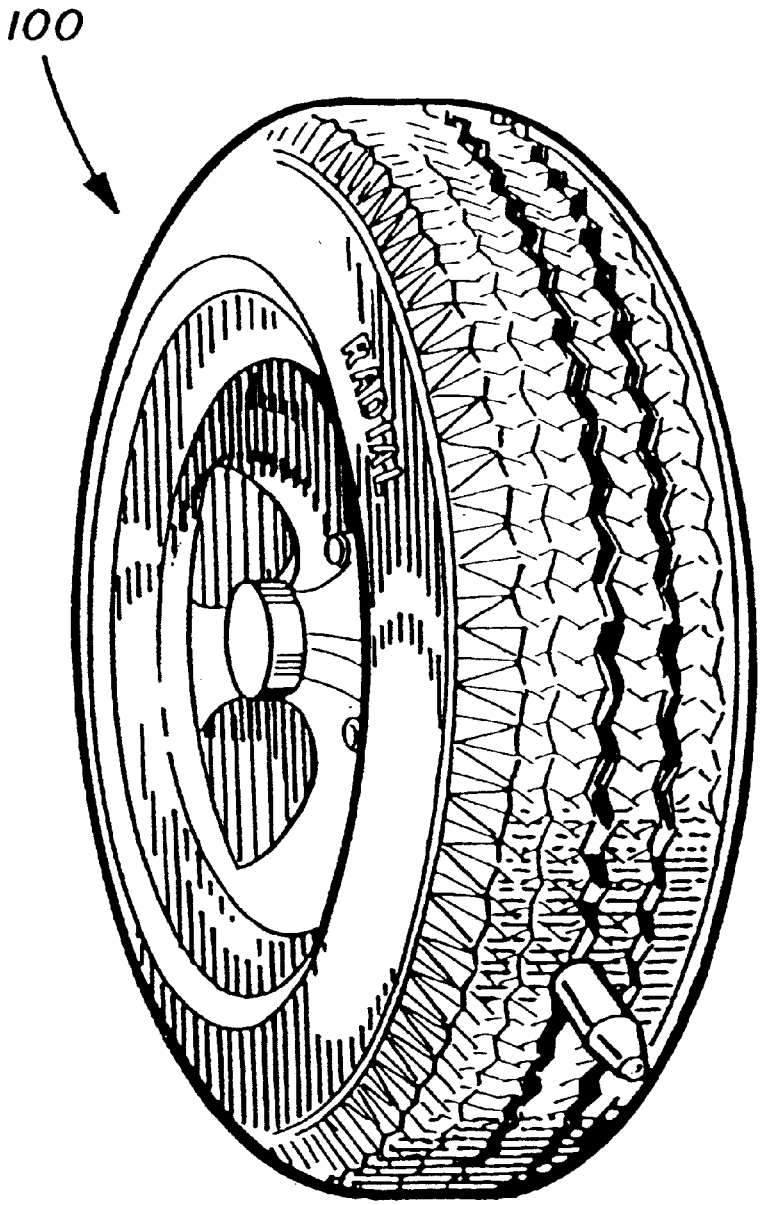
FIG. 63 is a perspective view of the present invention shaped like a tire.
Figure 64:
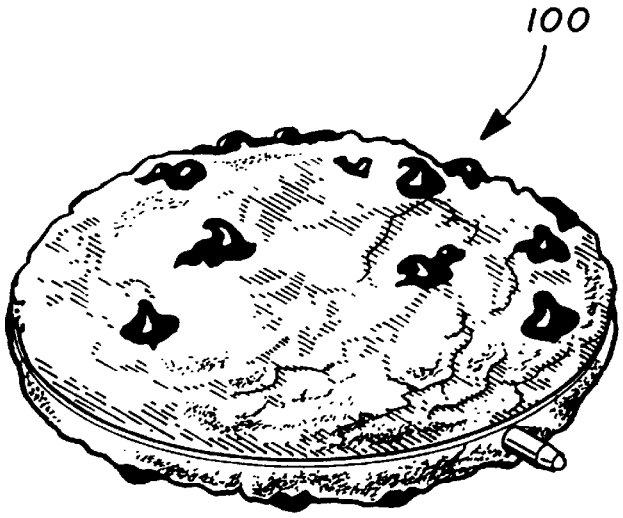
FIG. 64 is a perspective view of the present invention shaped like a double-sided chocolate chip cookie.
Figure 65:
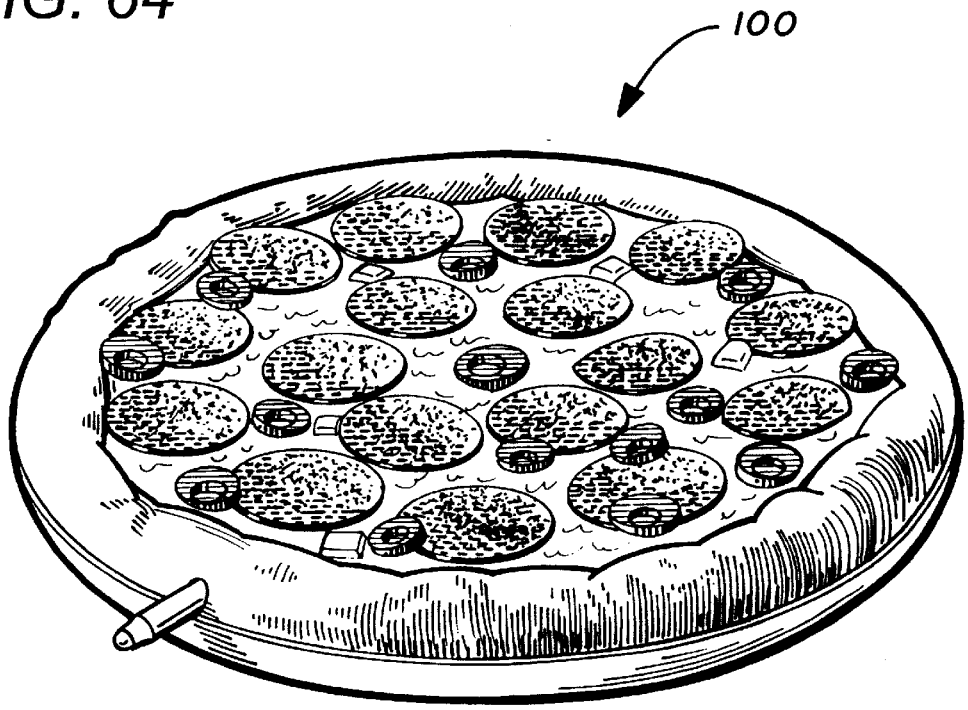
FIG. 65 is a perspective view of the present invention shaped like a pizza.
Figure 66:
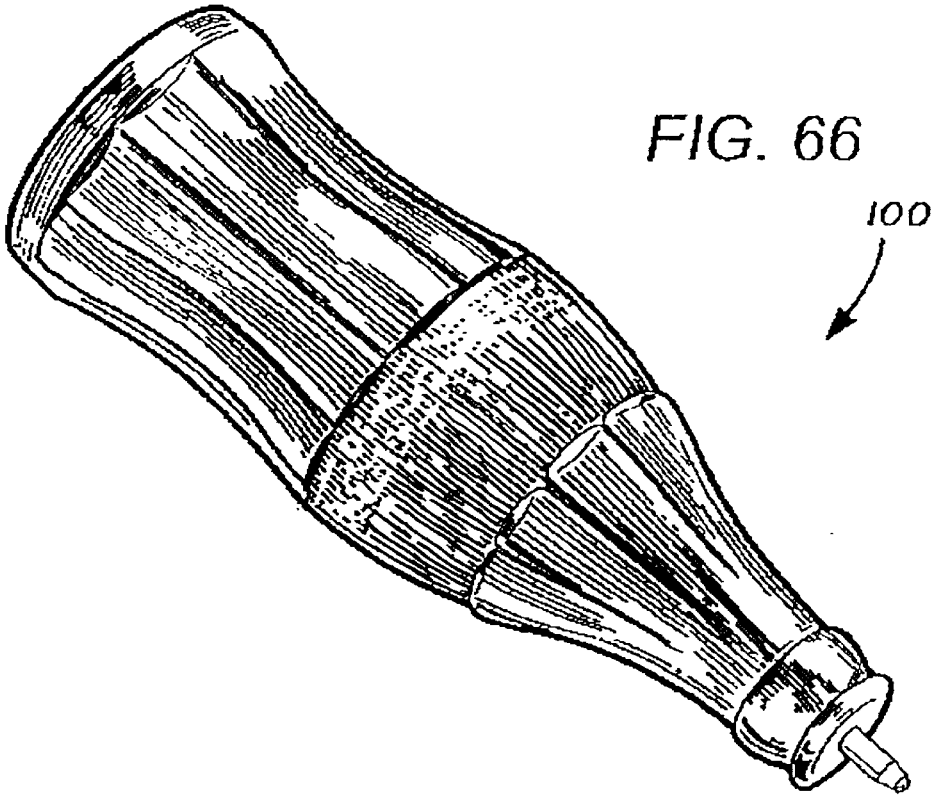
FIG. 66 is a perspective view of the present invention shaped like a bottle.
Figure 67:
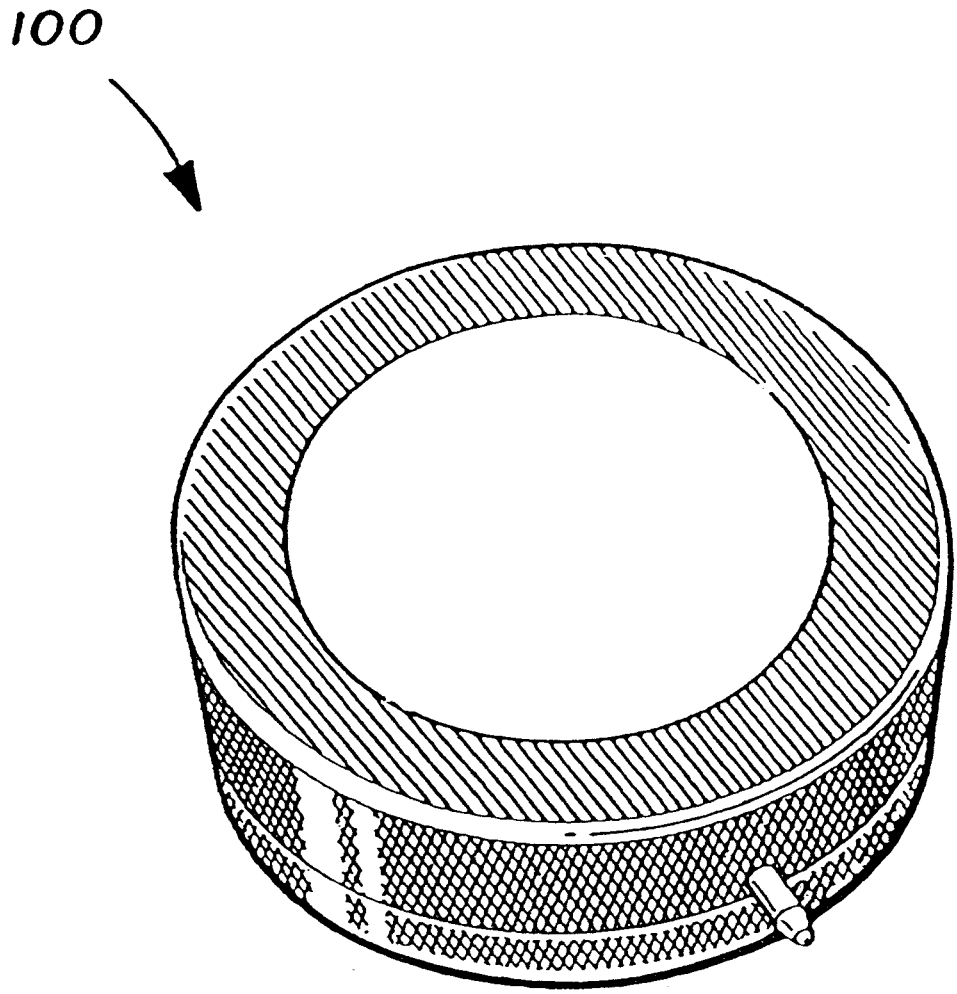
FIG. 67 is a perspective view of the present invention shaped like a hockey puck.
Figure 68:
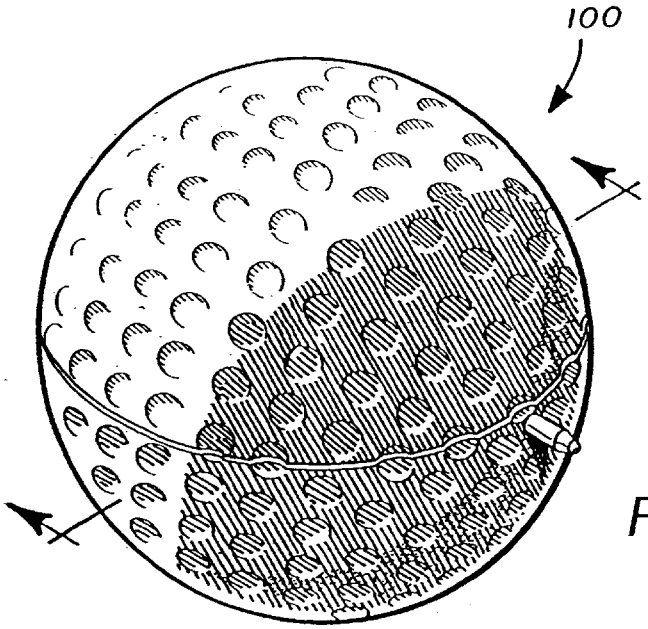
FIG. 68 is a perspective view of the present invention shaped like a golf ball.
Figure 68B:
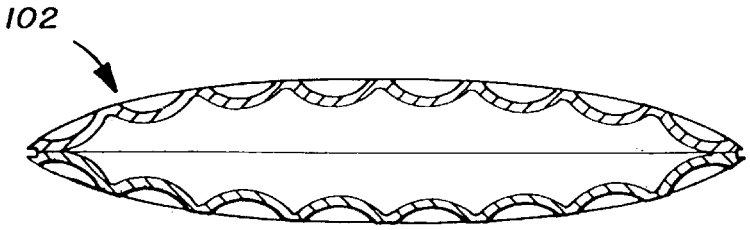
FIGS. 68A and 68B are cross-sectional views of an alternative embodiment to that shown in FIG. 68.
Figure 68A:
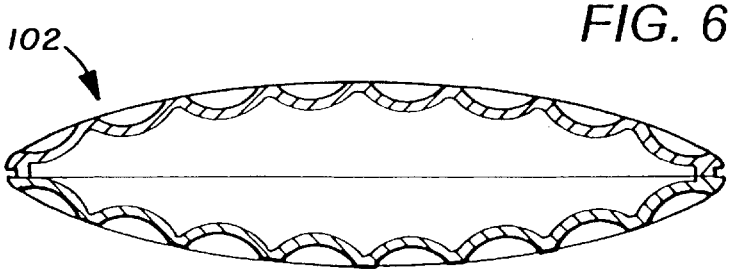
Figure 72:
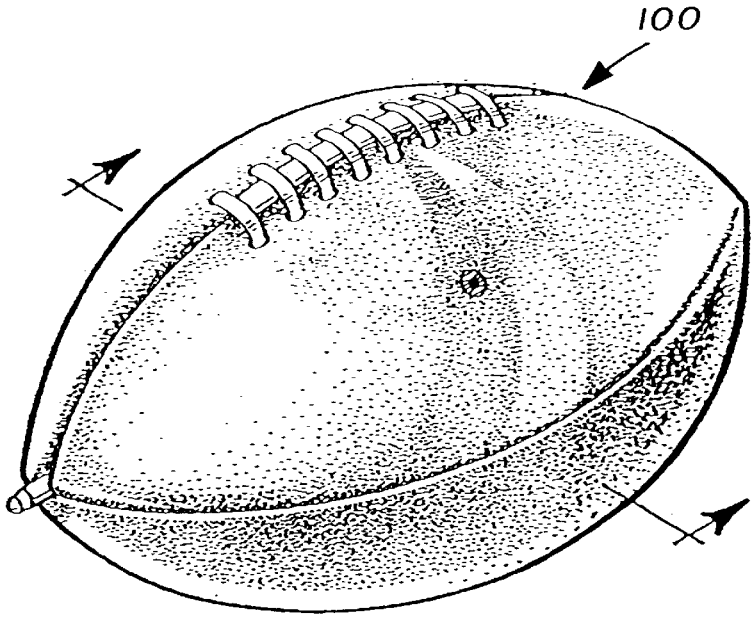
FIG. 72 is a perspective view of the present invention shaped like a football.
Figure 72B:
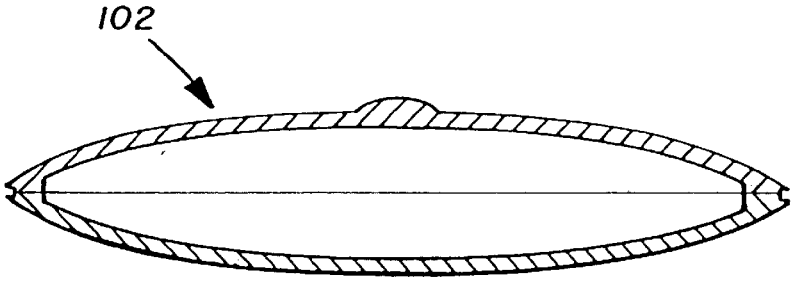
FIGS. 72A and 72B are cross-sectional views of an alternative embodiment to that shown in FIG. 72.
Figure 72A:
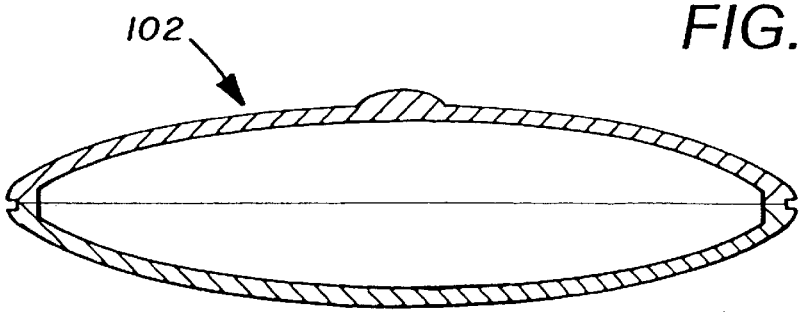
Figure 73:
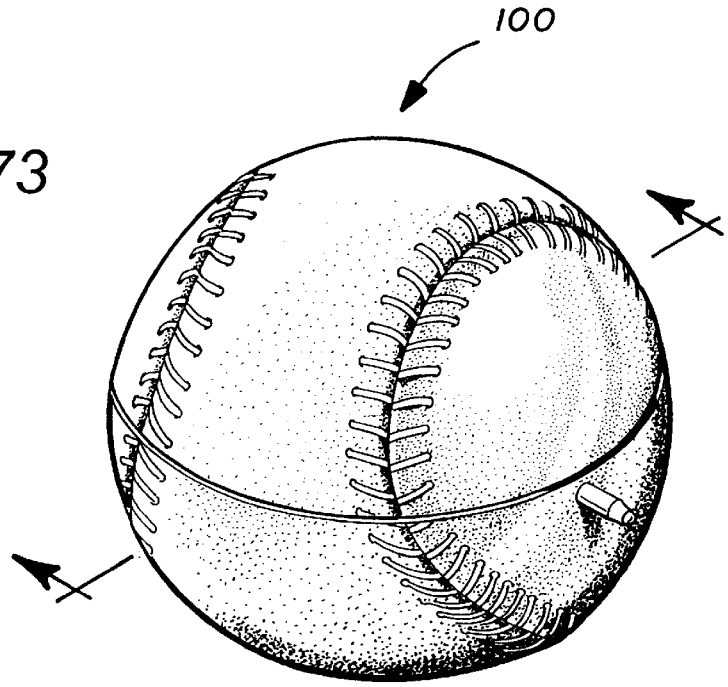
FIG. 73 is a perspective view of the present invention shaped like a baseball.
Figure 73B:
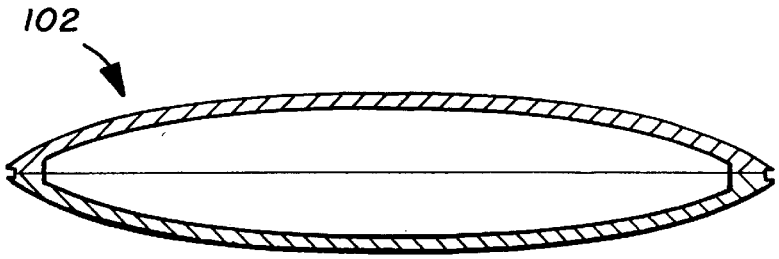
FIGS. 73A and 73B are cross-sectional views of an alternative embodiment to that shown in FIG. 73.
Figure 73A:
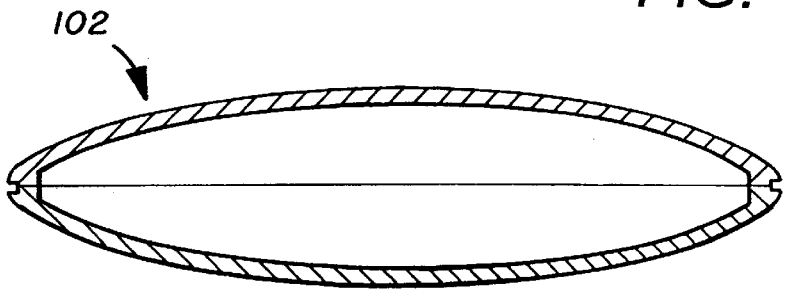
Figure 99:
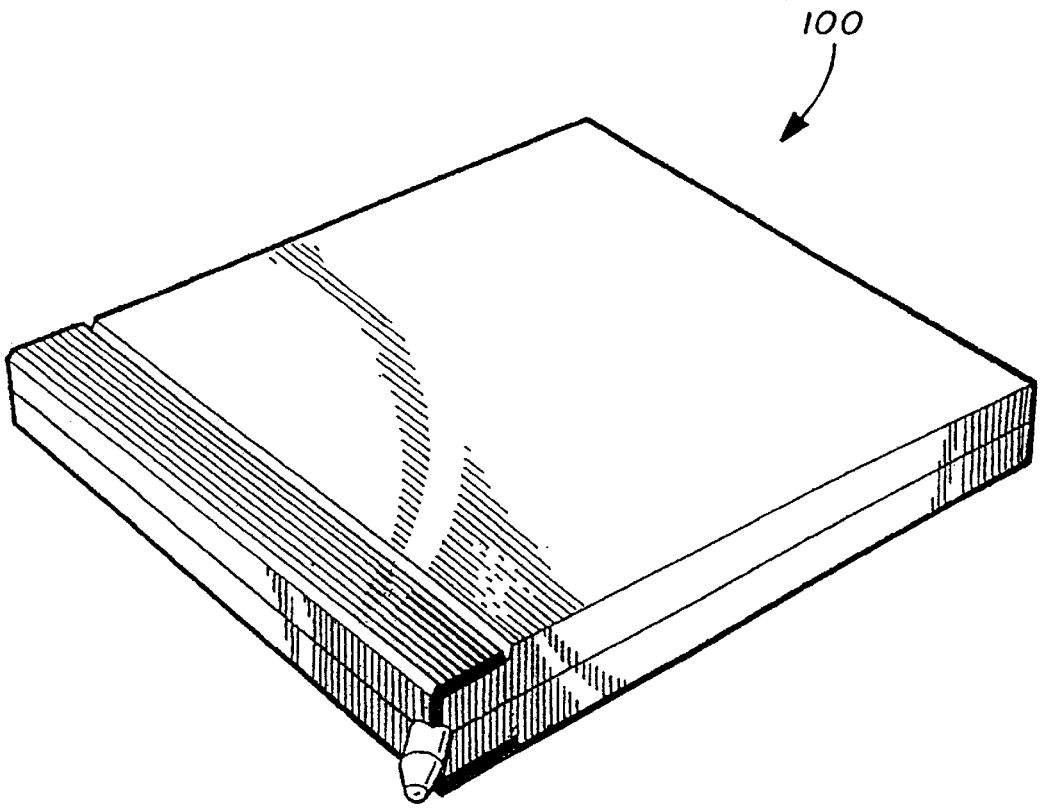
FIG. 99 is a perspective view of the present invention shaped like a compact disk case.
Figure 100:
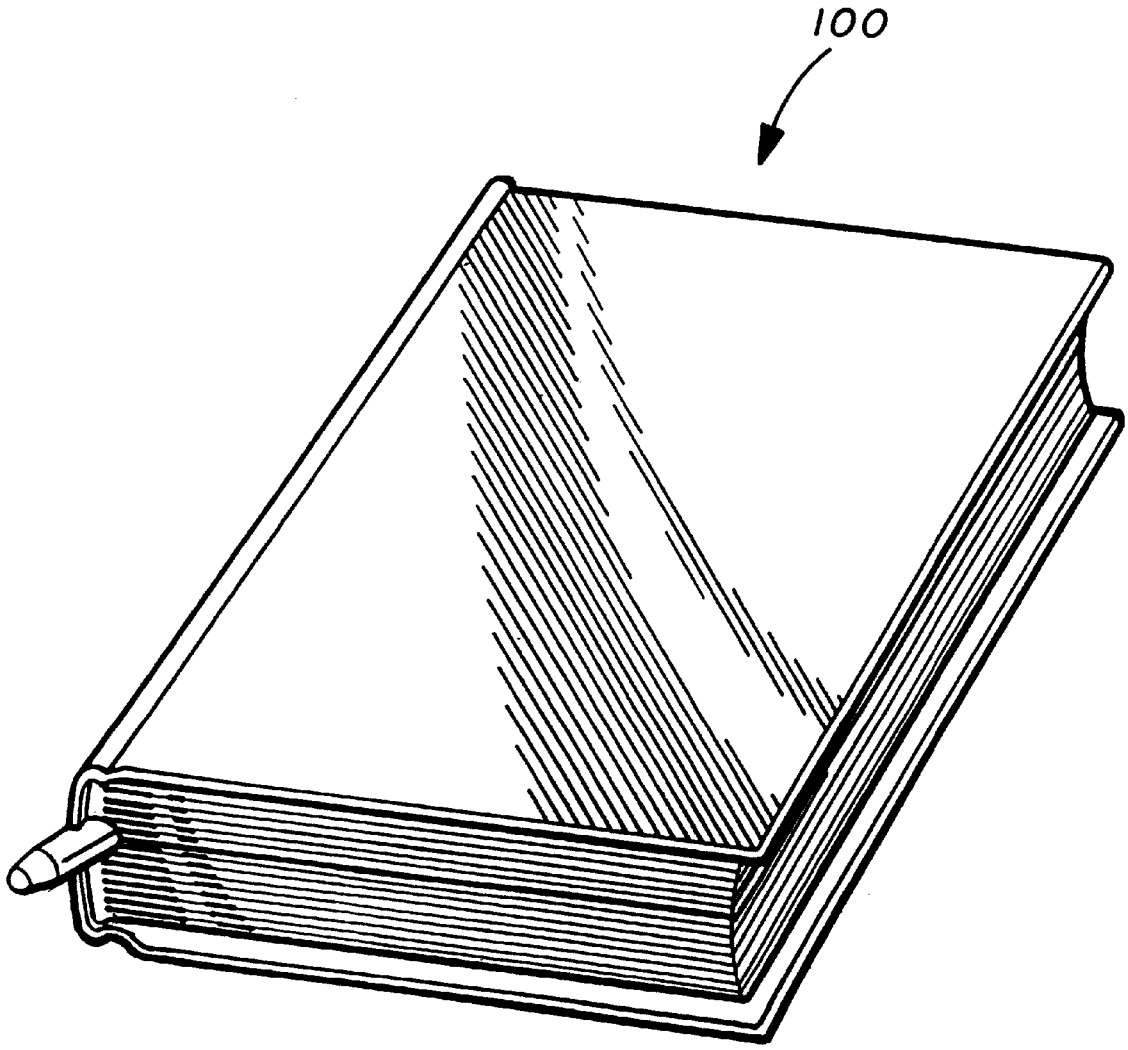
FIG. 100 is a perspective view of the present invention shaped like a book.
Figure 101:
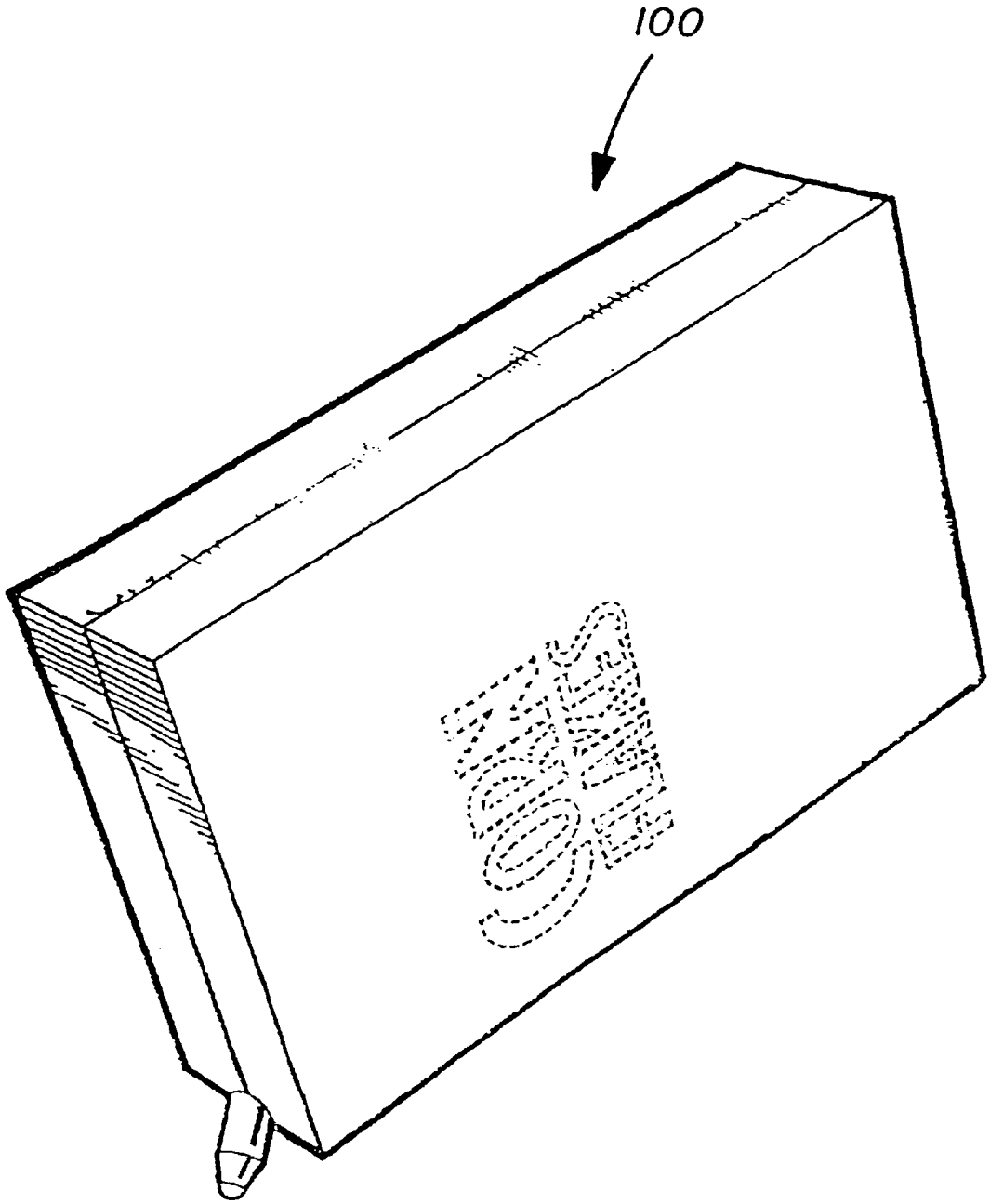
FIG. 101 is a perspective view of the present invention shaped like a cereal box.
Figure 102:
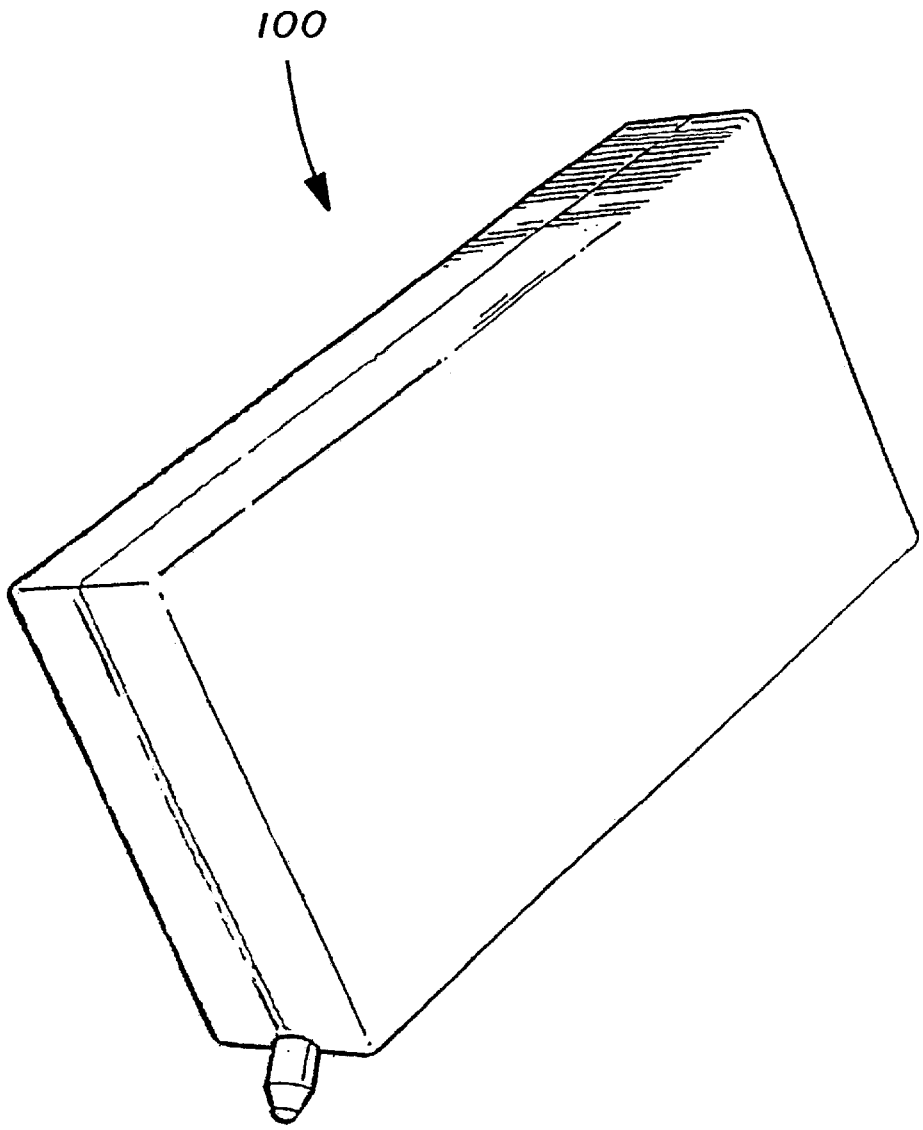
FIG. 102 is a perspective view of the present invention shaped like a cigarette pack.
Figure 103:
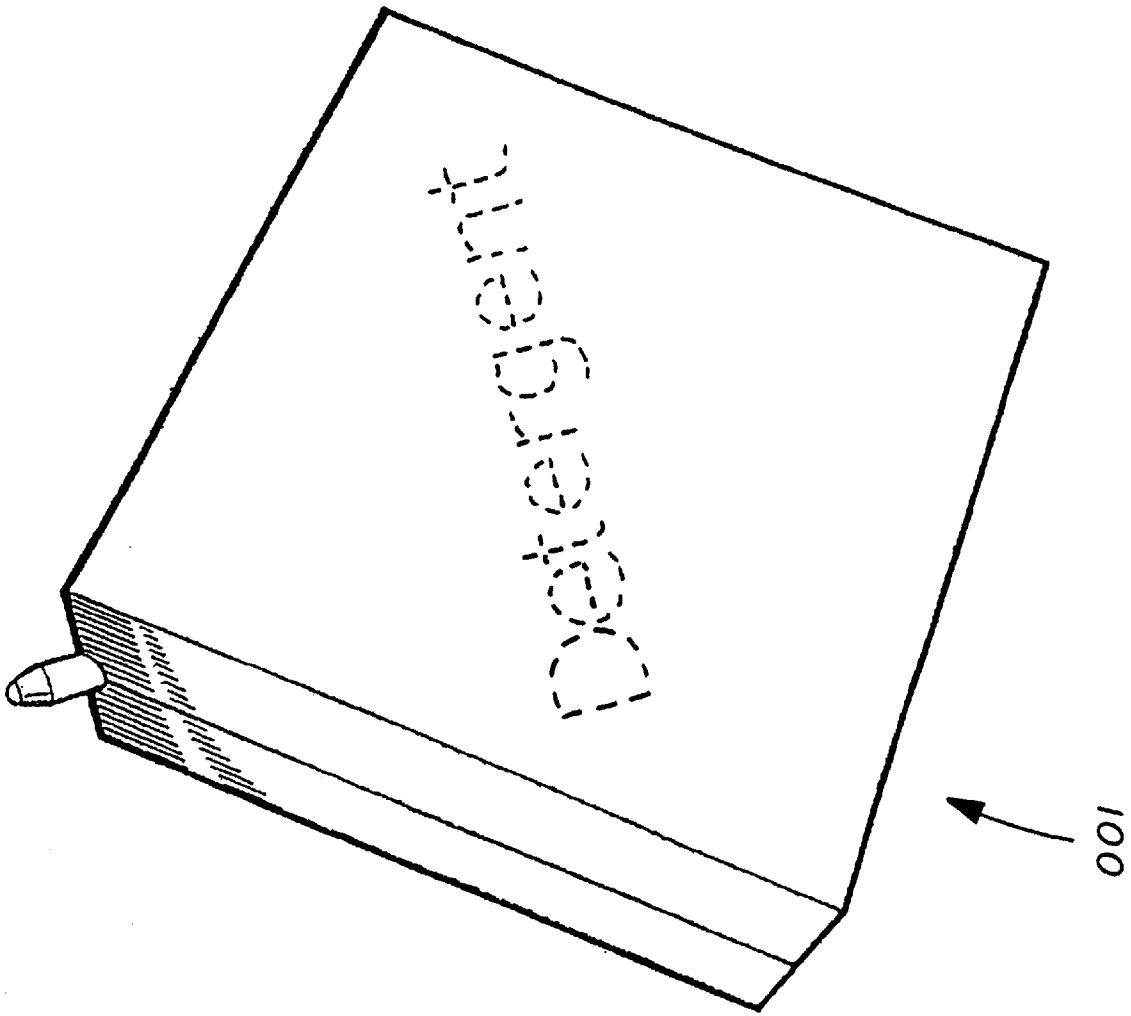
FIGS. 103 and 104 are perspective views of the present invention shaped like a laundry detergent container.
Figure 104:
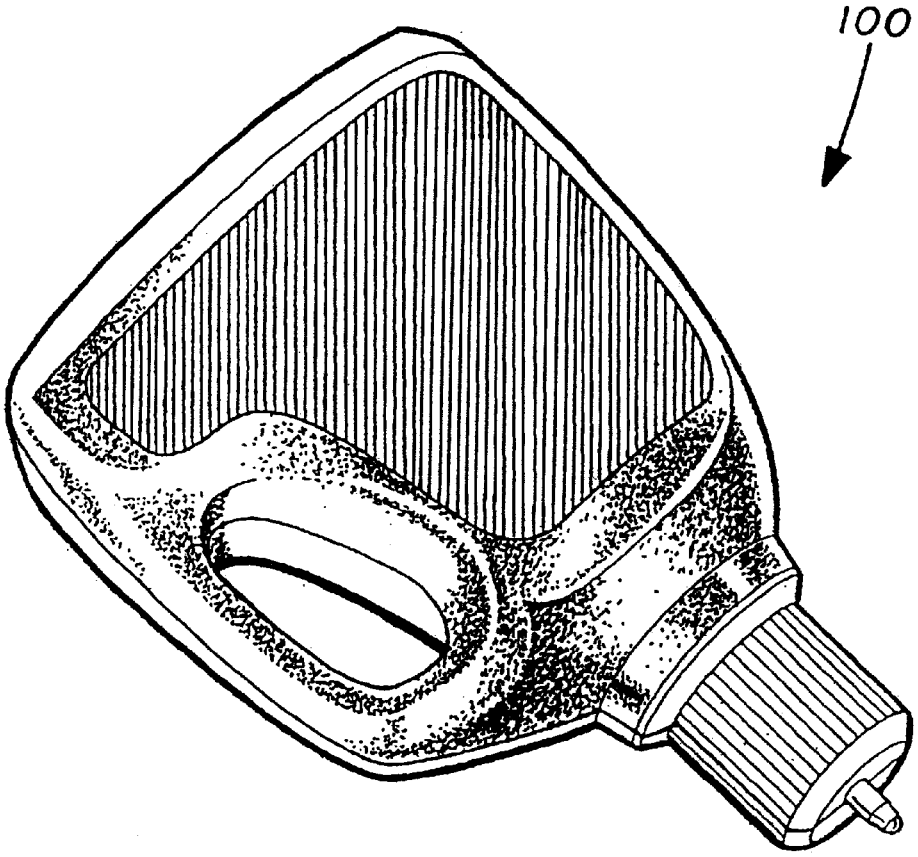
Figure 105:
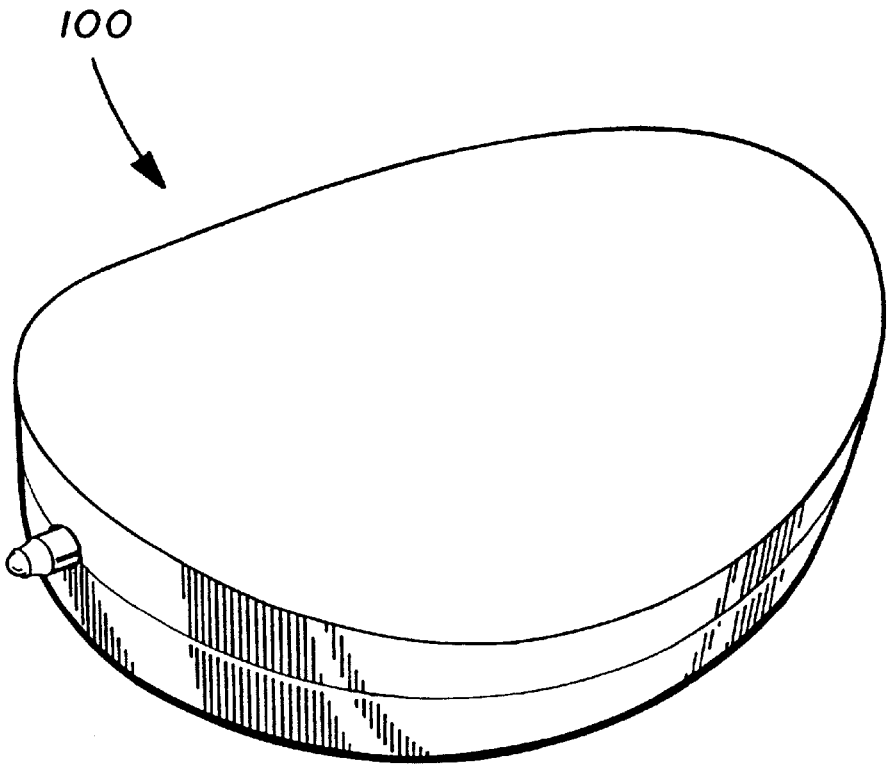
FIG. 105 is a perspective view of the present invention shaped like a bar of soap.
Figure 106:
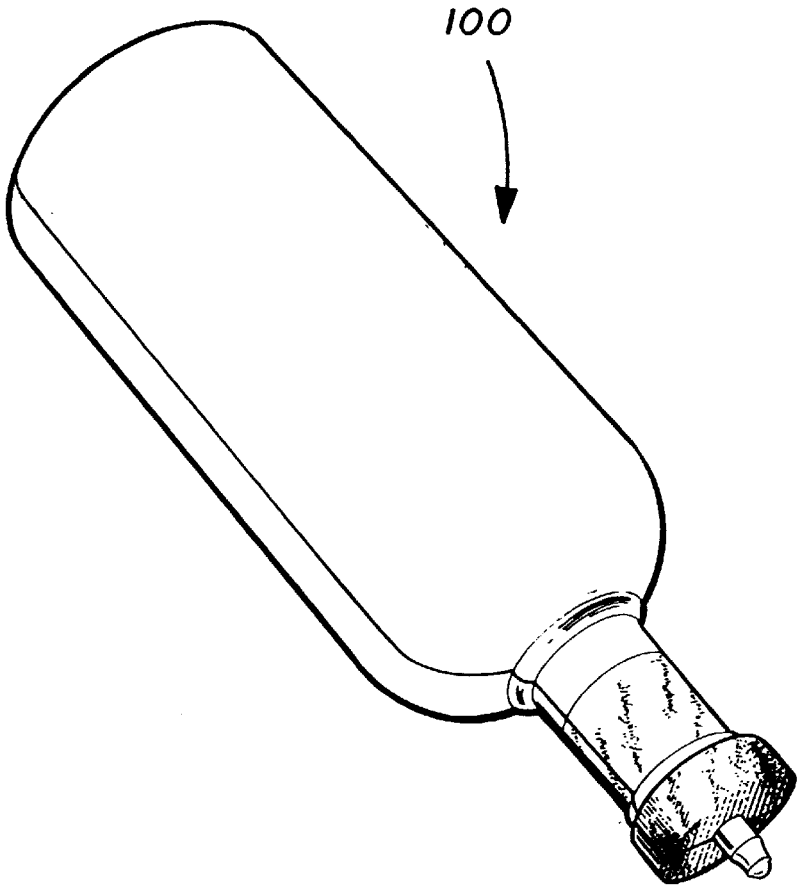
FIG. 106 is a perspective view of the present invention shaped like a bottle of alcohol.
Figure 107:
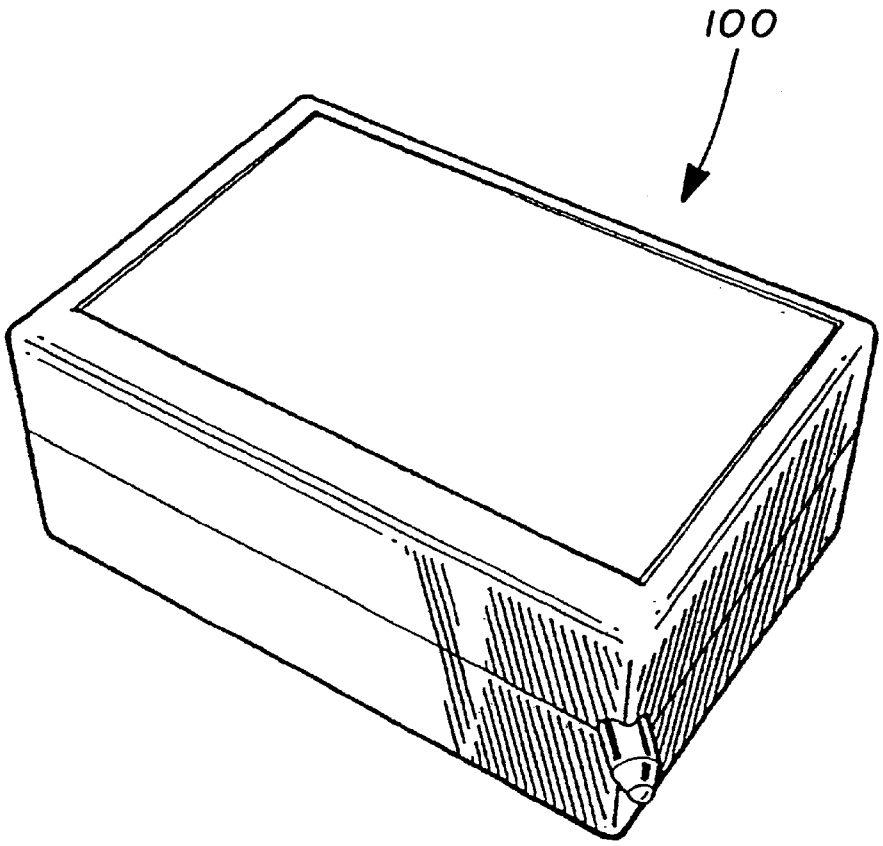
FIG. 107 is a perspective view of the present invention shaped like a box for a bar of soap.
Figure 108:
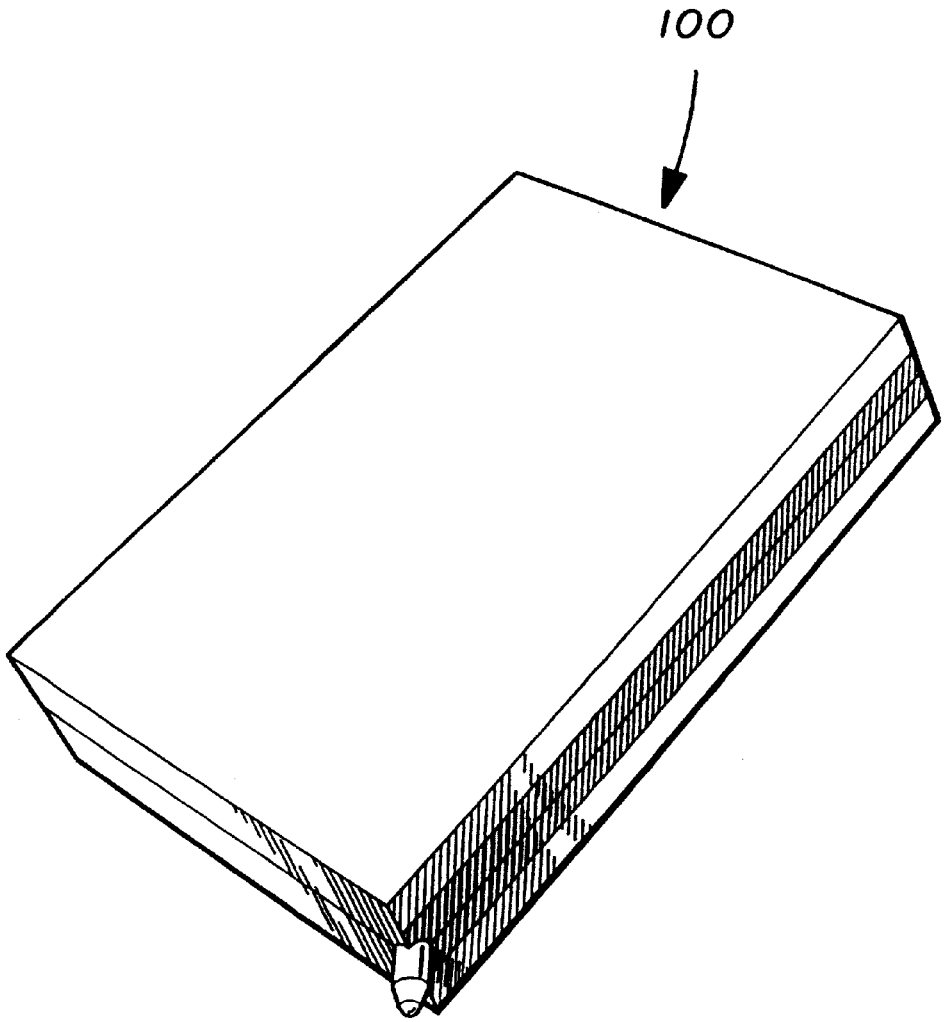
FIG. 108 is a perspective view of the present invention shaped like a matchbox.

As described above, in addition to the bottle cap shown, the appearance of the outer housing 102 may be that of any of several familiar and/or proprietary objects. A partial listing of such objects is set forth below:

- a double sided bottle cap as shown in FIG. 41 and a single sided bottle cap, such as a Clorox® bottle cap, as shown in FIG. 41A;
- food items, such as a cookie and a hamburger as shown in FIGS. 42–43;
- a compact disk as shown in FIG. 44;
- a gambling chip as shown in FIG. 45;
- candy such as M&Ms® or Lifesavers® as shown in FIGS. 46–48;
- a computer chip, such as Intel's Pentium® I, II or III chips, as shown in FIGS. 49 and 49A;
- a floppy disk such as shown in FIG. 50;
- rotary and digital watches such as shown in FIGS. 51 and 52 (this embodiment may comprise an actual working watch affixed to a cover, or a non-working replica of a watch face);
- a cover of a container, such as an ice cream container, as shown in FIGS. 53 and 53A;
- a coaster as shown in FIG. 54;
- a pill and capsule such as shown in FIGS. 55, 56 and 56A;
- a plate as shown in FIG. 57;
- a makeup compact as shown in FIG. 58;
- a rivet such as shown in FIG. 59;
- a coin as shown in FIGS. 60 and 60A;

a cracker such as shown in FIG. 61;

a rotary phone dial as shown in FIG. 62;

a tire as shown in FIG. 63;

a chocolate chip cookie as shown in FIG. 64 (this embodiment may comprise back-to-back cookies as shown or a single cookie);

a pizza as shown in FIG. 65;

a bottle, such as a Coca-Cola® bottle, as shown in FIG. 66;

a hockey puck as shown in FIG. 67;

a golfball as shown in FIG. 68 (the ball may be spherical as in FIG. 68, or it may have a slimmer profile including convex surfaces or flattened convex surfaces as shown in the cross-sectional views of the housing 102 in FIGS. 68A and 68B, respectively, to be more compact);

a basketball as shown in FIG. 69 (the ball may be spherical as in FIG. 69, or it may have a slimmer profile including convex surfaces or flattened convex surfaces as shown in the cross-sectional views of the housing 102 in FIGS. 69A and 69B, respectively, to be more compact);

a soccer ball-as shown in FIG. 70 (the ball may be spherical as in FIG. 70, or it may have a slimmer profile including convex surfaces or flattened convex surfaces as shown in the cross-sectional views of the housing 102 in FIGS. 70A and 70B, respectively, to be more compact);

a tennis ball as shown in FIG. 71 (the ball may be spherical as in FIG. 71, or it may have a slimmer profile including convex surfaces or flattened convex surfaces as shown in the cross-sectional views of the housing 102 in FIGS. 71 A and 71B, respectively, to be more compact);

a football as shown in FIG. 72 (the ball may be shaped like an inflated football as in FIG. 72, or it may have a slimmer profile including convex surfaces or flattened convex surfaces as shown in the cross-sectional views of the housing 102 in FIGS. 72A and 72B, respectively, to be more compact);

a baseball as shown in FIG. 73 (the ball may be spherical as in FIG. 73, or it may have a slimmer profile including convex surfaces or flattened convex surfaces as shown in the cross-sectional views of the housing 102 in FIGS. 73A and 73B, respectively, to be more compact);

a volleyball as shown in FIG. 74 (the ball may be spherical as in FIG. 74, or it may have a slimmer profile including convex surfaces or flattened convex surfaces as shown in the cross-sectional views of the housing 102 in FIGS. 74A and 74B, respectively, to be more compact);

a compact disk case as shown in FIG. 99;

a book as shown in FIG. 100;

a cereal box as shown in FIG. 101;

a cigarette pack as shown in FIG. 102;

laundry detergent containers as shown in FIGS. 103 and 104;

a bar of soap as shown in FIG. 105;

a bottle containing a beverage or alcohol such as shown in FIG. 106;

a box for a bar of soap as shown in FIG. 107; and a match box as shown in FIG. 108.

It is understood that the above list is exemplary and it is understood that the outward appearance of the writing instrument 100 may have many other additional shapes and appearances in alternative embodiments. For example, the writing instrument may comprise a generic object, or slug, having blank covers and edges. Still further examples include a writing instrument 100 having a transparent cover affixed to the outer surface of cover 104 and/or 106, into which transparent cover a photo or other picture may be placed. The outer surface of cover 104 and/or 106 may alternatively be coated with a material capable of accepting a fingerprint. In a still further example, the outer surface of cover 104 and/or 106 may include a material that changes color with a change in pressure or temperature. Such materials are known and used for example in so-called "mood rings". In another embodiment, one or both covers may be coated with a fragrance in accordance with so-called "scratch and sniff" technology. Although the pen is shown in the above described figures as protruding from a side between two corners of the generally square-shaped embodiments, it is understood that the pen tip may alternative protrude from a corner where two sides come together. Moreover, it is understood that a writing instrument shaped or appearing as any of the above-described objects can operate in accordance with each of the above-described embodiments for extending and retracting the pen cartridge.

For example, the lifesaver embodiment of FIG. 48, including a hole in the middle of the writing instrument, can operate with the cam assembly of FIGS. 4–9. This particular configuration is shown in FIGS. 78–82 where writing instrument 100 includes a central hole 250. As described above with respect to FIGS. 4–9, when the writing instrument 100 in FIGS. 78–82 is assembled, the pen guide 128 lies between the respective covers 104 and 106. Rotation of the second cover clockwise from the view of FIGS. 80–82 with respect to the first cover causes rotation of the track 124 as shown. Rotation of the track 124 in turn causes translation of the track following section 132, which is constrained to translate horizontally from the views of FIGS. 78–82 as a result of the guide following sections 136 (not shown in FIGS. 78–82) riding along the linear guides 126. Thus, rotation of the second cover from the position shown in FIG. 80, through the position shown in FIG. 81, to the position shown in FIG. 82 results in the writing end of the cartridge 138 moving from its retracted position to its extended position.

As stated above, each of the embodiments shown in FIGS. 41–74A can operate in accordance with any of the above-described embodiments for extending and retracting the pen cartridge. Therefore, the seam shown for example in FIGS. 41, 41A, 44, 45, 47A, 48, 49A, 51–56A, 60A–65, and 67–47B can be between two rotationally engaged sections of the housing, or between two fixedly engaged sections of the housing.

It is understood that the outward shape of the writing instrument may take on various three dimensional shapes in alternative embodiments. For example, the instrument 100 may be cylindrically shaped, such as for example in the shape of a can or a bottle, or may be irregularly shaped, such as for example in the shape of a person, character or automobile. For such embodiments, the internal components according to the various embodiments described above for extending and retracting the pen cartridge may be housed within an internal compartment within the outer housing. (It may not be practical to use rotating components to extend and retract the pen cartridge in some of these alternative shape embodiments.)

In embodiments where the housing 102 is shaped for example like a bottle, a viscous liquid may be provided in a sealed area within the housing 102, isolated from the internal compartment in which the extending and retracting components are located. In such embodiments, the liquid may create the impression of the liquid being poured from the bottle as the writing instrument is tilted downward to the writing position. Moreover, in for example the gravity-activated embodiment described above, a conventional damper may be employed to slow the movement of the pen cartridge as the pen cartridge extends from and retracts into the housing, thus creating the impression that the pen tip is being poured out of the housing 102.

Figure 75:
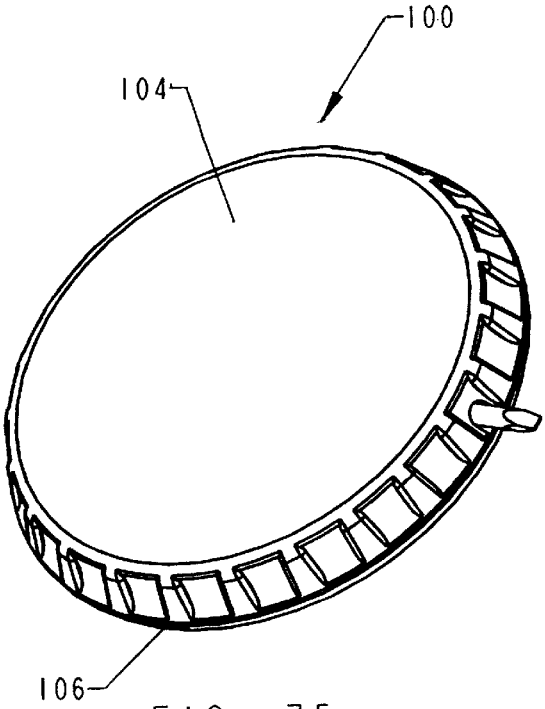
FIG. 75 is a perspective view showing a screwdriver extending from the housing instead of a writing instrument.
Figure 76:
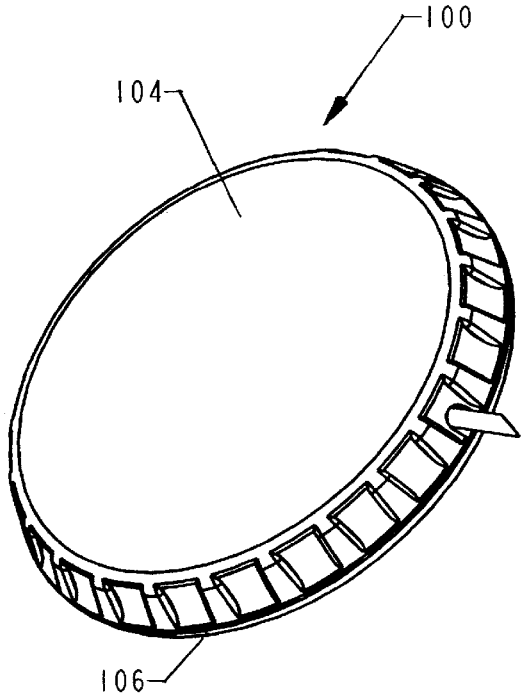
FIG. 76 is a perspective view of the instrument showing a cutting blade extending from the housing instead of a writing instrument.
Figure 77:
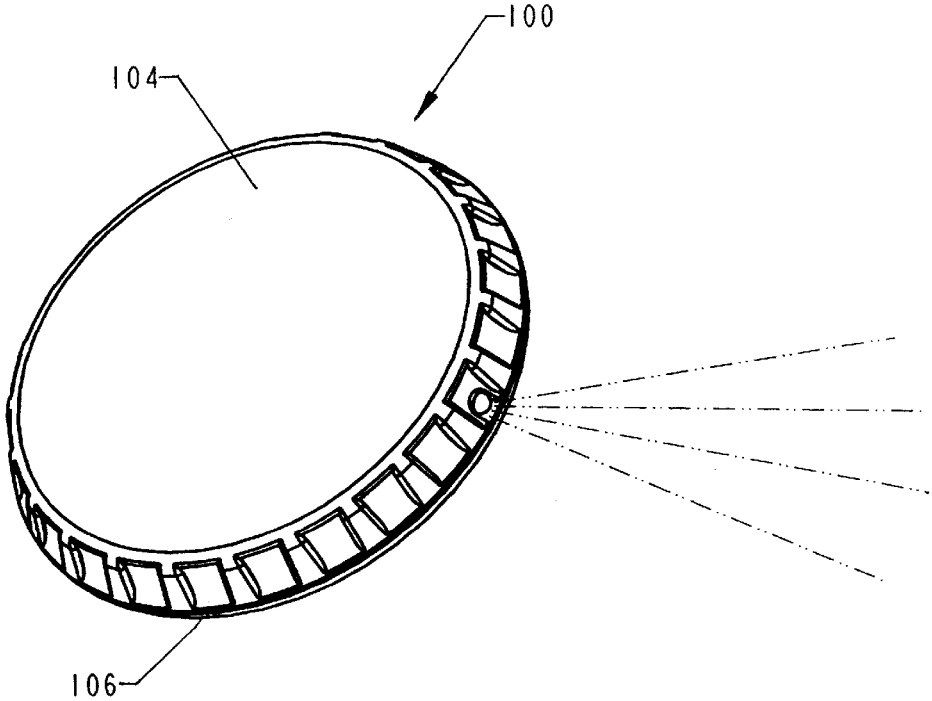
FIG. 77 is a perspective view of the instrument showing a flashlight extending from the housing instead of a writing instrument.
Figure 78:
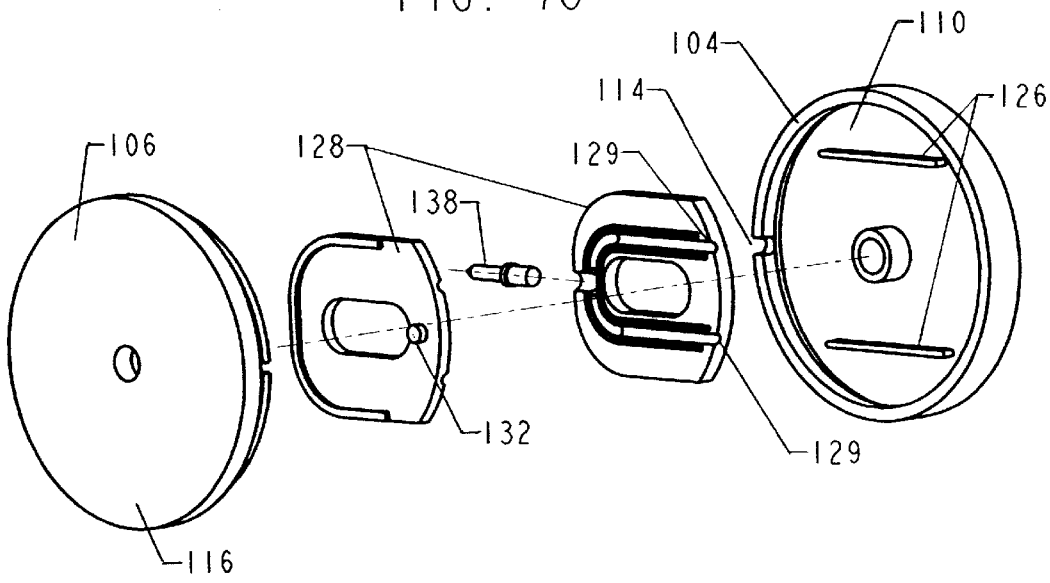
FIGS. 78–82 illustrate perspective and top views of an embodiment of the present invention including a hole in the center of the writing instrument.
Figure 79:
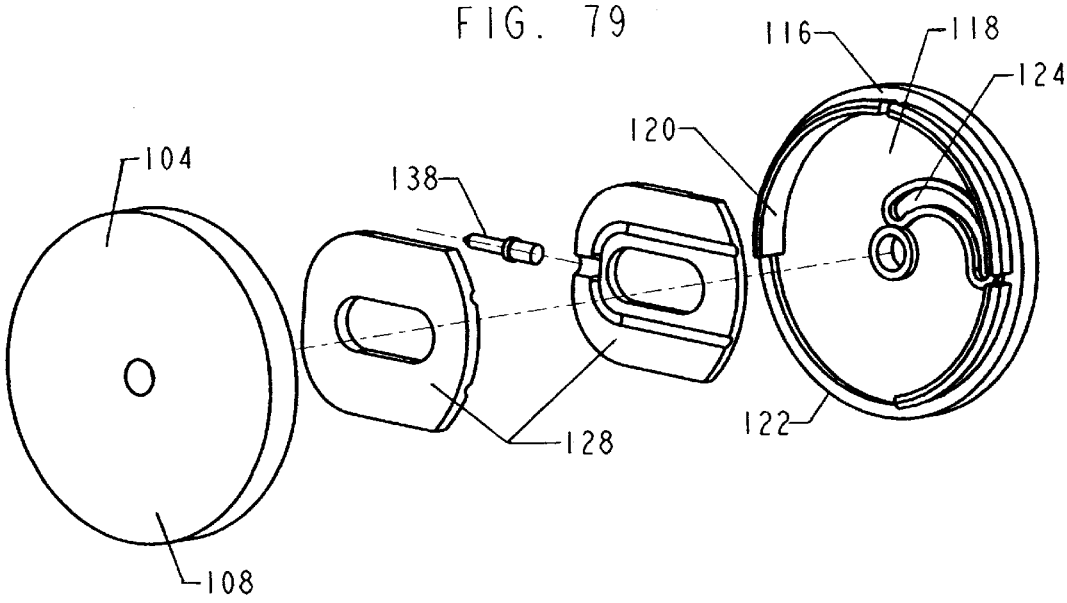
Figure 81:
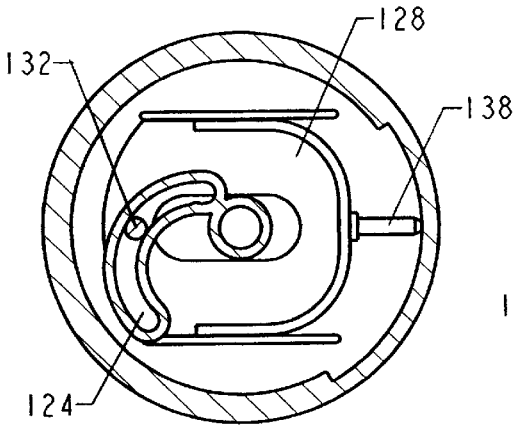
Figure 80:
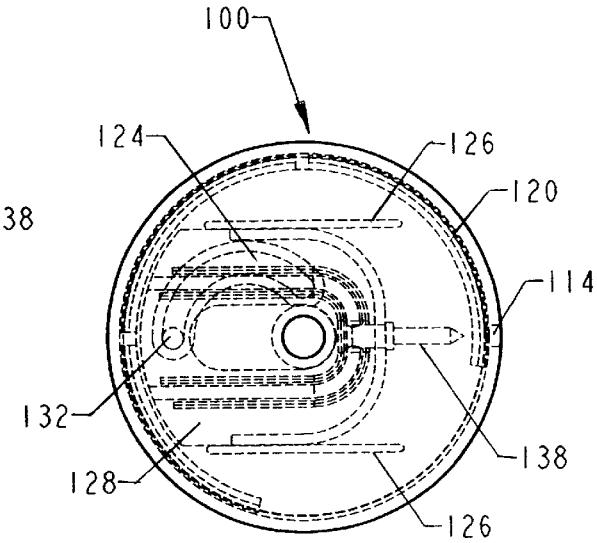
Figure 82:
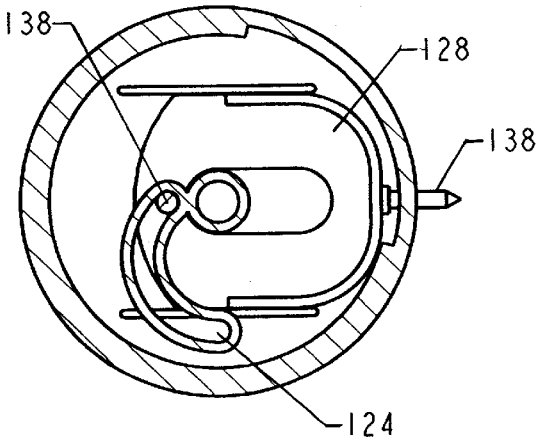

As set forth briefly above, while a preferred embodiment of the present invention relates to a writing instrument, it is understood that other tools may be mounted within housing 102. Such tools can have an outer appearance of a familiar and/or proprietary object as described above, and can be extended and retracted in accordance with the various embodiments described above. For example, as shown in FIGS. 75 and 76, respectively, a screwdriver or cutting blade may be provided within housing 102. Moreover, as shown in FIG. 77, a light source may be provided within housing 102. In such an embodiment, in addition to extending and retracting the light source, the internal mechanisms can activate the light source when it is extended, and can deactivate the light source when it is retracted. It is further understood that the mechanisms for activating and deactivating the light source may be separate from those extending and retracting the light source. Further still, it is contemplated that the internal mechanisms merely activate and deactivate the light source, without extending or retracting it.

In further alternative embodiments, it is contemplated that writing instrument 100 include a wide variety of battery or solar powered electronics. In such instances the electronics can be activated upon extension or retraction of the pen cartridge. In addition to the light source describe above, the electronics may include a sound chip for emitting audible sounds, words and/or melodies.

It is an advantage of the present invention that it provides a much more effective promotional and marketing vehicle than that presented by conventional printing on the side of a writing instrument. This is so because the pen does not have the word "Oreo"® printed on its side, it is an Oreo®; it does not have a picture of an auto manufacturer's emblem on its side, it is the emblem; it does not have a picture of a Coca-Cola® bottle on its side, it is a Coca-Cola® bottle, or at least close replicas thereof. The present invention conjures a corporate image without having to read or study information printed on a side of a pen, and thus provides a more effective at-a-glance marketing tool than words or information about the object could ever be. Moreover, a writing instrument according to the present invention will have much greater value as a novelty item than conventional pens.

Although the invention has been described in detail herein, it should be understood that the invention is not limited to the embodiments herein disclosed. Various changes, substitutions and modifications may be made thereto by those skilled in the art without departing from the spirit or scope of the invention as described and defined by the appended claims.

I claim:

1. A writing instrument comprising:

a housing having an outward appearance of a familiar or proprietary object, said housing further including a first cover element and, a second cover element movably affixed to, and biased coextensive with, said first cover element;

a writing assembly located within said housing, said writing assembly having a writing tip, and capable of moving between a first or retracted position wherein said writing tip is retracted within said housing, and a second or extended position wherein said writing tip is extended from said housing, wherein the writing tip can be extended from or retracted into said housing by a displacement of said first cover element with respect to said second cover element.

2. A writing instrument comprising:

a housing having an outward appearance of a familiar or proprietary object, said housing further including a first cover element, said first cover element includes an interior wall and a plurality of posts located thereon, each of which posts includes a lip;

a second cover element movably affixed to, and biased coextensive with, said first cover element, said second cover element includes an interior wall and a plurality of slots located therein, wherein the lip of each post mates with, and is capable of sliding within a corresponding slot, to allow the first and second cover elements to slide with respect to each other;

a plurality of formations located within said first and/or second cover elements and providing a plurality of ratchet tracks;

a writing assembly located within said housing, said writing assembly having a writing tip, and capable of moving between a first or retracted position wherein said writing tip is retracted within said housing, and a second or extended position wherein said writing tip is extended from said housing, said writing assembly includes a plunger that abuts against an interior wall of either the first or second cover, and an actuator coupled to said plunger and configured to alternately rotate between first and second ratchet positions, said actuator including a plurality of teeth, wherein in a first rachet position the teeth of the actuator do not catch on the ratchet tracks, and the writing assembly remains in a retracted position, and wherein in a second rachet position the teeth of the actuator catch on the tracks, and the writing assembly is held in an extended position; and, wherein the writing tip can be extended from or retracted into said housing by advancing the first cover element relative to the second cover element to depress the plunger and to cause the actuator to rotate between said first and second ratchet positions.

3. A writing instrument as recited in claim 1, wherein said outward appearance is that of a compact disk case.

4. A writing instrument as recited in claim 1, wherein said outward appearance is that of a book.

5. A writing instrument as recited in claim 1, wherein said outward appearance is that of a pack of cigarettes.

6. A writing instrument as recited in claim 1, wherein said outward appearance is that of a detergent container.

7. A writing instrument as recited in claim 1, wherein said outward appearance is that of a bar of soap.

8. A writing instrument as recited in claim 1, wherein said outward appearance is that of a soap container.

9. A writing instrument as recited in claim 1, wherein said outward appearance is that of a bottle of alcohol.

10. A writing instrument as recited in claim 1, wherein said outward appearance is that of a box of matches.

11. A writing instrument as recited in claim 1, wherein said outward appearance is that of a cereal box.

12. A writing instrument as recited in claim 1, wherein said outward appearance is that of a pizza.

13. A writing instrument as recited in claim 1, wherein said outward appearance is that of a bottle.

14. A writing instrument as recited in claim 1, wherein said outward appearance is that of a hockey puck.

15. A writing instrument as recited in claim 1, wherein said outward appearance is that of a golf ball.

16. A writing instrument as recited in claim 1, wherein said outward appearance is that of a basketball.

17. A writing instrument as recited in claim 1, wherein said outward appearance is that of a tennis ball.

18. A writing instrument as recited in claim 1, wherein said outward appearance is that of a football.

19. A writing instrument as recited in claim 1, wherein said outward appearance is that of a baseball.

20. A writing instrument as recited in claim 1, wherein said outward appearance is that of a volley ball.

21. A writing instrument as recited in claim 1, wherein said outward appearance is that of a soccer ball.

22. A writing instrument as recited in claim 1, wherein said outward appearance is that of a cookie.

23. A writing instrument as recited in claim 1, wherein said outward appearance is that of a tire.

24. A writing instrument as recited in claim 1, wherein said outward appearance is that of a rotary phone dial.

25. A writing instrument as recited in claim 1, wherein said outward appearance is that of a coin.

26. A writing instrument as recited in claim 1, wherein said outward appearance is that of a plate.

27. A writing instrument as recited in claim 1, wherein said outward appearance is that of a pharmaceutical pill or capsule.

28. A writing instrument as recited in claim 1, wherein said outward appearance is that of a container top.

29. A writing instrument as recited in claim 1, wherein said outward appearance is that of a coaster.

30. A writing instrument as recited in claim 1, wherein said outward appearance is that of a watch.

31. A writing instrument as recited in claim 1, wherein said outward appearance is that of a computer chip.

32. A writing instrument as recited in claim 1, wherein said outward appearance is that of a floppy disk.

33. A writing instrument as recited in claim 1, wherein said outward appearance is that of a piece of candy.

34. A writing instrument as recited in claim 1, wherein said outward appearance is that of a hamburger.

35. A writing instrument as recited in claim 1, wherein said outward appearance is that of a bottle cap.

* * * * *